US006486600B1

(12) United States Patent
Azuma et al.

(10) Patent No.: US 6,486,600 B1
(45) Date of Patent: Nov. 26, 2002

(54) IMAGE DISPLAY APPARATUS

(75) Inventors: Hiroo Azuma, Atsugi; Kohei Nakata, Machida; Masaaki Ogura, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/348,671

(22) Filed: Jul. 6, 1999

Related U.S. Application Data

(62) Division of application No. 08/768,472, filed on Dec. 18, 1996, now Pat. No. 5,925,979.

(30) Foreign Application Priority Data

| | | |
|---|---|---|
| Dec. 19, 1995 | (JP) | 7-330460 |
| Dec. 19, 1995 | (JP) | 7-330462 |
| Dec. 19, 1995 | (JP) | 7-330463 |
| Dec. 16, 1996 | (JP) | 8-335996 |

(51) Int. Cl.[7] ..... H01J 17/24

(52) U.S. Cl. ..... 313/496; 313/553; 313/495; 313/554

(58) Field of Search ..... 313/422, 553, 313/554, 555, 495, 558, 497, 557, 461, 496

(56) References Cited

U.S. PATENT DOCUMENTS

| | | | |
|---|---|---|---|
| 5,525,861 A | 6/1996 | Banno et al. | 313/495 |
| 5,731,660 A | 3/1998 | Jaskie et al. | 313/495 |
| 5,734,226 A | 3/1998 | Cathey | 313/553 |

FOREIGN PATENT DOCUMENTS

| | | |
|---|---|---|
| EP | 0 708 471 | 4/1996 |
| JP | 56-44534 | 10/1981 |
| JP | 61-32336 | 2/1986 |
| JP | 5-151916 | 6/1993 |
| JP | 7-288092 | 10/1995 |
| JP | 7-296732 | 11/1995 |
| JP | 7-296748 | 11/1995 |

*Primary Examiner*—Vip Patel
*Assistant Examiner*—Ken A Berck
(74) *Attorney, Agent, or Firm*—Fitzpatrick, Cella, Harper & Scinto

(57) ABSTRACT

An image display apparatus which is subjected to getter flashing during manufacturing, for the purpose of increasing the degree of vacuum in the air-tight container thereof, is provided with a getter scattering prevention member comprised of a plurality of getter scattering prevention walls. The getter scattering prevention walls prevent getter material from scattering to the image display portion of the image display apparatus, while allowing for smooth conductance of gas in the air-tight container during evacuation. Thus, evacuation by the getter can be further improved by increasing the area to which getter adheres to, deterioration of the image quality can be prevented by not allowing getter to adhere to the image display portion, the air-tight container can be evacuated in a shorter time, irregularities in brightness of the screen due to uneven pressure within the display portion can be done away with, and a higher degree of vacuum can be attained. Consequently, an image display apparatus with good image quality and a long life expectancy is provided.

6 Claims, 39 Drawing Sheets

FIG. 22A1
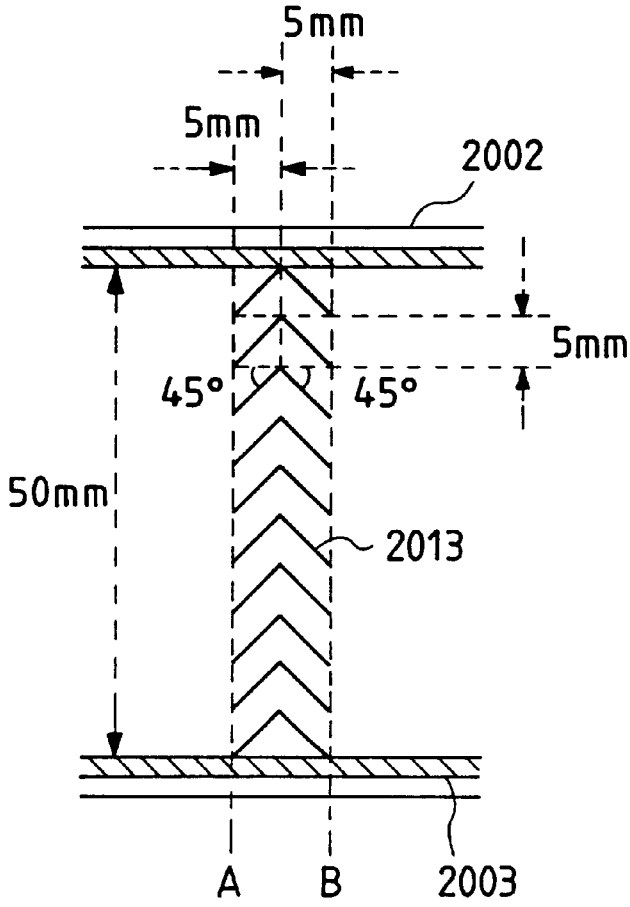
FIG. 22A2
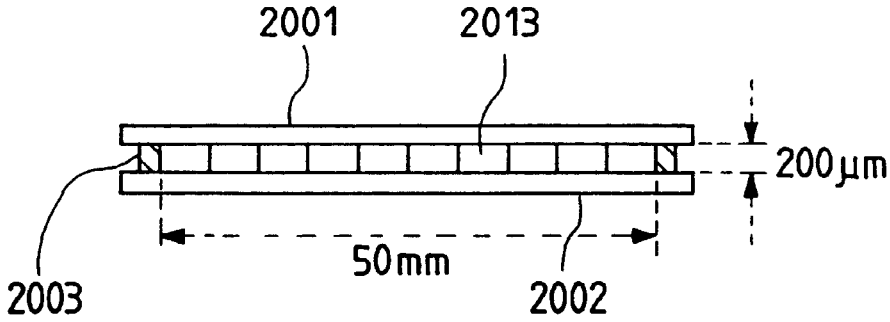

FIG. 22B1
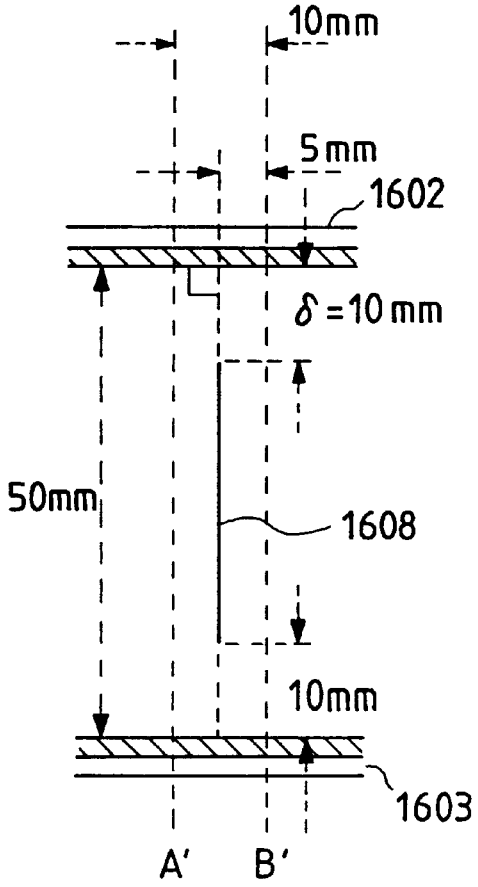
FIG. 22B2
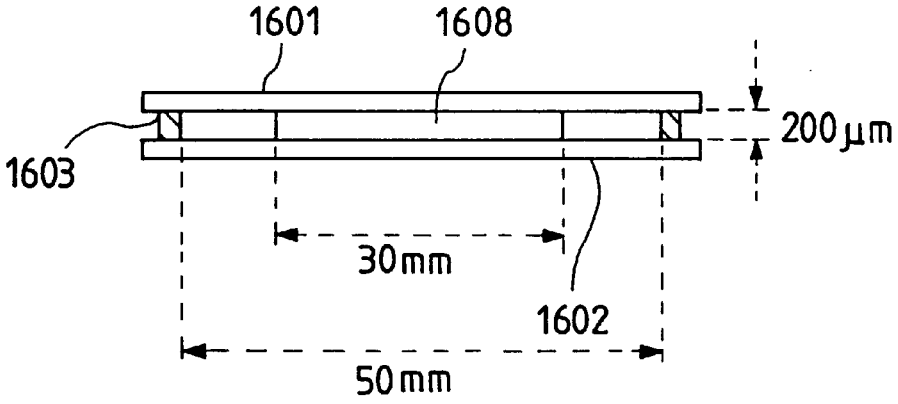

FIG. 37A1
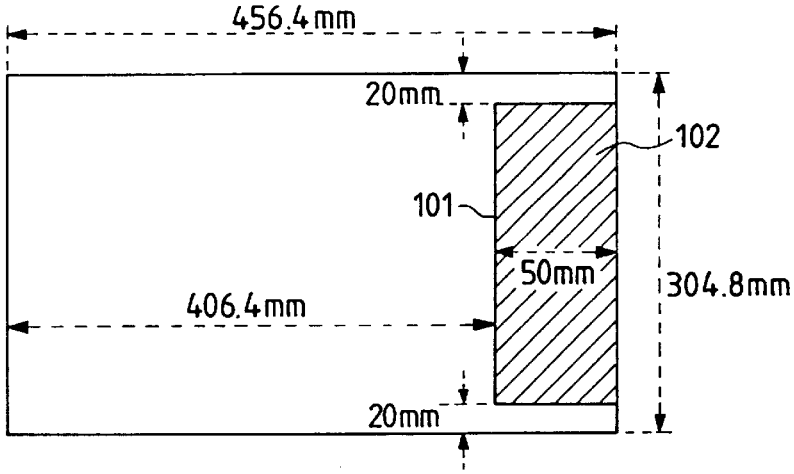
FIG. 37A2
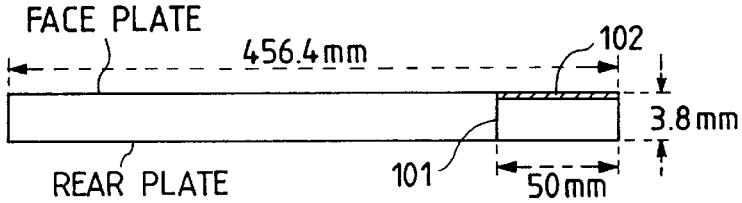
FIG. 37B1
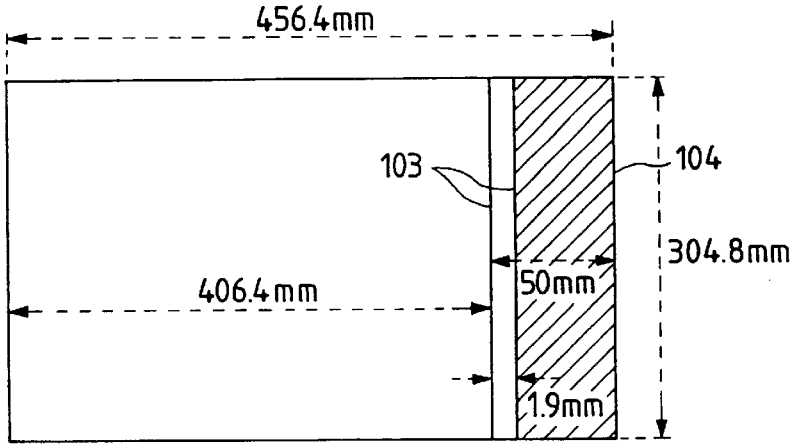
FIG. 37B2
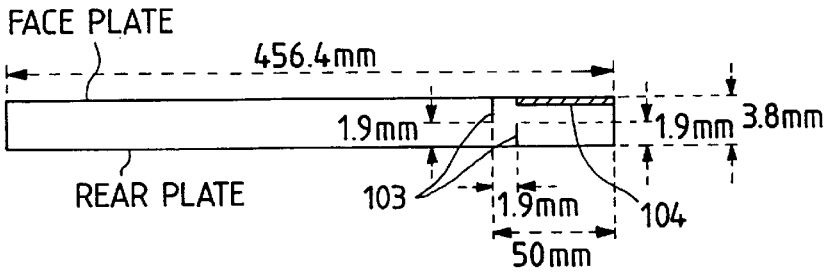

IMAGE DISPLAY APPARATUS

This application is a division of application Ser. No. 08/768,472, filed Dec. 18, 1996 now U.S. Pat. No. 5,925, 979.

BACKGROUND OF THE INVENTION

1. Field of the Invention

The present invention relates to a flat-type image display apparatus, and particularly to an image display comprising getter and a getter scattering preventive member.

2. Related Background Art

There have been known image display apparatuses such as those using liquid crystal, electron beam, EL (electroluminescence), and of these the most commonly used image display apparatus for television is that employing the cathode-ray tube.

Television apparatuses using a cathode-ray tube generally have a disadvantage in that the depth of the apparatus is great in comparison to the size of the screen, thereby limiting the locations at which the television apparatus may be placed. Accordingly, in recent years, there has been research conducted on flat-type image display apparatuses which use electron beams, this arrangement requiring less depth of the apparatus than such employing the cathode-ray tube.

While flat-type image display apparatuses are smaller in volume than such employing cathode-ray tubes, the amount of gas emitted from the fluorescent material is great. Accordingly, a high level of skill is required to raise the degree of vacuum within the image display apparatus and further maintain that state.

Generally, in order to maintain the state within the sealed envelope at a high degree of vacuum, getter is employed. There are two types of getter; evaporation type, and non-evaporation type. With the evaporation type getter, the getter material is stored within an open container, following which this getter material is heated by means of conductive heating or electrical induction heating or the like, thus causing the getter material to evaporate (this process hereafter referred to as "flashing"), thereby causing the getter material to adhere to the interior of the envelope, consequently removing the gas from the airtight container. The non-evaporation type involves getter material being stored within an open container, following which the gas from is removed from the airtight container without causing flashing.

FIGS. 20A and 20B illustrate on e example of the structure of a known vacuum fluorescent display tube as disclosed in Japanese Patent Publication No. 56-44534, with FIG. 20A being a plan view, and FIG. 20B being a cross-sectional view along the line denoted by 20B—20B in FIG. 20A.

As illustrated in FIG. 20B, this known example comprises a face plate 1601 composed of insulating material such as glass serving as an image display screen, and a rear plate 1602 set so as to oppose the face plate 1601. The area of contact between the face plate 1601 and the rear plate 1602 is sealed by means of glass with a low melting point, supersonic soldering, or resin which hardens in the presence of ultraviolet rays.

Further, a getter scattering prevention wall 1608 which doubles as a filament support is provided within this envelope so as to face the face plate 1601 and the rear plate 1602 in a generally vertical manner, and to this getter scattering prevention wall 1608, getter 1605 is fixed. Further, on the face plate 1601 situated on the other side of the getter scattering prevention member 1608 from the side provided with getter, a plurality of display units are arrayed, with each display unit comprising an image pattern 4, a control grid 1610 for controlling the content of the image, and a filament 1609. The getter scattering prevention wall 1608 is provided so that the getter material from the getter 1605 does not pass over to the image display unit side. Incidentally, reference numeral 9 in FIGS. 20A and 20B denotes a getter film, this formed by means of flashing of the getter 1605.

The image display apparatus constructed as described above is generally evacuated by means of connecting a turbo molecular pump or the like to an evacuation tube (not shown) and evacuating, and when the degree of vacuum within the envelope reaches a sufficient level, the evacuation tube is sealed by means of being stopped and severed, following which the getter 1605 is flashed, thus completing the image display apparatus.

After completion of the image display apparatus, heating the filament (thermionic cathode) 1609 causes electrons generated by means of the heating to be accelerated by means of an anode comprising an image pattern 4 (not shown), and strike fluorescent material (not shown) comprising an image pattern. Consequently, an image is displayed on the face plate 1601.

On the other hand, Japanese Laid-Open Patent Application No. 61-32336 mentions that with a flat-type image display apparatus, the amount of metal, glass, and ceramic comprising the electrode structure is several times that of a cathode-ray tube, whereas the area to which getter can be deposited to by flashing is less. Particularly, the inner wall area of the glass container is markedly smaller with a flat-type image display apparatus as compared to a cathode-ray tube. Accordingly, within the Japanese Laid-Open Patent Application No. 61-32336 is disclosed a fibrous shielding member such as steel wool or steel wool coated with graphite, for the purpose of increasing the area to which getter can be deposited by flashing, and preventing the getter subjected to flashing from passing over to the electrode structure or wires, causing short-circuiting between the electrodes or wires. This fibrous member is placed, for example, continuously or intermittently around the space formed between the inner wall of the glass container and the rear side of the electrode structure, i.e., the space where evaporation deposition of the getter is conducted, thus limiting the spread of the getter which attempts to pass over, and also increasing the area to which deposition of getter occurs by means of causing evaporation deposition of the getter to the surface of the shielding member.

However, known image display apparatuses constructed as described above have problems such as described below.

(1) Narrowing the distance between the outer edges of the getter scattering prevention wall and the outer frame, or increasing the density of the fibrous shielding material, as is done with known art, decrease the flowability of residual gas, i.e., the conductance thereof, to the getter flashing area within the envelope. In such an event, the capability of the getter may not be sufficiently exhibited, or modifications in the brightness of the image may occur due to the pressure being uneven within the envelope. Further, this lengthens the amount of time required to evacuate the container via the evacuation tube.

(2) Widening the distance between the outer edges of the getter scattering prevention wall and the outer frame, or decreasing the density of the fibrous shielding material improves the conductance, but the getter material may pass over to the image display portion via the gap between the getter scattering prevention wall and the outer frame or via the gaps in the fibrous shielding material, thus adhering to the electron emission source or fluorescent material, and possibly causing short-circuiting of the wiring.

(3) Further, in the case of flat-type image display apparatuses, the area occupied by the electron emission source and the area occupied by the fluorescent material are often approximately the same, and moreover, the distance between the electron emission source and the fluorescent material corresponding to the depth of the CRT is around several hundred $\mu$m to several tens of mm.

Accordingly, the area capable of placement of getter within the flat-type image display apparatus is markedly reduced compared to that of the CRT, although the area of getter adhesion required therein is equal to or greater than that of the CRT, due to the degree of vacuum required being equal to or greater than that of the CRT. Consequently, it becomes important to secure area for placement of getter therein, increasing the amount of getter placed, and also preventing the aforementioned getter from passing over.

SUMMARY OF THE INVENTION

The present invention has been made to solve the aforementioned problems with the known art, and accordingly, it is an object of the present invention to provide an image display apparatus with a high degree of vacuum and a long working life expectancy, wherein the area to which getter adheres is great, the time require to evacuate the envelope by means of the evacuation tube is short, vapor evaporation of the getter is conducted without the getter material passing over to the image display portion, evacuation following sealing of the evacuation tube is conducted efficiently by means of the getter, and wherein pressure modifications within the image display apparatus do not occur.

According to an aspect of the present invention, there is provided an image display apparatus comprising: a face plate carrying fluorescent material; a rear plate situated so as to oppose the face plate; an outer frame disposed between the aforementioned face plate and rear plate, the outer frame being bonded to both plates, thus forming an envelope comprised of the aforementioned face plate, rear plate, and outer frame; fluorescent material excitation means situated within the aforementioned envelope; evaporation type getter situated within the aforementioned envelope at a position other than the position at which the aforementioned fluorescent material excitation means and getter are situated; and a plurality of getter scattering prevention walls provided as a means to prevent the getter evaporating from the aforementioned evaporation type getter from scattering to the portion within the aforementioned envelope where the fluorescent material and fluorescent material excitation means are situated.

Providing the getter scattering prevention member according to the present invention between the getter flashing portion and the image display portion provides the below-described advantages.

1. The getter material that has evaporated from the getter scatters radially in all directions. While the getter material has properties of adhering to walls with which collision occurs, rather than being deflected from the walls, molecules or atoms comprising gas are deflected from any walls they may collide with, and do not adhere to these walls. To be more precise, these molecules or atoms are not completely deflected with absolutely no adhesion whatsoever; a certain amount adheres thereto, depending on the gas, wall material, temperature, etc. The present invention takes advantage of the difference in properties between the getter material and gas, and provides a plurality of getter scattering prevention walls arrayed so that there is no linear optical path between the getter flashing portion where the getter is situated and the image display portion. Accordingly, there is no passing over of getter material to the display portion, thus avoiding undesirable effects such as shorting of wiring or undesirable effects to the electron-emitting devices and fluorescent material. Consequently, pixel defects owing to getter, which are fatal to the quality of an image display apparatus, are eradicated. Further, since there is no passing over of getter material as described above, there is no restriction to the image pattern (screen size) within the display area, as with known-apparatuses which have taken into account beforehand the passing over of getter. Rather, according to the present intention, the entirety of the image dispay area can be employed as image pattern (screen size), thus allowing for a larger and more imposing screen on an image display apparatus of the same size.
2. Particularly, in the event that a getter scattering prevention member is constructed of a plurality of plates forming a getter scattering prevention wall, the number of getters to be situated needs only be restricted by mechanical concerns, since there is no restriction regarding the direction of getter flash. Accordingly, a great number of getters may be deployed. Further, the total area of the face plate, rear plate, outer frame, and getter scattering prevention walls of the getter flashing portion are subject to getter material adhesion, thus effectively securing a large getter area, so that evacuation by means of getter can be conducted for a long period of time.
3. As described above, the getter material that has evaporated from the getter scatters radially in all directions. While the getter material has properties of adhering to walls with which collision occurs, rather than being deflected from the walls, molecules or atoms comprising gas are deflected from any walls they may collide with, and do not adhere to these walls. To be more precise, these molecules or atoms are not completely deflected with absolutely no adhesion whatsoever; a certain amount adheres thereto, depending on the gas, wall material, temperature, etc. The present invention takes advantage of the difference in properties between the getter material and gas, and provides a plurality of getter scattering prevention walls arrayed so that there is no linear optical path between the getter flashing portion where the getter is situated and the image display portion. Accordingly, the gas is capable of freely passing through the paths between walls neighboring the aforementioned walls, and can reach the getter flashing portion from the image display portion. Further, the paths neighboring the aforementioned walls are constructed throughout the entire area, so that conductance is good. Moreover, the conductance can be designed and controlled, so that the amount of time required for evacuation by means of the evacuation tube is shortened.

Accordingly, manufacturing costs of image display apparatuses can be lowered greatly. Further, conductance is good as described above, so that pressure distribution within the image display apparatus is reduced, the amount of time required for evacuation of gas which is generated from the fluorescent material and the like upon driving the apparatus, this evacuation conducted by means of getter, is shortened, and as a result, an image display apparatus wherein modifiedities in brightness and discharge are suppressed can be provided.

According to the above-described, an image display apparatus can be provided with a long working life expectancy, one which is stable over a long period of time, having high quality with no pixel defects or brightness modifiedities, and at a low cost.

BRIEF DESCRIPTION OF THE DRAWINGS

FIGS. 22A1, 22A2, 22B1 and 22B2 are explanatory drawings illustrating a comparison between the conductance of the getter scattering prevention member according to the present invention and the same of a known getter scattering prevention member, with FIGS. 22A1 and 22A2 illustrating the chevron-type getter scattering prevention member according to the present invention, and FIGS. 22B1 and 22B2 illustrating a known simple shield-plate-type getter scattering prevention member;

FIGS. 37A1, 37A2, 37B1 and 37B2 are explanatory drawings illustrating a comparison between a known getter scattering prevention member and the getter scattering prevention member according to the present invention, with FIGS. 37A1 and 37A2 illustrating an image display apparatus employing a known getter scattering prevention member, wherein FIG. 37A1 is a frontal view and FIG. 37A2 a cross-section view, and with FIGS. 37B1 and 37B2 illustrating an image display apparatus employing the getter scattering prevention member according to the present invention, wherein FIG. 37B1 is a frontal view and FIG. 37B2 a cross-section view.

DESCRIPTION OF THE PREFERRED EMBODIMENTS

The getter scattering prevention member according to the present invention will now be described in detail. There are three types of structures of the getter scattering prevention member according to the present invention.

The structure of the first getter scattering prevention member according to the present invention will be described with the following first through ninth embodiments. Further, the structure of the second getter scattering prevention member according to the present invention will be described with the following tenth through fifteenth embodiments. Moreover, the structure of the third getter scattering prevention member according to the present invention will be described with the following sixteenth through nineteenth embodiments.

First Embodiment

Figure 21A:
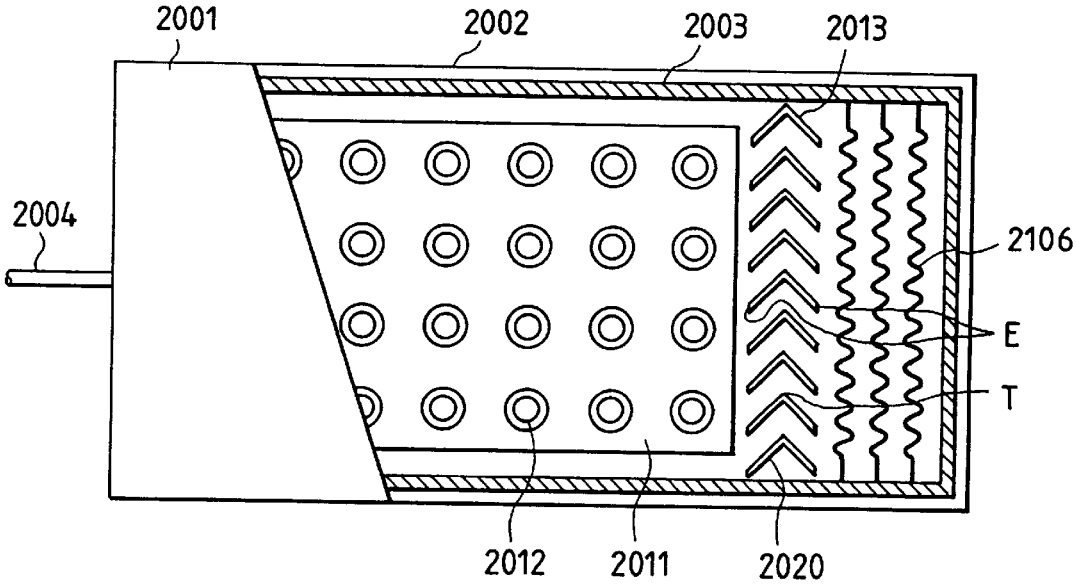
FIGS. 21A, 21B, 21C and 21D are drawings illustrating an embodiment of an image display apparatus according to the present invention, with FIG. 21A being a plan view, FIG. 21B a cross-section view in the depth direction of the apparatus, FIG. 21C a portion of the electron emission portion extracted, and FIG. 21D an example of wire-type getter.
Figure 21B:
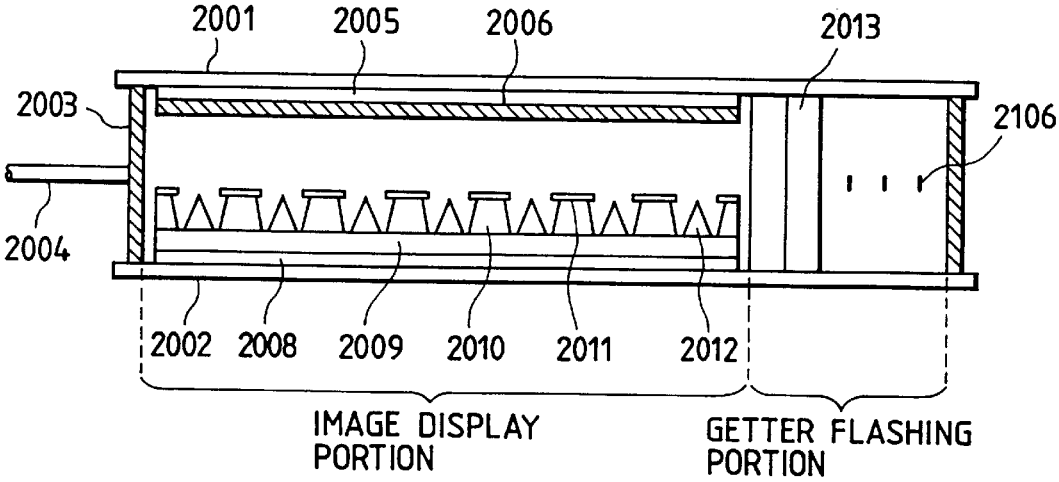
Figure 21C:
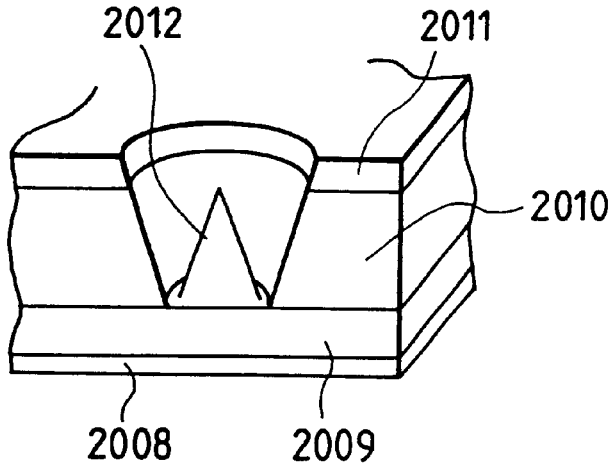

Description of the first embodiment involves that employing a field emitter array, otherwise known as FEA, as the fluorescence excitation means. FIG. 21A and FIG. 21B are drawings illustrating an embodiment of the image display apparatus according to the present invention, with FIG. 21A being a plan view, FIG. 21B a cross-section view in the depth direction of the apparatus, and FIG. 21C a portion of the electron emission portion extracted.

In FIG. 21A, reference numerals 2001 and 2002 denote substrates formed of insulating material such as glass or the like. The substrate 2001 shall be hereafter referred to as "face plate", and 2002, as "rear plate". In the present embodiment, glass was employed for both the face plate and the rear plate. Reference numeral 2106 denotes wire-type getter. The face plate 2001 and the rear plate 2002 may be sealed with an outer frame 2003 by means of glass with a low melting point, supersonic soldering, or resin which hardens in the presence of ultraviolet rays. In the present embodiment, glass was employed for the outer frame 2003, and glass with a low melting point was employed for sealing. An evacuation tube 2004 is provided to the outer frame 2003, so as to allow for forming of an envelope by means of sealing this evacuation tube 2004. However, this evacuation tube 2004 is unnecessary when assembly is conducted in a vacuum. The spacing between the face plate 2001 and the rear plate 2002 was set so as to be about 200 $\mu$m.

ITO thin-film 2005 and fluorescent material 2006 are formed on the inner wall of the face plate 2001. The ITO thin-film 2005 is employed as a positive electrode (anode) for accelerating the electrons emitted from the electron source. Also, in the event that several kV or more can be applied to the positive electrode, a metal back may be layered upon the fluorescent material.

The structure of the electron emission portion is as follows: cathode 2008 and resistor layer 2009 are formed on the inner wall of the rear plate 2002. On the resistor layer 2009 is formed an insulating layer 2010, and further, upon this is formed gate electrode 2011. Moreover, holes 0.4 to 1 $\mu$m in diameter are provided opened in the insulating layer 2010 and gate electrode 2011, and cone-type electron emitter 2012 are formed within these holes.

The resistor layer 2009 has been inserted in order to decrease the degree of fluctuation of the electrical current emitted from the electron emitter 2012, such a resistor layer being referred to as a current restricting resistor. It is known that the number of electrons emitted from a field emitter array generally differs greatly according to the state of the surface of the electron emitter, and impurities and the like. The resistor layer 2009 acts so as to decrease the potential difference between the electron emitter 2012 and the gate electrode 2011 in the event that the current flowing through the electron emitter 2012 is great, and to increase the potential difference between the electron emitter 2012 and the gate electrode 2011 in the event that the current flowing through the electron emitter 2012 is small. Accordingly, the degree of fluctuation of the electrical current emitted from the electron emitter 2012 adjusted so as to be decreased.

The cathode 2008 was set to 0V, the gate electrode to 50V, and the positive electrode (anode) comprised of the ITO thin-film 2005 to 400V.

The electrons emitted from the electron emitter 2012 are accelerated by means of the positive electrode comprised of the ITO thin-film 2005, and collide with the fluorescent material 2006 so as to form an image.

At the getter scattering prevention member 2013, a getter scattering prevention walls 2020 formed of V-shaped plates are arrayed linearly so that there can be no gap observed from the display portion, but also so that the plates not to come into contact with one another. The apexes T of the Vs all face in the same direction, and the plates are arrayed so that the apexes T are situated at the point which is the center of a line connecting the two ends E of the neighboring V. Such a getter scattering prevention member is referred to as a "chevron-type" getter scattering prevention member.

The chevron-type getter scattering prevention member 2013 is provided within the envelope in a direction generally vertical to the face plate 2001 and the rear plate 2002, thus dividing the envelope into two portions: the area where the electron-emitting devices are disposed (image display portion), and the area where getter flashing is conducted (getter flashing portion).

For the getter material to be set in the getter flashing portion of the envelope of the present embodiment, evaporation type getter such as Ba (barium) was used. Also, non-evaporation type getter such as Zr—Al (zirconium-aluminum) may be provided at an appropriate position and employed with the aforementioned getter in an aiding manner.

In the present embodiment, the getter scattering prevention member and getter flashing portion is provided only in the area of one side of the rectangle observed when the image display apparatus is viewed from the front. However, the numbers and the positions of the getter scattering prevention member and getter flashing portion are by no means limited to such an arrangement. For example, the getter scattering prevention member may be provided to all four sides of the rectangle observed when the image display apparatus is viewed from the front, with getter being provided so as to surround the image display portion.

There are various shapes and sizes of getter being used in practice, such as ring type and wire type. Accordingly, it is important to use appropriate types of getter according to the form of the envelope. For example, in the event that the spacing between the face plate and the rear plate, i.e., the depth of the interior of the envelope is several mm, ring-type getter is appropriable. However, in the event that an envelope is to be used wherein the spacing between the face plate and the rear plate is extremely narrow, ring-type getter may not be usable.

With the present embodiment shown in FIGS. 21A and 21B, the spacing between the face plate 2101 and the rear plate 2102 is extremely narrow, measuring only 200 $\mu$m, so that ring-type getter cannot be used. In such a case, the following methods are employed.

Figure 21D:
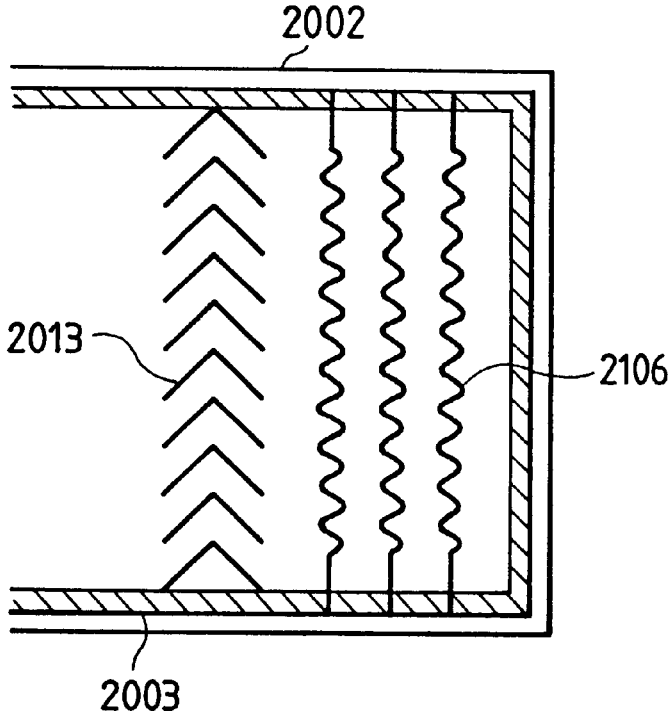

A first method involves employing wire-type getter, as with the present embodiment. FIG. 21D is a frontal view of an image display apparatus provided with wire-type getter 2106. The wire-type getter 2106 is formed by coating extremely fine metal wires with evaporation type getter such as Ba (barium); see Japanese Laid-Open Patent Application No. 5-151916. Both ends of the fine metal wires can be extended to the exterior of the envelope, for electrical induction heating.

A second method involves making the envelope of the image display apparatus a bi-layered structure (double chamber structure), i.e., providing separate chambers for the image display portion and the getter flashing portion, and connecting these two chambers with the getter scattering prevention member according to the prevention, e.g., chevron-type getter scattering prevention member or the like. This method is described in detail regarding the eighth embodiment in the present specification, accordingly description of this method will be omitted at this point.

With the image display apparatus according to the present invention, a turbo molecular pump is connected to the evacuation tube 2004 and evacuation is conducted. When the pressure within the container reaches $10^{-7}$ Torr or lower, the evacuation tube 2004 is sealed, and the getter 2014 is flashed, thus completing the image display apparatus.

Any type of insulating material can be used for the substrate material for the face plate 2001 and rear plate 2002, and the material for the outer frame 2003, so long as it is insulating material such as glass. However, the material for the face plate 2001 must be a light transparent material, in order to display an image.

Mo or Si can be used for the material comprising the cone-type electron emitter 2012 formed inside the holes opened in the insulating layer 2010 and gate electrode 2011.

The image display apparatus constructed as described above exhibited conductance superior to that of known image display apparatuses, thus allowing for evacuation to be conducted in a shorter time, and modifiedities in brightness of the screen were also reduced compared to the known apparatuses.

Figure 20A:
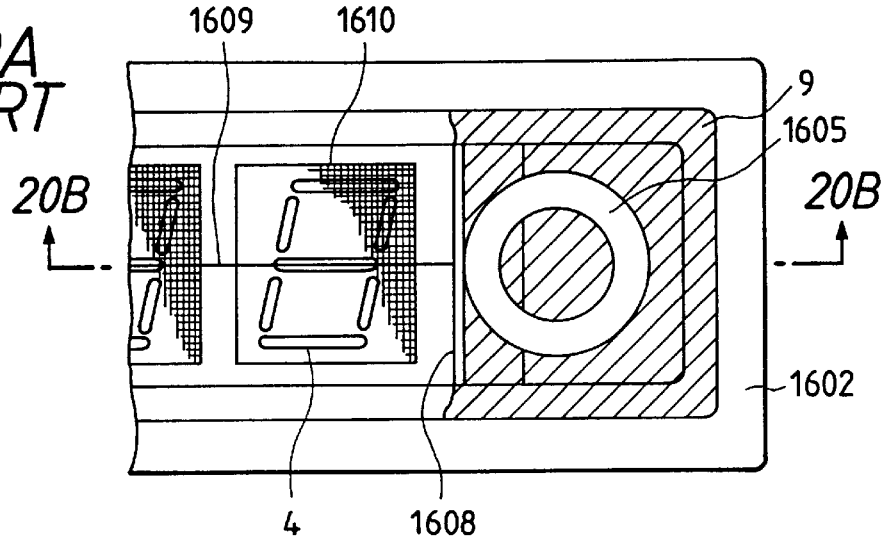
FIG. 20A PRIOR ART
FIGS. 20A and 20B are drawings illustrating a construction example of a known fluorescent display tube, FIG. 20A being a plan view, and FIG. 20B a cross-section view.

Next a comparison was made to find to what degree the chevron-type getter scattering prevention member according to the present invention denoted by reference numeral 2013 in FIG. 21A is superior to the known getter scattering prevention member comprised of a simple shield plate denoted by reference numeral 1608 in FIG. 20A, by mounting the known getter scattering prevention member in the image display apparatus according to the present invention. The conductance of the getter scattering prevention member according to the present invention was calculated as a comparative example.

FIGS. 22A1 and 22A2 are partial enlargements of the chevron-type getter scattering prevention member according to the present invention shown in FIGS. 21A and 21B, showing the form and size thereof. FIG. 21A1 is a frontal view, and FIG. 21A2 is a cross-section view in the depth direction of the apparatus. The chevron-type getter scattering prevention member 2013 are attached in a generally vertical direction to the rear plate 2002. The spacing between the face plate 2001 and rear plate 2002 was set at 200 $\mu$m. The length of the one side, observed when the image display apparatus is viewed from the front, to which the chevron-type getter scattering prevention member 2013 are attached, was made to be 50 mm.

The angle between the outer frame 2003 and the V-shaped plates comprising the chevron-type getter scattering prevention member 2013 was made to be 45°. According to the present embodiment, the V-shaped structure forming the chevron-type getter scattering prevention member 2013, 7.1 mm in length for both sides, was formed using two rectangular glass plates 7.1 mm ($5\sqrt{2}$mm) in length and 200 $\mu$m in width. Here the thickness of the glass was made to be so thin so as to be negligible. The angle of the apex of the V was made to be 90°.

FIGS. 22B1 and 22B2 are drawings of the known getter scattering prevention member comprised of a simple shield plate denoted by reference numeral 1608, showing the form and size thereof. FIG. 22B1 is a frontal view, and FIG. 22B2 is a cross-section view in the depth direction. According to the present embodiment, the getter scattering prevention member 1608 comprised of a simple shield plate was formed using a rectangular glass plate 30 mm in length and 200 $\mu$m in width. Here also, the thickness of the glass was made to be so thin so as to be negligible.

Incidentally, the reason that the image display apparatus employing the known getter scattering prevention member was provided with gaps of 10 mm in width on-both side between the plate and outer frame was to allow the degree of vacuum to be brought to a value similar to that of the image display apparatus employing the getter scattering prevention member according to the present invention, i.e., in the $10^{-8}$ Torrs, so as to make a comparison in the form thereof.

The conductance between A and B in FIG. 22A1 was compared with that between A' and B' in FIG. 22B1. Computer simulation means were employed to track the movement of the gas particles in a virtual simulation, thus obtaining the conductance. The "3-Dimensional Dilute Gas Flow Analysis Program RAFAL-3D Ver.3.4" (by Kagaku Gijutsu Software, Inc.) was used for the simulation. The physical conditions for the simulation and the calculation method thereof will now be briefly described, and then the calculation results will be given. This description of the calculation method has been written with reference to the "3-Dimensional Dilute Gas Flow Analysis Program RAFAL-3D Ver.3.4. Instruction Manual (1), (2)".

The only gas molecule taken into consideration for the simulation according to the present embodiment is water vapor, i.e., $H_2O$. The temperature was set at 300K. $H_2O$ molecules were caused to flow in from the cross-section planes A and A', and flow out from the cross-section planes B and B'. The cross-section planes here are cross-sections made in a direction vertical to the drawing.

The rate and direction at which $H_2O$ molecules are caused to flow in from the cross-section planes A and A' was set so as to be randomly emitted in all directions at uniform probability. The size of the molecules were determined according to a probability according to Maxwell-Boltzmann distribution. Accordingly, the velocity vector average of the $H_2O$ molecules flowing in is zero, and the mean-square value being described by the following expression:

$$<v^2>=(8RT/\pi mN_A)$$

wherein the gas constant is expressed by R=8.31 [J/mol/K], absolute temperature T [K], mass of gas molecules m [kg], and the Avogadro number $N_A=6.022\times10^{23}$ [/mol].

Collision of the $H_2O$ molecules one with another is ignored, taking into account only the collision of the $H_2O$ molecules with the solid walls. This assumes that the hypothetical system is within a range referred to as the molecule flow range.

When the mean free path of the gas molecules is expressed by $\lambda$ [m] and the characteristic length of the envelope through which the molecules are to flow is expressed by L [m], the expression $K_n=\lambda/L$ represents what is called a Knudsen number. Generally, the range in which $K_n>>0.3$ holds is called the molecule flow range, and it is known that approximation ignoring the collision of molecules one with another is effective therein.

The typical pressure for driving the image display apparatus was set at $10^{-8}$ Torr. For example, regarding water vapor at $1.3\times10^{31\ 8}$ Torr, the mean free path is expressed by $\lambda=3.29\times10^5$ m. The typical length of the envelope with which we are dealing has spacing of 200 $\mu$m between the face plate and the rear plate, meaning that the Knudsen number is:

$$K_n=\lambda/L=(3.29\times10^5)/(2.0\times10^{-4})=1.65\times10^9>>0.3$$

Accordingly, a state of molecule flow range may be assumed without any problem.

Here, it is assumed that in the event that the $H_2O$ molecules collide with the wall, the information which the $H_2O$ molecules posses before the collision such as momentum and energy and the like is totally lost, and the $H_2O$ molecules are re-emitted from the location of collision randomly emitted in all directions at uniform probability at a speed according to Maxwell-Boltzmann distribution.

In the molecule flow range, the conductance C [$m^3$/s] of the envelope, i.e., the tube, is not dependent on the pressure difference between the entrance of the tube and the exit thereof, but is constant. Accordingly, when conducting a computer simulation, the value of conductance C is the same, whatever value the pressure of $H_2O$ molecules flowing in from the cross-section planes A and A' is set to be.

With the present embodiment, the pressure at the cross-section planes A and A' was set so as to be $7.5\times10^{-8}$ Torr ($p=1.0\times10^{-5}$ [Pa]), the pressure at the cross-section planes B and B' at zero (0 Torr), and calculation was thus conducted.

Computer simulation was employed to track the movement of the $H_2O$ molecules in a virtual simulation under the aforementioned conditions, thus obtaining the conductance thereof. Emission of the $H_2O$ molecules was initiated at the time t=0 [s]. The number of $H_2O$ molecules in an actual system is vast, and the capabilities of a computer do not allow for tracking of all of these molecules. Accordingly, in the present embodiment, the number of $H_2O$ molecules corresponding to $\gamma=1.0\times10^{-5}$ times that of the number of $H_2O$ molecules in an actual system were emitted in the virtual simulation.

Further, in the present embodiment, $\Delta t=5.0\times10^{-7}$ [s] comprises one step, and the position of the $H_2O$ molecules caused to flow in were checked at each step. Although the number of $H_2O$ molecules within the envelope, i.e., the tube or the area defined between A and B, and A' and B', increase with the passing of time, the number of molecules eventually reaches a constant value, and attains a constant state with no more change in the number than some fluctuation around the constant.

Once judgment is made that the system is in a sufficiently constant state, a certain number of steps $n_s$ are allowed to transpire in the constant state, during which calculation is continued. Next, the average of physical quantity (such as pressure distribution) of each time step in the constant state is obtained. This is equivalent to obtaining the time average of the physical quantity in a constant state. When conducting this averaging, the greater the number of time steps $n_s$ which are added, the smaller the fluctuation from the true value of physical quantity.

For the chevron-type getter scattering prevention member 2013 shown in FIG. 22A1, the envelope was judged to be in a constant state after 2,000 steps, following which calculation was conducted for $n_s$=6,000 [steps], during which the average was calculated. The number of molecules which were emitted from the cross-section plane A during the $n_s$=6,000 steps (equivalent to $3.0\times10^{-4}$ [s]) was 107,589 molecules, and of these, the number which exited from the cross-section plane B was $N_B$=4,027 molecules. The conductance C [$m^3$/s] is calculated according to the following expression:

$$C=(N_B/\gamma)(RT/N_A)/(p\Delta tn_s)$$

The conductance of the chevron-type getter scattering prevention member 2013 shown in FIG. 22A1 was calculated to be $C=5.56\times10^{-5}$ [$m^3$/s].

For the getter scattering prevention member 1608 comprised of a simple shield plate as shown in FIG. 22B1, judgment was made that the container was in a constant state after 4,000 steps, following which calculation was conducted for $n_s$=4,000 [steps], during which the average was calculated. The number of molecules which were emitted from the cross-section plane A during the $n_s$=4,000 steps (equivalent to $2.0\times10^{-4}$ [s]) was 71,740 molecules, and of these, the number which exited from the cross-section plane B' was $N_{B'}$=2,561 molecules. The conductance of this getter scattering prevention member 1608, comprised of a simple shield plate as shown in FIG. 22B1, was calculated to be $C=5.27\times10^{-5}$ [$m^3$/s].

With the getter scattering prevention member 1608 comprised of a simple shield plate as shown in FIG. 22B1, there is a gap of 10 mm on both sides of the getter scattering prevention member 1608 when viewed from the front of the image display portion, and through this gap the gas molecules travel. With the spacing of the gap on both sides of the getter scattering prevention member 1608 represented by δ, $$C=2.91\times10^{-5}\ [m^3/s] \text{ when } \delta=5\ [mm],$$

$$C=4.21\times10^{-5}\ [m^3/s] \text{ when } \delta=7.5\ [mm],$$

and $$C=6.56\times10^{-5}\ [m^3/s] \text{ when } \delta=12.5\ [mm].$$

As can be understood from the above-described conductance calculation results, in order to achieve conductance in the getter scattering prevention member 1608 comprised of a simple shield plate as shown in FIG. 22B1 at a level of that of the chevron-type getter scattering prevention member 2013 shown in FIG. 22A1, the spacing of the gap on both sides of the getter scattering prevention member 1608 needs to be set at approximately δ=10 [mm].

With the chevron-type getter scattering prevention member 2013 shown in FIG. 22A1, getter can be situated throughout the entire getter flashing area. On the other hand, with the getter scattering prevention member 1608 comprised of a simple shield plate as shown in FIG. 22B1, the getter can only be situated at the getter flashing portion behind the getter scattering prevention member 1608 comprised of a shield plate, in order to prevent getter material particles from scattering to the image display portion.

In FIG. 22B1, the shield plate comprising the getter scattering prevention member 1608 is only 30 mm in length, and consequently, at the simplest case where the getter can be situated when viewed from the image display portion is only 30 mm in width. This is markedly disadvantageous as compared to the chevron-type getter scattering prevention member 2013 shown in FIG. 22A1. The less the amount of getter which can be provided, the shorter the time that a vacuum can be maintained, and consequently, the life expectancy of the image display apparatus becomes just that much shorter. The evacuation properties thereof are not as good either, meaning that a sufficient degree of vacuum cannot be provided to the image display portion.

If the spacing of the gap on both sides of the getter scattering prevention member 1608 comprised of a simple shield plate as shown in FIG. 22B1 is narrowed, the conductance becomes smaller than that of the chevron-type getter scattering prevention member 2013 shown in FIG. 22A1.

As can be understood from the above description, the chevron-type getter scattering prevention member according to the present invention is advantageous toward lengthening the working life expectancy of the image display apparatus, achieving a high degree of vacuum of the image display portion, and shortening of the time necessary for evacuation, as compared to the known getter scattering prevention member comprised of a simple shield plate.

Second Embodiment

Figure 1A:
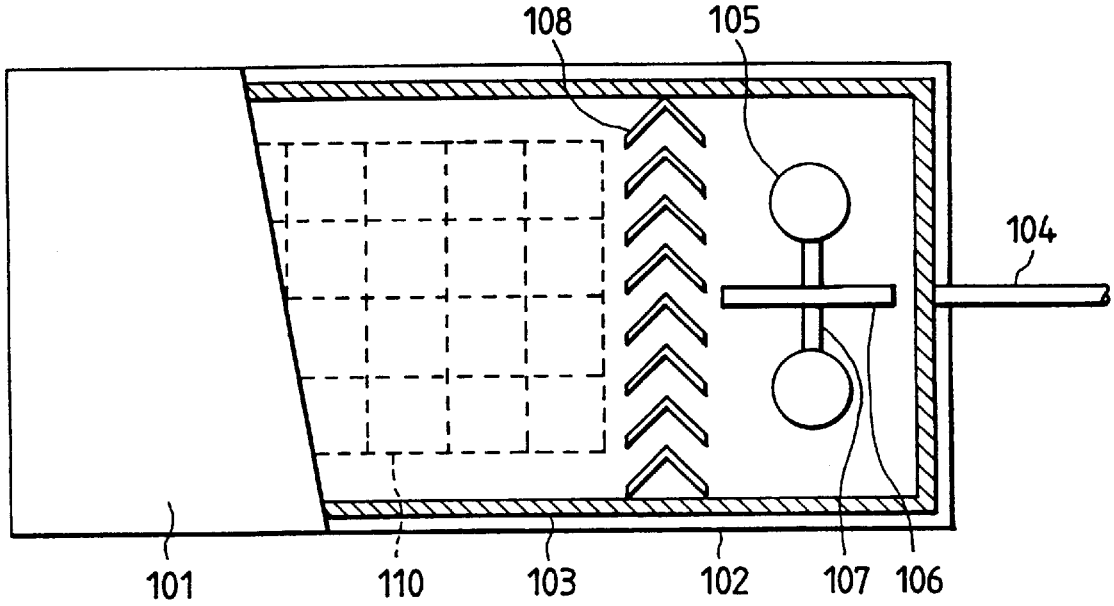
FIGS. 1A and 1B are drawings illustrating a second embodiment of the image display apparatus according to the present invention, FIG. 1A being a plan view, and FIG. 1B a cross-section view.
Figure 1B:
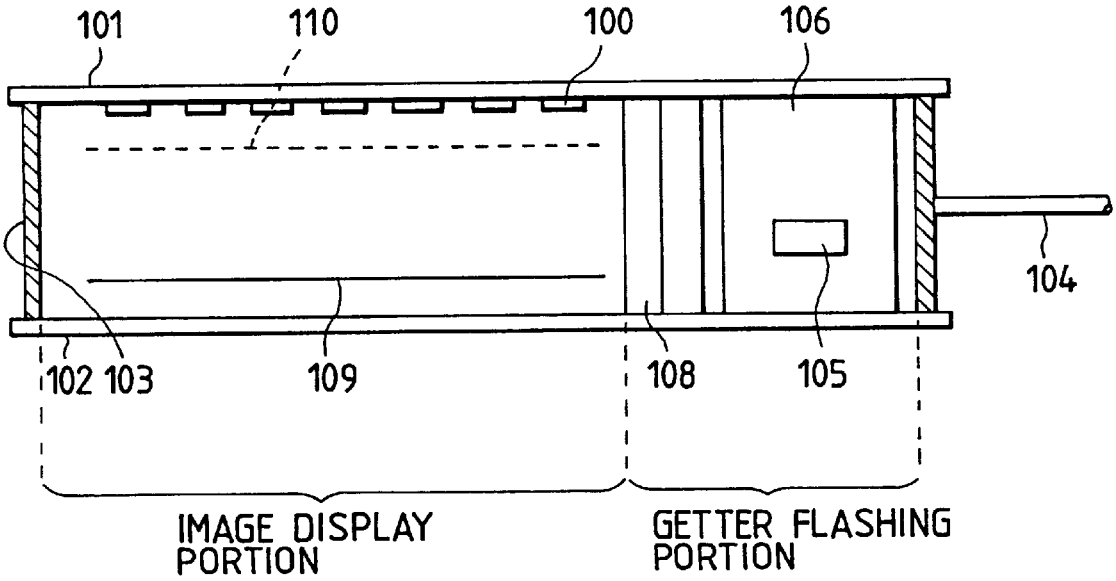

FIG. 1A and FIG. 1B are drawings illustrating a second embodiment of the image display apparatus (vacuum fluorescent display tube) according to the present invention, FIG. 1A being a plan view, and FIG. 1B a cross-section view.

As shown in FIG. 1B, the present embodiment is comprised of a face plate 101 formed of an insulating material such as glass and serving as an image display portion, a rear plate 102 formed of an insulating material such as glass and situated so as to oppose the face plate 101, outer frame 103 for supporting the structure against the external pressure. The areas where the face plate 101 and outer frame 103 are connected, as well as the areas where the rear plate 102 and outer frame 103 are connected, are bonded by means of glass with a low melting point, or the like so as to form an envelope. Further, an evacuation tube 104 is provided to the outer frame 103 for conducting evacuation of the interior of the apparatus (envelope). Moreover, image patterns 100 are formed on the face plate 101.

Further, within the envelope, affixed to the face plate 101 and rear plate 102 in a generally vertical direction by means of glass with a low melting point or the like, is a getter scattering prevention member 108 comprised of multiple flat plates in a V shape and forming a getter scattering prevention wall, and also fixed is a getter holding jig 106. Fixed to the getter holding jig 106 are getter holding rods 107, and fixed to the ends of the getter holding rods 107 is getter 105.

At the getter scattering prevention member 108, a getter scattering prevention wall is formed of at least two V-shaped plates which are arrayed linearly so that there can be no gap observed from the image display portion, with the outermost portion of the getter scattering prevention wall coming into contact with the outer frame, and also so that the plates not to come into contact with one another. The apexes of the Vs all face in the same direction, and the plates are arrayed so that the apexes are situated at the point which is the center of a line connecting the two ends of the neighboring V.

Further, on the other side of the getter scattering prevention wall 108 from the side provided with getter 105, a plurality of display units are arrayed so as to comprise the image display portion, with each display unit comprising an image pattern on the face plate 101 formed of an anode and fluorescent material, a control grid 110 for controlling the display content of the image, and a filament 109.

The effects of situating the V-shaped members of the getter scattering prevention member 108 so that there is no linear optical path between the getter flashing portion where the getter is situated and the image display portion will now be described in principle.

Flashing causes the ejected getter material particles of spread throughout the getter flashing portion. However, the getter material particles do not act like general gas molecules; the getter material particles have a nature to adhere to a solid wall with which they collide. In order for the getter material particles to pass through the getter scattering prevention member according to the present invention and pass over to the image display portion, the getter material particles must first collide with the V-shaped plates comprising the getter scattering prevention member 108 or the inner walls. Once the getter material particles collide with the V-shaped plates comprising the getter scattering prevention member 108 or the inner walls, they adhere to the place where the collision occurred. Therefore, according to the getter scattering prevention member 108 according to the present invention, the getter material particles do not pass through the getter scattering prevention member 108 according to the present invention, nor pass over to the image display portion. On the other hand, the general gas particles are capable of passing through the V-shaped plates comprising the getter scattering prevention member 108, repeatedly colliding with the plates in doing so.

Next, the method of constructing the above-described image display apparatus will now be described. Glass which melts at a low temperature is coated at the points of connection with the face plate 101, rear plate 102, outer frame 103, getter scattering prevention member 108, and the getter holding jig 106 the getter scattering prevention member 108, getter holding jig 106, and outer frame 103 are positioned by means of a positioning jig, following which the glass which melts at a low temperature is heated and softened, and subsequently hardened, thus fixing and bonding the respective members.

After all of the members have been bonded, the gas within the envelope is evacuated from the evacuation tube 104 by means of a turbo molecular pump or the like, and the evacuation tube 104 is sealed at the point the interior of the envelope reaches a sufficient degree of vacuum. After sealing off the evacuation tube 104, the getter 105 is flashed by means of electrical induction heating or the like, thus completing the image display apparatus.

After completion of the image display apparatus, heating the filament 109 causes electrons generated by means of the heating. And the electrons are accelerated by means of an anode (not shown), and strike the image pattern. Consequently, an image is displayed on the face plate 101.

As well as first embodiment, the image display apparatus as described above could be evacuated in a short time, and exhibited little screen brightness modifiedity.

Third Embodiment

Figure 2A:
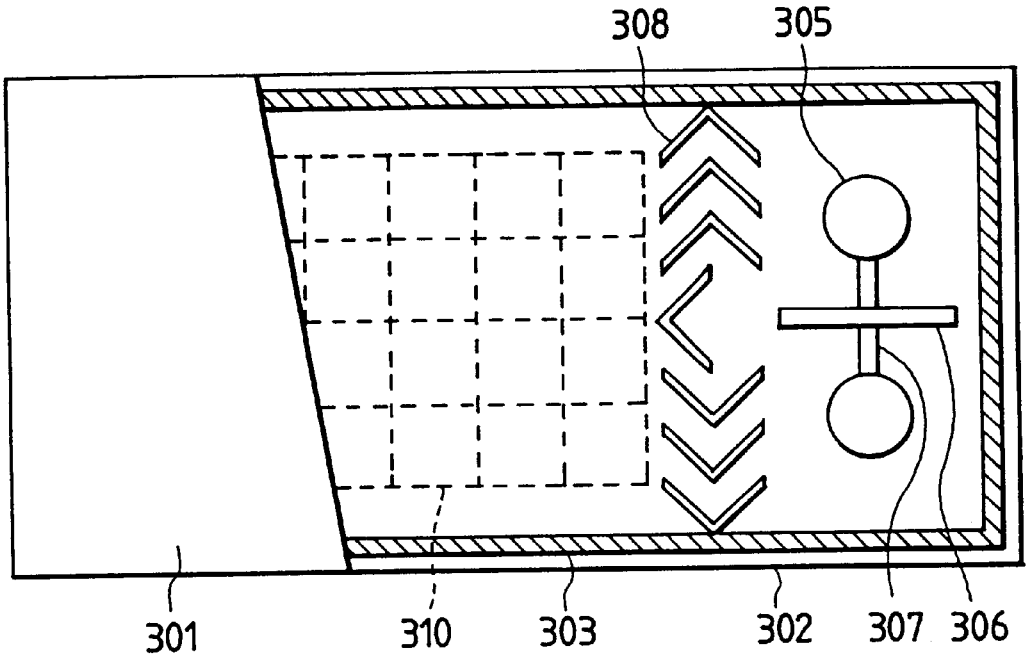
FIGS. 2A and 2B are drawings illustrating a third embodiment of the image display apparatus according to the present invention, FIG. 2A being a plan view, and FIG. 2B a cross-section view.
Figure 2B:
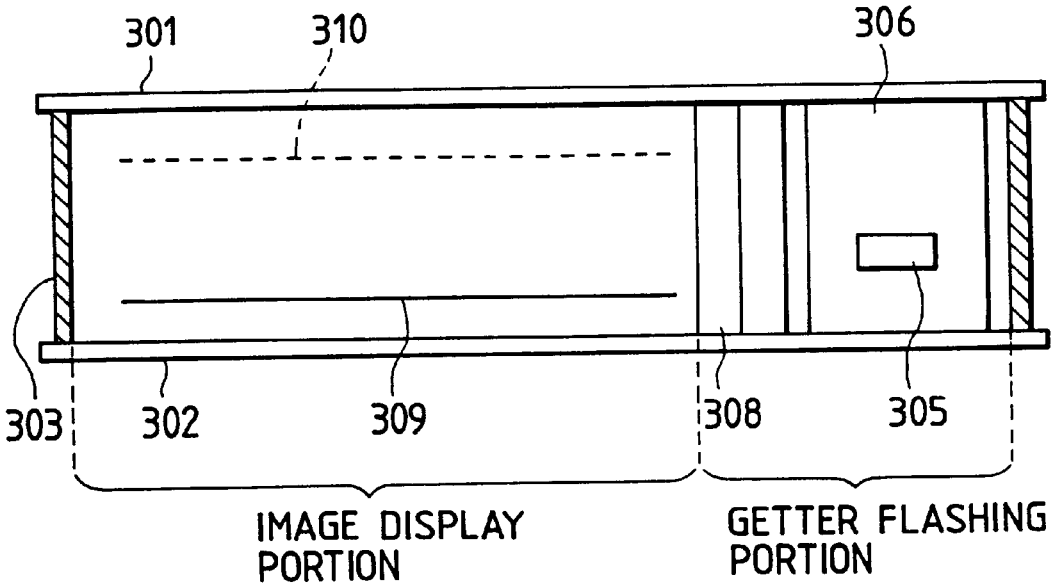

FIG. 2A and FIG. 2B are drawings illustrating a third embodiment of the image display apparatus according to the present invention, FIG. 2A being a plan view, and FIG. 2B a cross-section view.

As shown in FIG. 2A and FIG. 2B, the present embodiment is comprised of a face plate 301 formed of an insulating material such as glass and serving as an image display portion, a rear plate 302 formed of an insulating material such as glass and situated so as to oppose the face plate 301, and an outer frame 303 for supporting the structure against the external pressure and for determining the distance between the face plate 301 and the rear plate 302. The areas where the face plate 301 and the outer frame 303 are connected, as well as the areas where the rear plate 302 and the outer frame 303 are connected, are bonded by means of glass with a low melting point, or the like. Also, two evacuation tubes (not shown) are provided to the face plate 301.

Further, within the envelope, bonded to the face plate 301 and the rear plate 302 in a generally vertical direction by means of glass with a low melting point or the like, is a getter scattering prevention member 308 comprised of multiple flat plates bent in a V shape and forming a getter scattering prevention wall, and also bonded is a getter holding jig 306. Bonded to the getter holding jig 306 are getter holding rods 307, and bonded to the ends of the getter holding rods 307 is getter 305.

At the getter scattering prevention member 308, a getter scattering prevention wall is formed of at least three V-shaped plates which are arrayed linearly so that there can be no gap observed from the display portion, and so that the plates not to come into contact with one another. With the present embodiment, two sets of V-shaped plates are situated upon a single line in a symmetrical manner, the apexes of the Vs in each set all facing in the same direction within that set, and the plates arrayed so that the apexes are situated at the point which is the center of a line connecting the two ends of the neighboring V. At the symmetrical center thereof, there is situated a single V-shaped plate, with the apex facing the image display portion, with the base of each side farthest from the apex being situated at a point which is the center of a line connecting the two ends of the neighboring V. Hereafter, such a getter scattering prevention member shall be referred to as an modified chevron-type getter scattering prevention member.

Although the above description has been made with a symmetrical arrangement, the present invention is not limited to such an arrangement.

Further, on the face plate 301 situated on the other side of the getter scattering prevention member 308 from the side provided with getter 305, a plurality of display units serving as the image display portion are arrayed, with each display unit comprising an image pattern (not shown), a control grid 310 for controlling the content of the image, and a filament 309.

Next, the method of constructing the above-described image display apparatus will now be described. Glass which melts at a low temperature are coated at the points of connection with the face plate 301, rear plate 302, outer frame 303, getter scattering prevention member 308, and the getter holding jig 306.

The getter scattering prevention member 308, getter holding jig 306, and outer frame 303 are positioned by means of a positioning jig, following which the glass which at a low temperature is heated and softened, and subsequently hardened, thus bonding the respective members.

After all of the members have been bonded, the gas within the envelope is evacuated from the evacuation tubes (not shown) by means of a turbo molecular pump or the like, and the evacuation tubes are sealed at the point the interior of the envelope reaches a sufficient degree of vacuum. After sealing off the evacuation tubes, the getter 305 is flashed by means of electrical induction heating or the like, thus completing the image display apparatus.

After completion of the image display apparatus, the filament 309 is heated to emit electrons, and to be accelerated by means of the anode, and strike the image pattern. Consequently, an image is displayed on the face plate 301.

The following is a description of an modified chevron-type getter scattering prevention member with reference to the drawings.

Figure 3A:
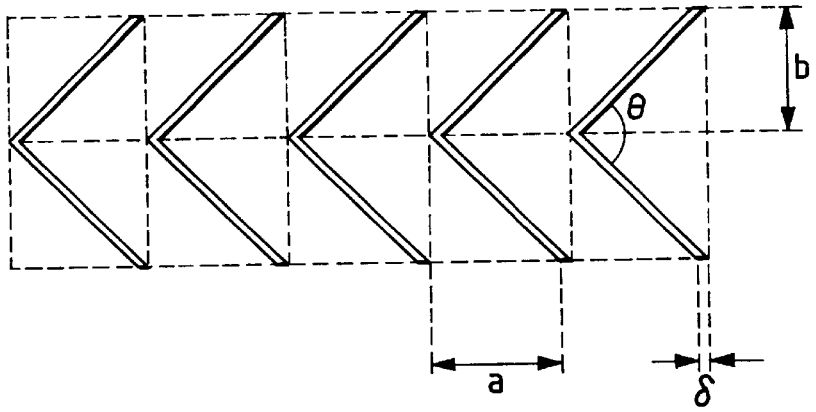
FIGS. 3A, 3B and 3C are drawings illustrating a portion of the getter scattering prevention member 308 shown in FIGS. 2A and 2B.
Figure 3B:
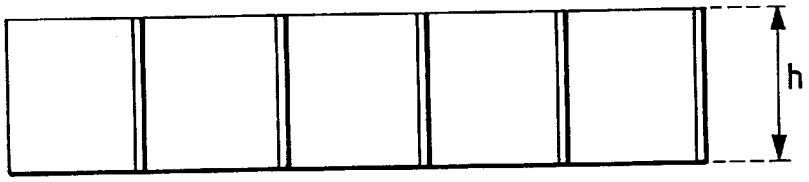
Figure 3C:
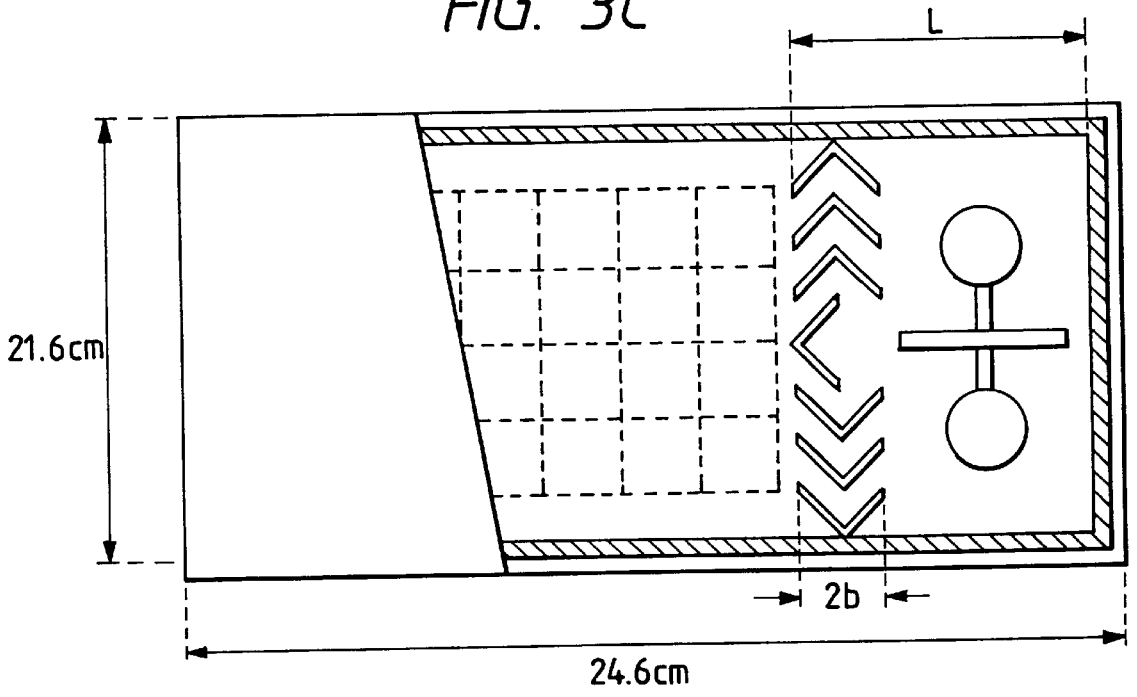

FIGS. 3A, 3B and 3C are drawings illustrating a portion of the getter scattering prevention member 308 illustrated in FIGS. 2A and 2B, with FIG. 3A being a top view, FIG. 2B a side view, and 3C a drawing showing the getter scattering prevention member 308 set within the envelope.

The form of the modified chevron-type getter scattering prevention member is as shown in FIGS. 3A and 3B; the form thereof is determined by "a", which denotes the height of the V-shape, "b", which denotes the half width of the V-shape, "h", which denotes the height of the getter scattering prevention wall, and "δ", which denotes the thickness of the getter scattering prevention wall.

As shown in FIG. 3C, in the event that the distance L from the getter scattering prevention member to the side plane of the image display apparatus on the side to which getter is provided is determined beforehand, the width 2*b* of the modified chevron-type getter scattering prevention member must be narrowed in order to increase the surface area to such getter adheres. It is also important at this time to adjust the height "a" of the V-shape according to "b", which is half of the width of the V-shape, so as to keep the angle θ of the apex shown in FIG. 3A from becoming extremely small. When the angle θ becomes small, the gas which flows from the image display portion toward the getter scattering prevention member tends to be deflected thereby and return to the direction whence it came. Further, even in the case that the gas which flows from the image display portion toward the getter scattering prevention member flows through to the getter flashing side, the distance of the actual flow path becomes longer as compared to an arrangement where the angle θ is large. Accordingly, if the angle θ is small, the gas does not flow easily from the image display portion to the getter flashing portion, and conductance is thus decreased.

Figure 4A:
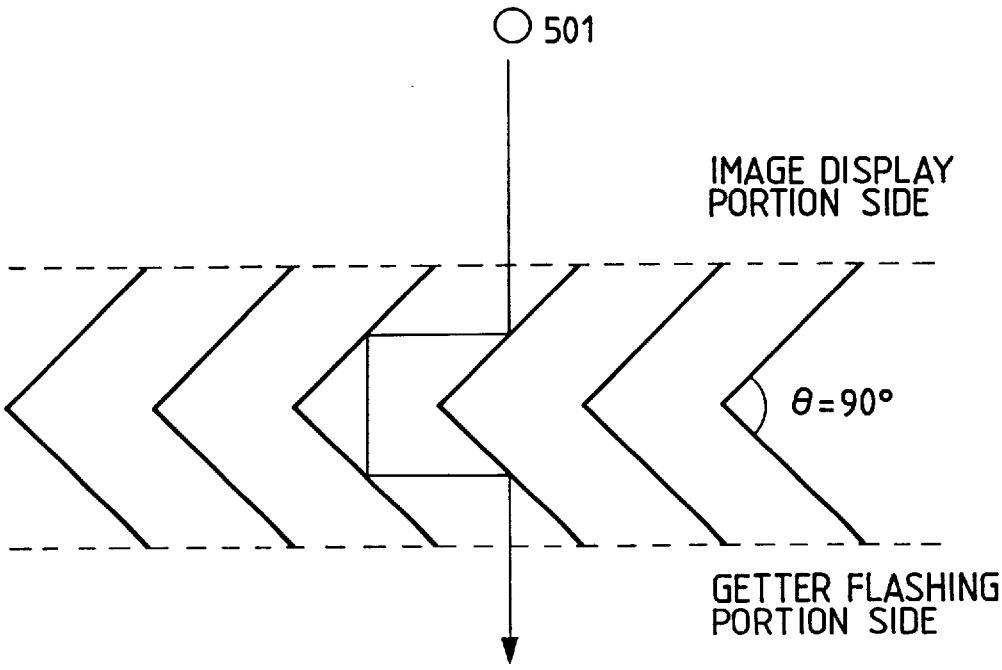
FIGS. 4A and 4B are diagrams illustrating the relation between the angle θ and the ease of passage of gas molecules, with FIG. 4A being a diagram illustrating the case where a:b=1:1 and the angle θ is 90°, and FIG. 4B a diagram illustrating the case where a:b=2:1 and the angle θ is 53.1°.
Figure 4B:
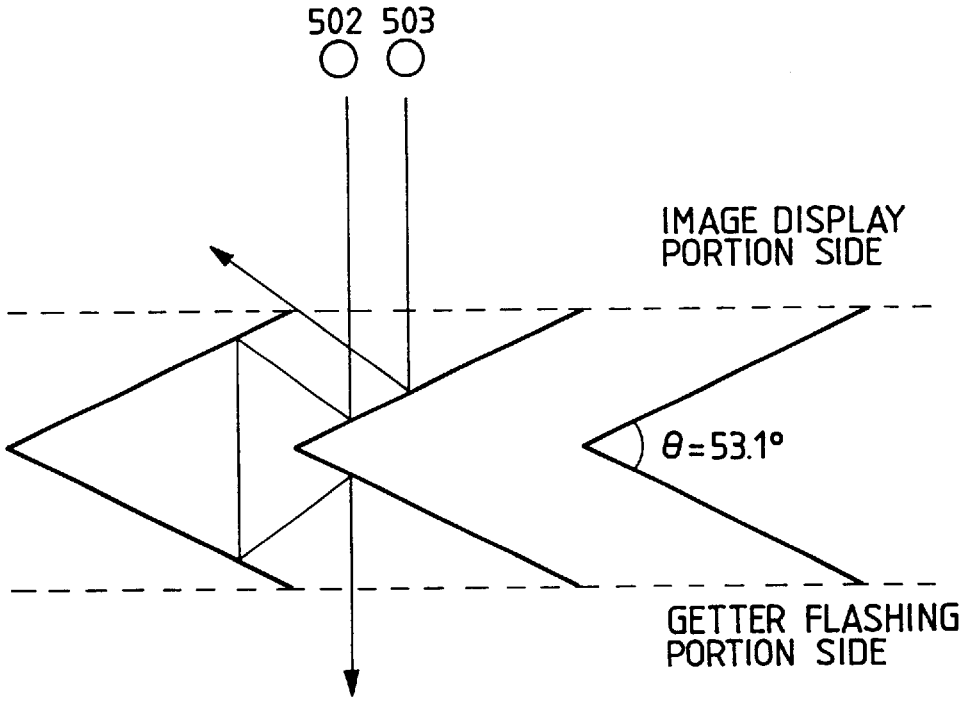

FIG. 4A and FIG. 4B are diagrams illustrating the relation between the angle θ of the apex and the ease of passage of gas molecules, as shown in FIG. 3A, with FIG. 4A being a diagram illustrating the case where a:b=1:1 and the angle θ is 90°, and FIG. 4B a diagram illustrating the case where a:b=2:1 and the angle θ is 53.1°.

As shown in FIG. 4A and FIG. 4B, the distance that the gas molecules 502 shown in FIG. 4B which flowed from the image display portion actually traveled to pass through the chevron-type getter scattering prevention member is longer than that of the gas molecules 501 shown in FIG. 4A. Also, the gas molecules 503 have bounced back toward the image display portion. Here, it is assumed that the gas molecules 501, 502, and 503 flow parallel to the face plate and rear plate, and also vertically to the line connecting the apexes of the V-shaped glass plates comprising the modified chevron-type getter scattering prevention member. Further, it is assumed that the gas molecules experience no adherence or stay upon collision with the V-shaped glass plates comprising the modified chevron-type getter scattering prevention member, rather are deflected in mirror fashion.

An image display apparatus comprised of an envelope 208 $cm^3$ in volume and possessing inner surface area of 1,223 $cm^2$ was prepared. Computer simulation was conducted under the following conditions, employing an modified chevron-type getter scattering prevention member, and the pressure distribution within the envelope was calculated.

The overall form of the image display apparatus shown in FIG. 3C is as follows: the vertical side of the rectangle observed when the image display apparatus is viewed from the front is 21.6 cm, the horizontal side 24.6 cm, and the thickness, 0.38 cm. Two cylindrical evacuation tubes, 0.83 cm in diameter and 5.29 cm in length are attached thereto, with the ends of the evacuation tubes being sealed. Further, a total of 28 atmospheric pressure supporting structures (not shown) called spacers, 4 cm in length and 0.38 cm in hight are provided to the image display portion.

Description of the calculation method regarding this simulation will be omitted here, as it has already been described in the first embodiment of the present specification.

The conditions are as follows: the temperature of the entire envelope was set at 300K, and it was assumed that $H_2O$ (water vapor) was continuously being emitted from a surface area of 1,159 $cm^2$ at a rate of $1.0\times10^{-10}$ Torr·liter/$cm^2$/sec., with getter material being adhered to the remaining 64 $cm^2$ of surface area. The adsorption rate of the getter was assumed to be 0.01. An adsorption rate of 0.01 means that if 100 $H_2O$ molecules strike the wall to which getter material has adhered, 1 $H_2O$ molecule will adsorb to the getter.

Generally, glass material which has been cleansed and then heated in a vacuum is capable of restricting gas emission speed at a level equivalent to that of stainless steel. Accordingly, the gas emission speed of $1.0\times10^{-10}$ Torr-liter/$cm^2$/sec. assumed in this computer simulation is considered to be an appropriate value. (Yoshitaka Hayashi, "SHINKU GIJUTSU NYUMON", NIKKAN KOGYO SHINBUN-SHA (1987))

The size of the modified chevron-type getter scattering prevention member was set as follow according to FIGS. 3A, 3B and 3C: a=0.5 cm, b=0.5 cm, h=0.38 cm, θ=90°, and δ=0 cm.

Collision of the $H_2O$ molecules one with another was ignored, taking into account only the collision of the $H_2O$ molecules with the solid walls.

Computer simulation means were employed to track the movement of the $H_2O$ molecules in a virtual simulation under these conditions, thus calculating the pressure distribution within the envelope. According to the calculations results, the partial pressure of $H_2O$ was within the range of $1.5\times10^{-8}$ to $3.4\times10^{-8}$ Torr. This is a pressure value sufficient for usage as a vacuum fluorescent display tube. Accordingly, the effects of employing the modified chevron-type getter scattering prevention member are extremely great.

Further, when the size of the modified chevron-type getter scattering prevention member was set to be: a=1 cm, b=0.5 cm, h=0.38 cm, θ=53.1°, and δ=0 cm, similar computer simulation showed the partial pressure of $H_2O$ to be within the range of $1.6\times10^{-8}$ to $3.7\times10^{-8}$ Torr. These results indicate a greater modifiedity in the partial pressure of $H_2O$ as compared to the case where θ=90°.

Next, an image display apparatus the same as the image display apparatus in the above-described simulation was built, and the time require for evacuation and the degree of modifiedity in brightness of the image was checked. Here, glass plates 200 μm in thickness were used here for the modified chevron-type getter scattering prevention member.

The results showed that the image display apparatus employing the modified chevron-type getter scattering prevention member according to the present invention exhibited the same advantages as the first embodiment, i.e., evacuation could be conducted in a shorter time as compared to the known single-plate getter scattering prevention member, and the modifiedities in brightness were decreased. Also, the case where an modified chevron-type getter scattering prevention member wherein θ=90° allowed for evacuation to be conducted in a shorter time as compared to the arrangement where θ=53.1°, and the modifiedities in brightness were less, as well. Accordingly, the getter scattering prevention member according to the present embodiment was set at θ=90°.

Further, no passing over of getter material to the image display portion was observed in the image display apparatus according to the present embodiment, and there was absolutely no short-circuiting of wiring.

Fourth Embodiment

Figure 5A:
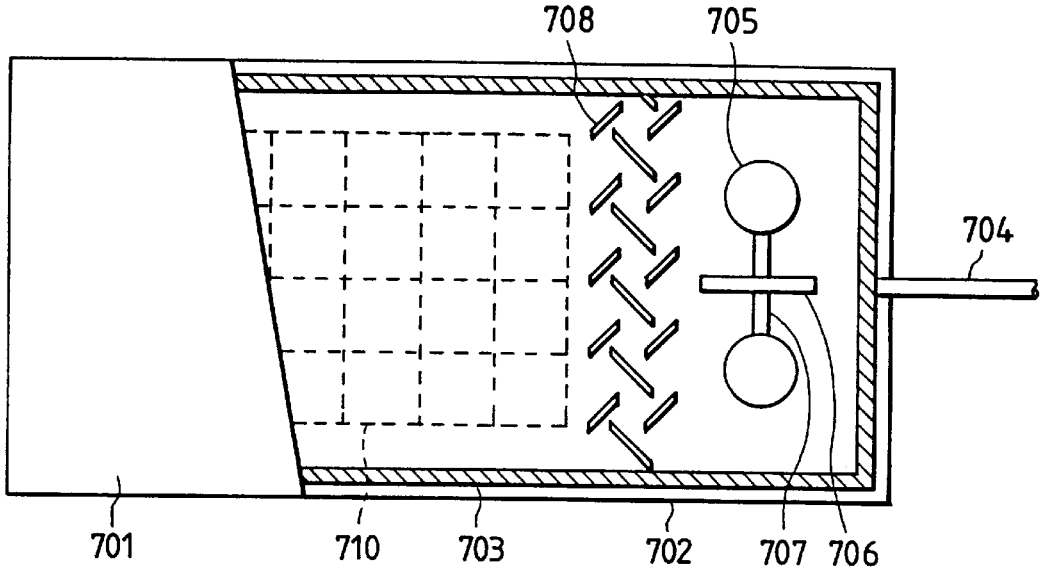
FIGS. 5A and 5B are drawings illustrating a fourth embodiment of the image display apparatus according to the present invention, FIG. 5A being a plan view, and FIG. 5B a cross-section view.
Figure 5B:
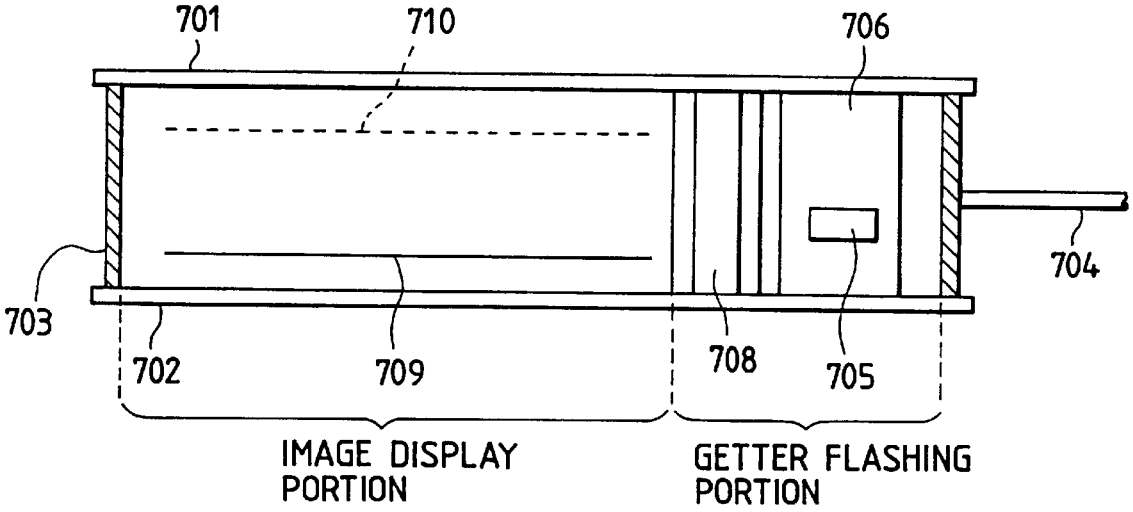

FIGS. 5A and 5B are drawings illustrating a fourth embodiment of the image display apparatus according to the present invention, FIG. 5A being a plan view, and FIG. 5B a cross-section view.

As shown in FIGS. 5A and 5B, the present embodiment is comprised of a face plate 701 formed of an insulating material such as glass and serving as an image display portion, a rear plate 702 formed of an insulating material such as glass and situated so as to oppose the face plate 701, and an outer frame 703 for supporting the structure against the external pressure and provided with an evacuation tube 704 for evacuation of the gas within the envelope. The areas where the face plate 701 and outer frame 703 are connected, as well as the areas where the rear plate 702 and outer frame 703 are connected, are bonded by means of glass with a low melting point, or the like.

Further, within the envelope, bonded to the face plate 701 and rear plate 702 in a generally vertical direction by means of glass with a low melting point or the like, is a getter scattering prevention member 708 comprised of multiple flat plates forming a getter scattering prevention wall, and also bonded is a getter holding jig 706. Bonded to the getter holding jig 706 are getter holding rods 707, and bonded to the ends of the getter holding rods 707 is getter 705.

At the getter scattering prevention member 708, at least two flat-plate getter scattering prevention walls are arrayed linearly so that the plates not to come into contact with one another, and so that there is no linear optical path between the getter flashing portion where the getter 705 is situated and the image display portion.

Further, on the face plate 701 situated on the other side of the getter scattering prevention member 708 from the side provided with getter 705, a plurality of display units serving as the image display portion are arrayed, with each display unit comprising an image pattern (not shown), a control grid 710 for controlling the content of the image, and a filament 709.

The getter scattering prevention member 708 employed in the present embodiment is quite different in form as compared to the modified chevron-type getter scattering prevention member shown in FIG. 2A and the chevron-type getter scattering prevention member shown in FIG. 1A. Accordingly, a description of the getter scattering prevention member 708 according to the present embodiment will now be made with reference to the drawings.

Figure 6A:
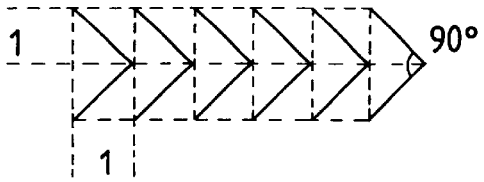
FIGS. 6A, 6B, 6C, 6D and 6E are explanatory drawings illustrating the getter scattering prevention member in the fourth embodiment of the image display apparatus according to the present invention, with FIG. 6A being a figure illustrating the chevron-type getter scattering prevention member shown in FIG. 1A, and FIGS. 6B, 6C, 6D and 6E drawings illustrating the process by which the getter scattering prevention member according to the present invention is fabricated from the chevron-type getter scattering prevention member shown in the fourth embodiment according to the present invention as shown in FIG. 6A.

FIGS. 6A, 6B, 6C, 6D and 6E are explanatory drawings illustrating the getter scattering prevention member in the fourth embodiment of the image display apparatus according to the present invention, with FIG. 6A being a figure illustrating the chevron-type getter scattering prevention member shown in FIG. 1A, and FIGS. 6B, 6C, 6D and 6E drawings illustrating the process by which the getter scattering prevention member according to the present invention is fabricated from the chevron-type getter scattering prevention member shown in the fourth embodiment according to the present invention as shown in FIG. 6A. Also, the size of each of the getter scattering prevention walls of the chevron-type getter scattering prevention member follow the notation method of FIG. 3A, with a=1, b=1, and θ=90°. (The unit of length for "a" and "b" is not specified in particular.)

Figure 6B:
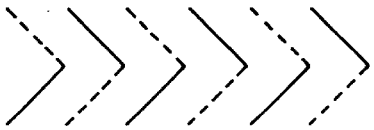

The following is a description of the getter scattering prevention member according to the present embodiment. First, one of the two sides of the getter scattering prevention walls forming a V and thus comprising the chevron-type getter scattering prevention member shown in FIG. 6A is removed. As shown in FIG. 6B, neighboring plate have opposite sides removed.

Figure 6C:
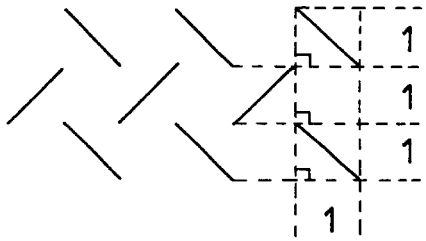

Next, in order to prevent the passing of getter material particles, a plurality of flat plates are attached parallel to the getter scattering prevention member. The plates attached here are of the same size as the removed side shown in FIG. 6B, and the direction thereof is parallel to the getter scattering prevention walls on the opposite side from the side to which the plates are to be attached, as shown in FIG. 6C.

Figure 6D:
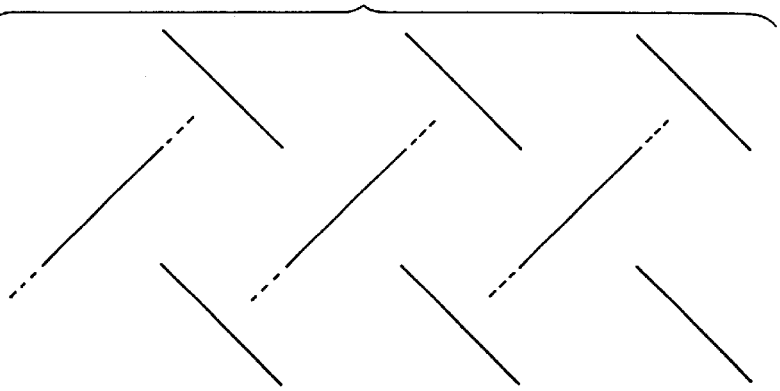
Figure 6E:
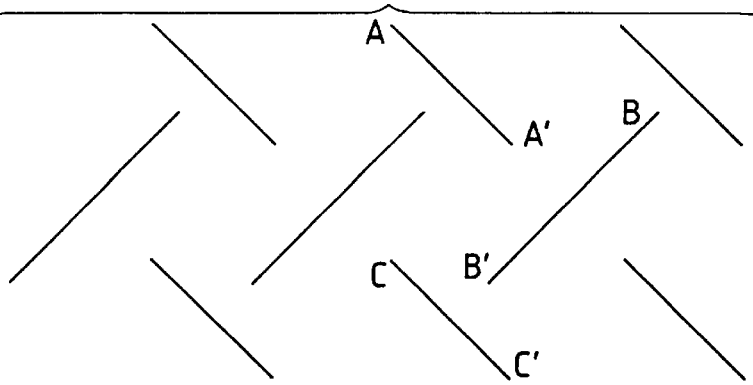

Subsequently, plates are added to the portions indicated by dotted lines in FIG. 6D, so as to sufficiently shield getter particles, as shown in FIG. 6E.

The following is a description of the positional relation of each of the getter scattering prevention walls of the getter scattering prevention member constructed according to the above-described process.

Figure 7:
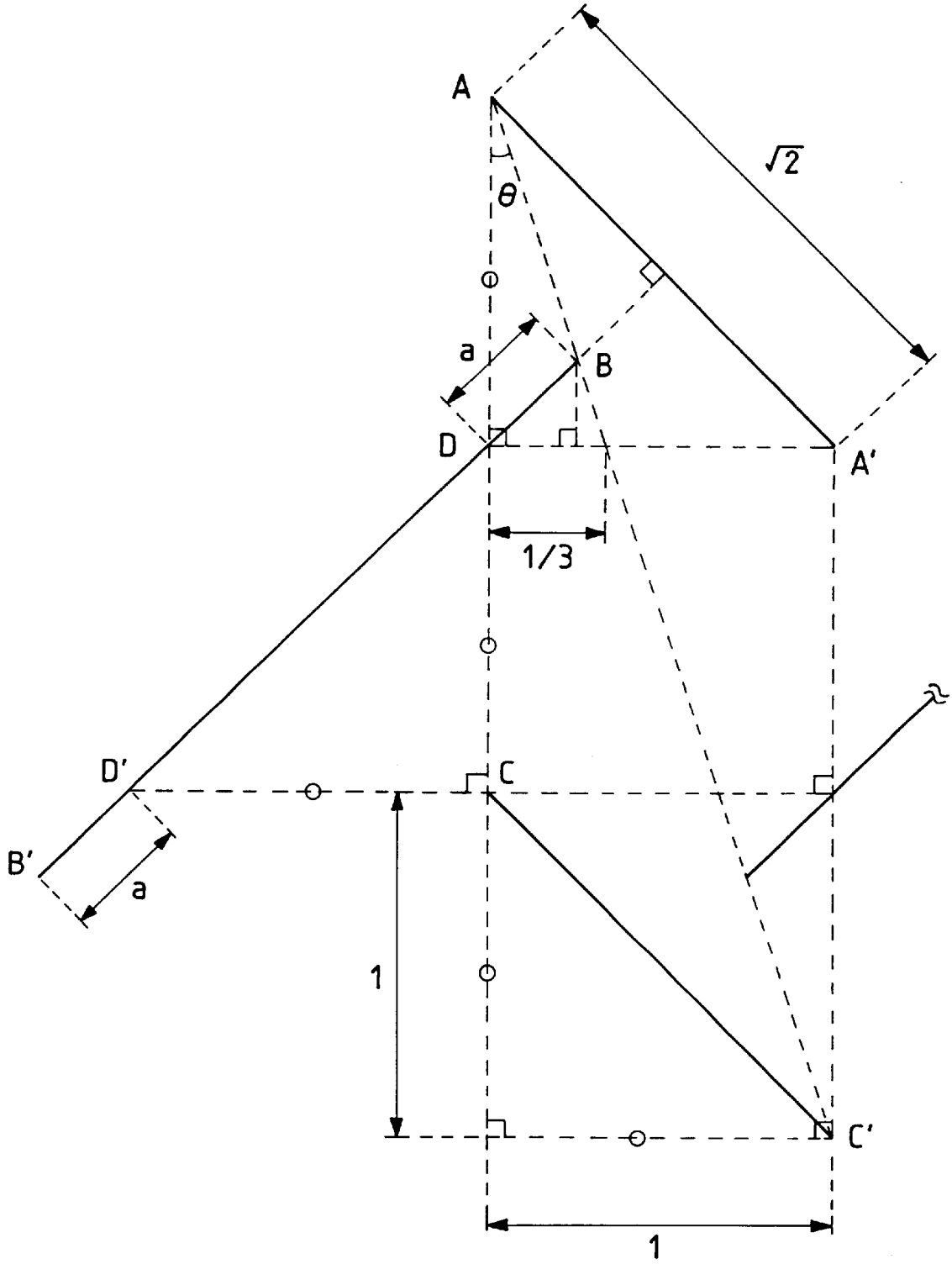
FIG. 7 is a drawing illustrating the positional relation of the getter scattering prevention walls shown in FIGS. 5A and 5B.

FIG. 7 is a drawing illustrating the positional relation of the getter scattering prevention walls shown in FIGS. 5A and 5B. Three plates AA', BB', and CC' form one element, and the getter scattering prevention member according to the present invention is comprised of a plurality of these elements being arrayed in one row.

AA' and CC' are in a parallel relationship, with a line extrapolated from BB' intersecting AA' at a right angle. Also, the length of AA' and CC' differs from that of BB'. AA' and DD' were part of the chevron-type getter scattering prevention member, and since CC' is also the same length as these, the following expression holds:

$$AA'=DD'=CC'=\sqrt{2}$$

The plate portions attached in the process shown in FIG. 6E correspond with BD and D'B'.

Point B represents the intersection of the extrapolations of dotted line AC' and line segment DD'. By means of extending line segment DD' to point B and point B', passing around of getter material particles can be completely prevented. With the length of BD and D'B' as "a", geometrical reasoning yields the following relation:

$$(a/\sqrt{2})\tan\theta+(a/\sqrt{2})=1/3$$

$$\tan\theta=1/3$$

thus, the following:

$$a=1/(2\sqrt{2})$$

Accordingly, the length of the plates can be determined from:

$$AA=DD'=CC'=\sqrt{2},$$

$$BD=D'B'=1/(2\sqrt{2})$$

As described above, if there is provided beforehand such a getter scattering prevention member formed of V-shaped plates arrayed linearly so that there can be no gap observed from the image display portion, but also so that the plates not to come into contact with one another, with the apexes of the Vs all facing in the same direction, and the plates being arrayed so that the apexes are situated at the point which is the center of a line connecting the two ends of the neighboring V, based on that structure, it is possible to form a new getter scattering prevention member structure therefrom wherein two or more plate-shaped getter scattering prevention walls are situated so as not to come in contact with one another, and also positioned so that a line connecting any point in the image display portion and any point in the getter flashing portion always intersects a getter scattering prevention wall.

The following method is effective in checking that there is no linear optical path between the image display portion and the side where the getter is situated with the getter scattering prevention member constructed according to the above-described method.

First, an enlarged scale mode of the getter scattering prevention member constructed according to the above-described method is created. Next, the getter flashing portion of this mode is viewed from the image display side thereof. If the plates comprising the getter scattering prevention member obstruct vision toward the getter flashing portion when viewed from various angles from the image display portion, it may be said that there is no linear optical path from the image display portion to the side where the getter is situated.

An image display apparatus was assembled as shown in FIGS. 5A and 5B, and it was found that this image display apparatus could be evacuated in a short time, a high degree of vacuum could be attained within the image display apparatus, and exhibited little screen brightness modifiedity. Further, no passing over of getter material to the image display portion was observed therein, and there was no short-circuiting of wiring.

Fifth Embodiment

The fifth embodiment of the image display apparatus according to the present invention which will now be described involves employing half-circle arc-shaped plates for the getter scattering prevention member.

Figure 8A:
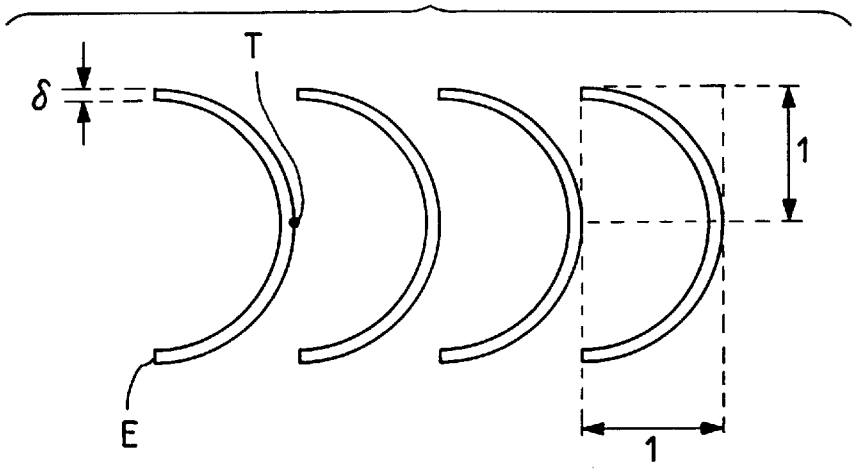
FIGS. 8A, 8B and 8C are explanatory drawings illustrating the getter scattering prevention member in the fifth embodiment of the image display apparatus according to the present invention, with FIG. 8A being a top view, FIG. 8B a figure illustrating the chevron-type getter scattering prevention member shown in FIG. 6A, and FIG. 8C a drawing illustrating an arc-shaped getter scattering prevention wall based on the chevron-type getter scattering prevention member shown in FIG. 8B.
Figure 8B:
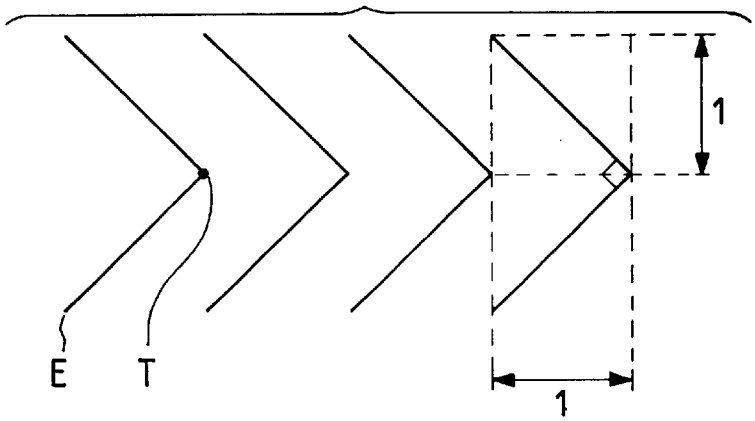
Figure 8C:
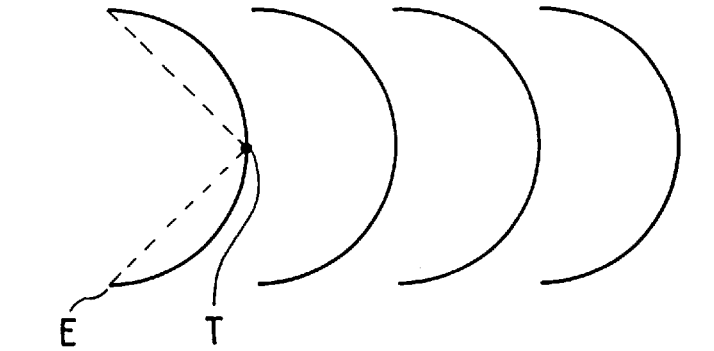

FIGS. 8A, 8B and 8C are explanatory drawings illustrating the getter scattering prevention member in the fifth embodiment of the image display apparatus according to the present invention, with FIG. 8A being a top view, FIG. 8B a figure illustrating the chevron-type getter scattering prevention member shown in FIG. 6A, and FIG. 8C a drawing illustrating an arc-shaped getter scattering prevention wall based on the chevron-type getter scattering prevention member shown in FIG. 8B. Description of other structure (image display apparatus) of the present embodiment will be omitted here, as the same as those of the second embodiment. Also, in FIGS. 8A, 8B and 8C, reference character T denotes the apex, and reference character E denotes the edge. Also, the size of each of the getter scattering prevention walls of the chevron-type getter scattering prevention member shown in FIG. 8B follow the notation method of FIG. 3A, with a=1, b=1 and θ=90°. (The unit of length for "a" and "b" is not specified in particular.)

As shown in FIG. 8A, the getter scattering prevention member of the present embodiment consists of at least two arc-shaped plates arrayed so that the plates not to come into contact with one another, facing the same direction, and also positioned so that a line connecting any point in the image display portion and any point in the getter flashing point always intersects a getter scattering prevention wall.

By replacing the line segment in FIG. 8B with a 80° arc of a circle with a radius of 1, a getter scattering prevention member comprised of a plurality of getter scattering prevention walls of half-circle arc-shaped plates as shown in FIG. 8C can be obtained.

As described above, if there is provided beforehand such a getter scattering prevention member formed of V-shaped plates arrayed linearly so that there can be no gap observed from the display portion, but also so that the plates not to come into contact with one another, with the apexes of the Vs all facing in the same direction, and the plates being arrayed so that the apexes are situated at the point which is the center of a line connecting the two ends of the neighboring V, based on that structure, it is possible to form a new getter scattering prevention member structure therefrom wherein two or more arc-shaped getter scattering prevention walls are situated so as not to come in contact with one another, with the apexes thereof facing in the same direction, and also positioned so that there is no linear optical path from the image display portion to the side where the getter is situated.

An image display apparatus according to the present embodiment employing the getter scattering prevention walls as shown in FIG. 8A was assembled, and it was found that, as with the second embodiment, this image display apparatus could be evacuated in a short time, a high degree of vacuum could be attained within the image display apparatus, and exhibited little screen brightness modifiedity. Further, no passing over of getter material to the image display portion was observed therein, and there was no short-circuiting of wiring.

Sixth Embodiment

Figure 9A:
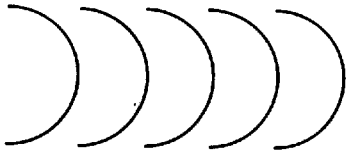
FIGS. 9A, 9B, 9C and 9D are explanatory drawings illustrating the getter scattering prevention member in the sixth embodiment of the image display apparatus according to the present invention, with FIG. 9A being a figure illustrating the getter scattering prevention member shown in FIG. 8A, and FIGS. 9B, 9C and 9D drawings illustrating the process by which the getter scattering prevention member according to the present invention is fabricated from the getter scattering prevention member shown in the sixth embodiment according to the present invention as shown in FIG. 9A.

FIGS. 9A, 9B, 9C and 9D are explanatory drawings illustrating the getter scattering prevention member in the sixth embodiment of the image display apparatus according to the present invention, with FIG. 9A being a figure illustrating the getter scattering prevention member shown in FIG. 8A, and FIGS. 9B, 9C and 9D drawings illustrating the process by which the getter scattering prevention member according to the present invention is fabricated from the getter scattering prevention member shown in the sixth embodiment according to the present invention as shown in FIG. 9A.

The present embodiment consists of a new getter scattering prevention member structure, based on a getter scattering prevention member wherein two or more arc-shaped getter scattering prevention walls are situated so as not to come in contact with one another, and also positioned so that there is no linear optical path from the image display portion to the side where the getter is situated.

Figure 9B:
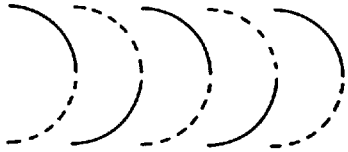

The following is a description of process for forming the getter scattering prevention member according to the present invention. First, one half of the arc of each of the getter scattering prevention walls comprising the getter scattering prevention member is removed. As shown in FIG. 9B, neighboring plates have opposite sides of the arcs removed.

Figure 9C:
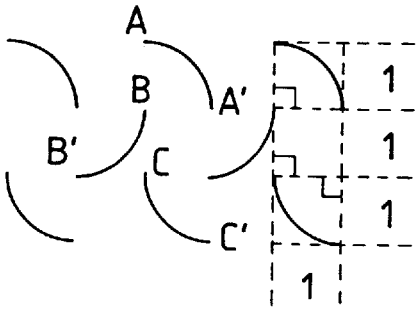

Next, in order to prevent the passing of getter material particles, a plurality of plates, i.e., the same number of plates as the removed arc portions, are attached to the getter scattering prevention member. The plates attached here are of the same shape as the removed arc portion, and the direction thereof is in the same direction as the getter scattering prevention walls on the opposite side from the side to which the plates are to be attached, as shown in FIG. 9C.

Figure 9D:
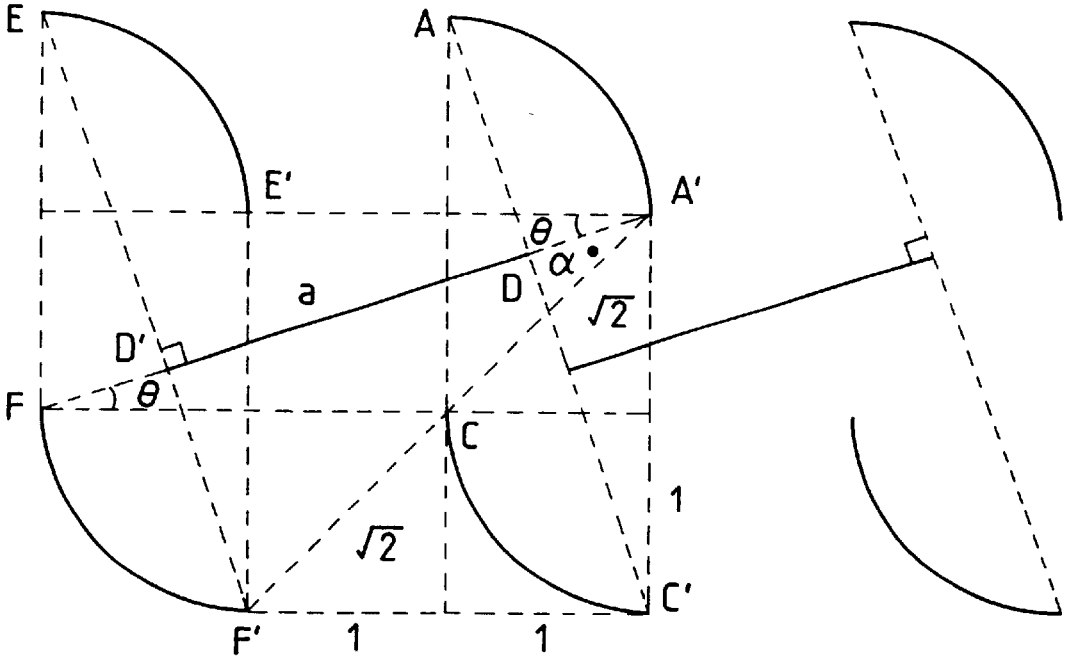

Subsequently, of the plates shown remaining in FIG. 9B, the plates on the side to which the new plates are added are deformed, so as to sufficiently shield getter particles, as shown in FIG. 9D.

The following is a detailed description of the deformation of the plates as shown in FIG. 9D. The plate DD' in the above-described process which was subjected to deformation is a line segment connecting the intersection point of line AC' and line A°F, with the intersection point of line EF' and line A°F. Here, the line AC' and the line DD' intersect at right angles.

Passing over of the getter material particles can be prevented by means of employing a plate which consists of a line segment connecting any point on line segment AC' and any point of line segment EF'.

Preferably the line segment DD' is the shortest of such plates.

With the length of the line segment DD' is represented by "a", and under the conditions ∠DFC=θ, ∠FA'C=α, α=(π/4)−θ and tan θ=⅓ give $$\tan \alpha = \tfrac{1}{2}.$$

Accordingly, cos α=2/√5 holds.

Further, a=(2√2)cos α−(1/√)2 cos α gives $$a = (3\sqrt{2})/\sqrt{5}$$

Thus, the shape and position of the plate DD' shown in FIG. 9D is determined.

Figure 10C:
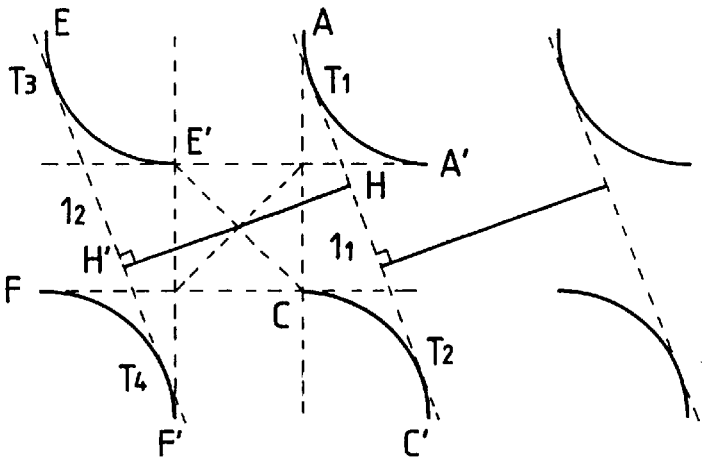
FIGS. 10A, 10B and 10C are explanatory drawings illustrating examples of alteration in the positioning or form of the plates shown in FIG. 9D.
Figure 10A:
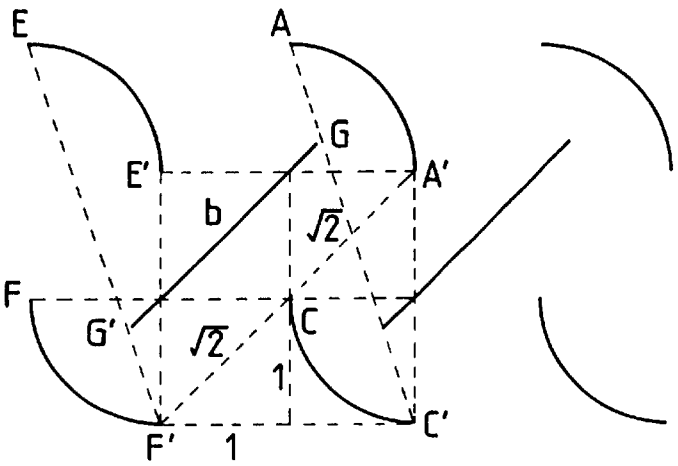
Figure 10B:
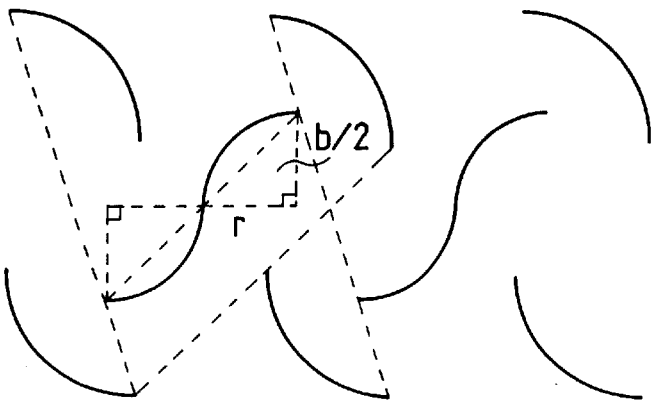

FIGS. 10A, 10B and 10C are explanatory drawings illustrating examples of alteration in the positioning or form of the plates shown in FIG. 9D. As shown in FIG. 10A, plate GG' may be positioned so as to be parallel with line A'F'.

In the arrangement shown in FIG. 10A, point G is upon line segment AC', and point G' is upon line segment EF', so that passing around of getter material particles can be completely prevented. With the length of line segment GG' as "b", geometrical reasoning yields:

$$b=3/\sqrt{2}$$

Further, as shown in FIG. 10B, the line segment GG' shown in FIG. 10A may be replaced with two 90° arcs combined.

In the arrangement shown in FIG. 10B as well, passing around of getter material particles can be completely prevented. With the radius of the arc as "r", $$(b/2)^2=2r^2$$

therefore, $$r=3/4.$$

In the arrangement shown in FIG. 10C, the line touching both arc AA' and arc CC' is denoted by $l_1$, and the line touching both arc EE' and arc FF' is denoted by $l_2$. The point of contact of $l_1$ and arc AA' is denoted by $T_1$, the point of contact of $l_1$ and arc CC' is denoted by $T_2$, the point of contact of $l_2$ and arc EE' is denoted by $T_3$, and the point of contact of $l_2$ and arc FF' is denoted by $T_4$.

Passing over of the getter material particles can be prevented by means of employing a plate which consists of a line segment connecting any point on line segment $T_1T_2$ and any point on line segment $T_3T_4$. Line segment HH' shown in FIG. 10C is the shortest distance between lines $l_1$ and $l_2$, with line segment HH' intersecting $l_1$ and $l_2$ at right angles and further passing thorough the center point of line segment E'C.

As described above, if there is provided beforehand such a getter scattering prevention member formed of two or more arc-shaped getter scattering prevention walls which are situated so as not to come in contact with one another, facing the same direction, and also positioned so that there is no linear optical path from the image display portion to the side where the getter is situated, based on that structure, it is possible to form a new getter scattering prevention member structure therefrom.

An image display apparatus according to the second embodiment employing the getter scattering prevention walls as shown in FIG. 9D and FIGS. 10A, 10B and 10C was assembled, and it was found that, as with the second embodiment, this image display apparatus could be evacuated in a short time, a high degree of vacuum could be attained within the image display apparatus, and exhibited little screen brightness modifiedity. Further, no passing over of getter material to the image display portion was observed therein, and there was no short-circuiting of wiring.

Seventh Embodiment

Figure 11A:
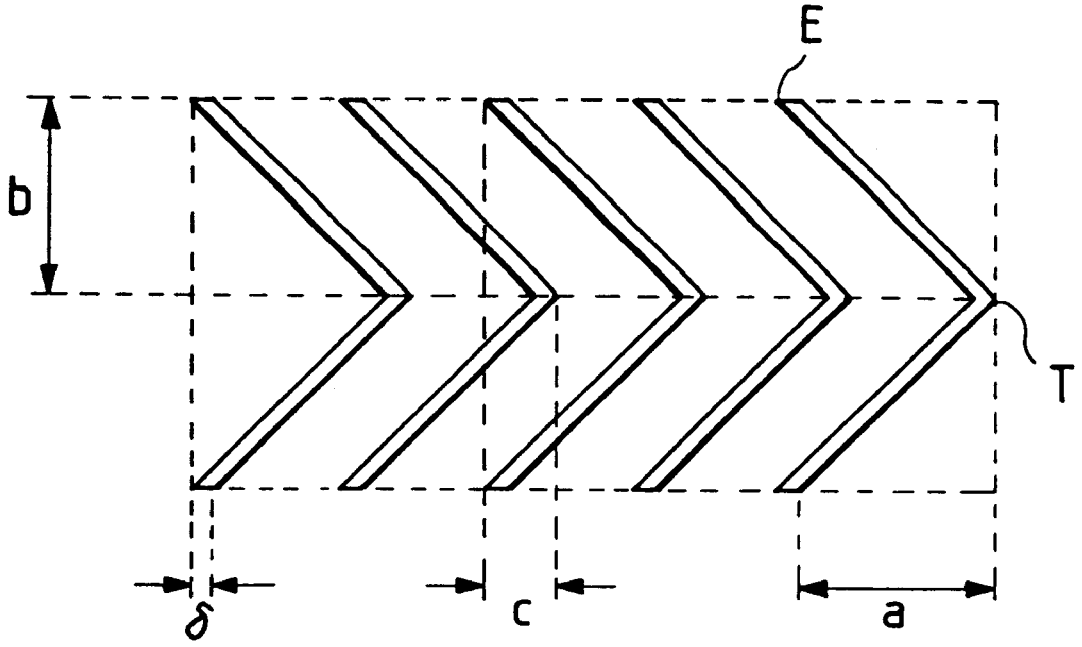
FIGS. 11A and 11B are drawings illustrating a portion of the seventh embodiment of the image display apparatus according to the present invention, FIG. 11A being a frontal view, and FIG. 11B a side view.
Figure 11B:
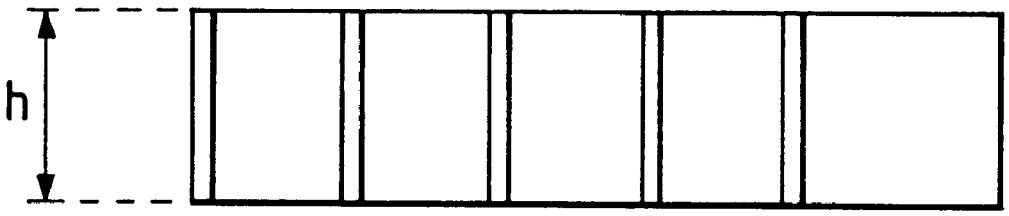

FIGS. 11A and 11B are drawings illustrating a portion of the seventh embodiment of the image display apparatus according to the present invention, FIG. 11A being a frontal view, and FIG. 11B a side view. In FIG. 11A, reference character T denotes the apex, and reference character E denotes the edge.

As shown in FIGS. 11A and 11B, the present embodiment is arranged so that the spacing between the getter scattering prevention walls is narrower than that of the second embodiment, and the apex of each V-shaped plate being closer to the apex of the neighboring plate than the line connecting the edges thereof.

The form of the above-described getter scattering prevention member is determined by "a", which denotes the height of the V-shape, "b", which denotes one half of the width of the V-shape, "c", which denotes the spacing between the apex of the V-shape and the line connecting the edges of the neighboring V-shape, "δ", which denotes the thickness of the getter scattering prevention wall, and "h", which denotes the height of the getter scattering prevention wall.

An image display apparatus according to the second embodiment employing the getter scattering prevention walls as shown in FIG. 11A and FIG. 11B was assembled, and it was found that, as with the second embodiment, this image display apparatus could be evacuated in a short time, a high degree of vacuum could be attained within the image display apparatus, and exhibited little screen brightness modifiedity. Further, no passing over of getter material to the image display portion was observed therein, and there was no short-circuiting of wiring. Further, the present embodiment required less time for evacuation.

Eighth Embodiment

Figure 12A:
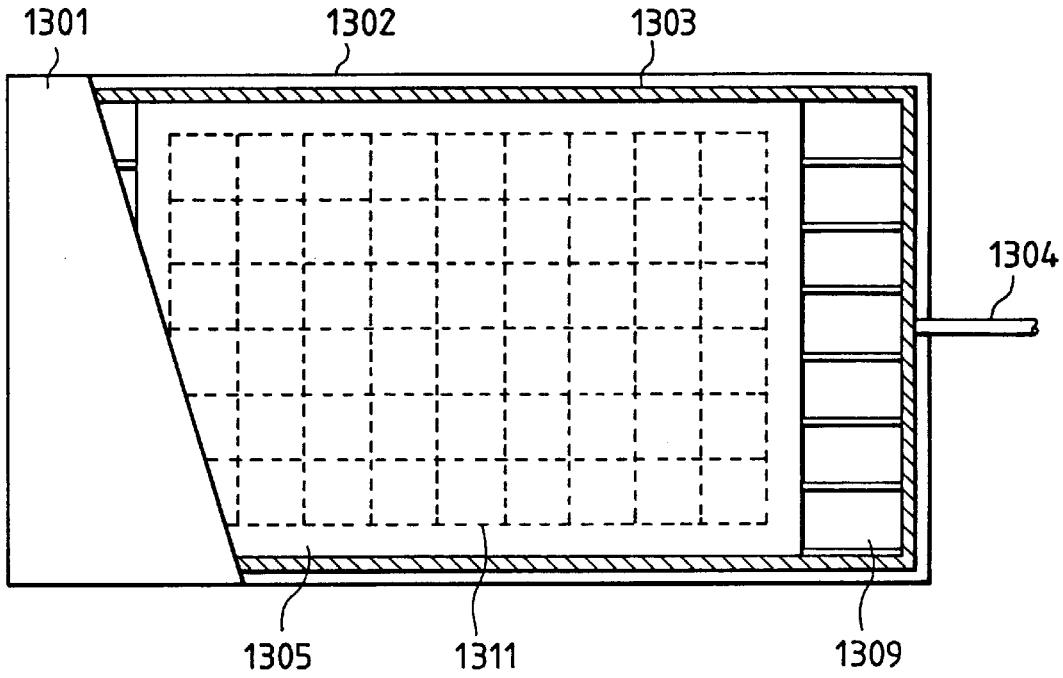
FIGS. 12A, 12B, 12C and 12D are drawings illustrating an eighth embodiment of the image display apparatus according to the present invention, FIG. 12A being a frontal view, FIG. 12B a cross-section view in the depth direction of the apparatus, FIG. 12C a rear view, and FIG. 12D a side cross-section view.
Figure 12B:
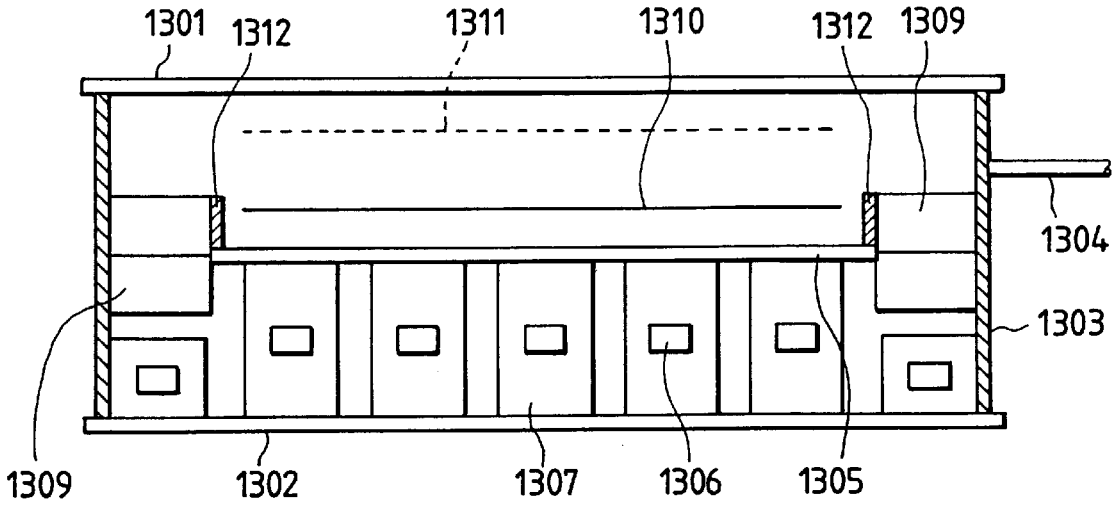
Figure 12C:
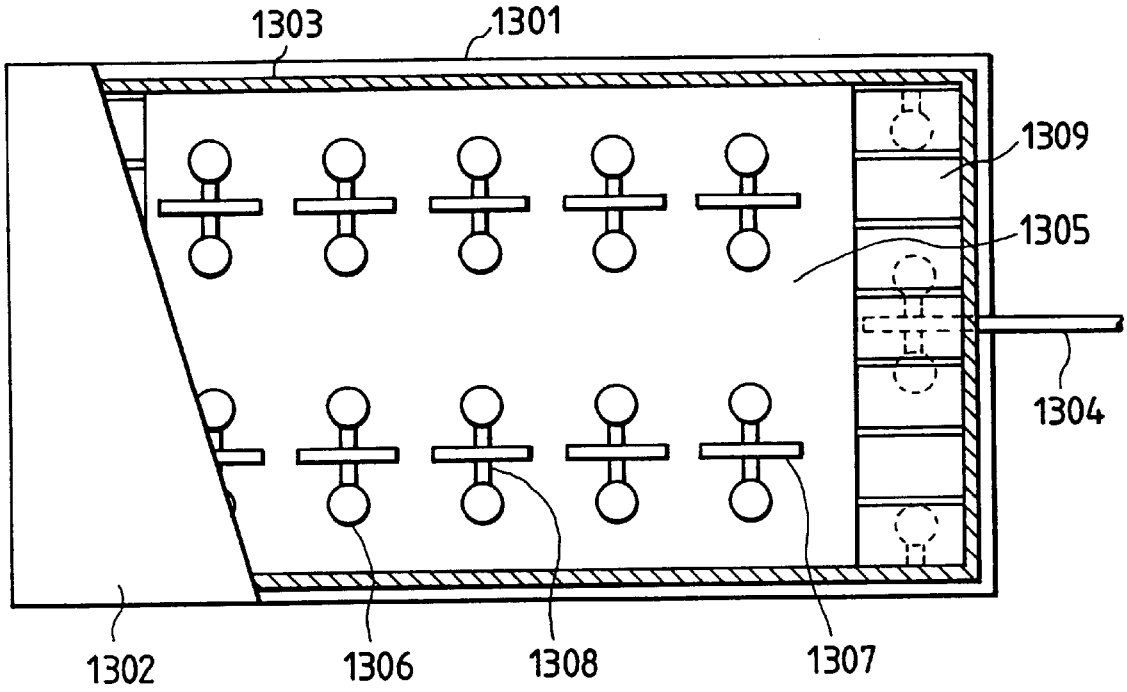
Figure 12D:
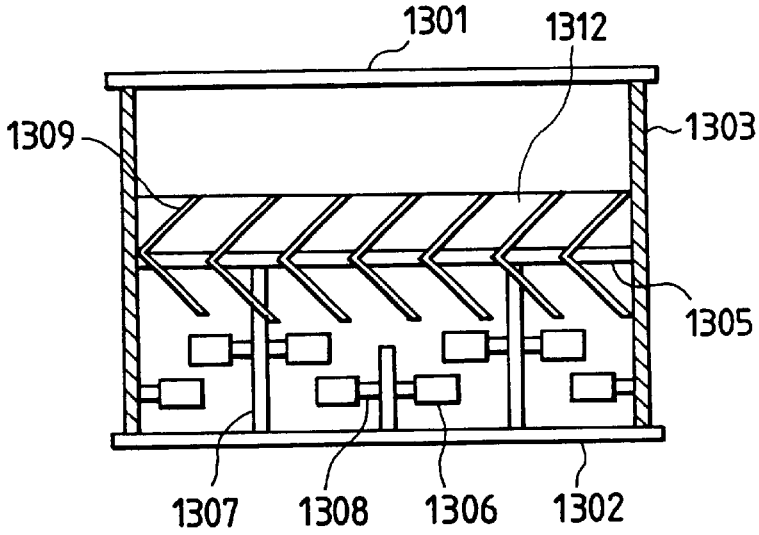

FIGS. 12A, 12B, 12C and 12D are drawings illustrating an eighth embodiment of the image display apparatus according to the present invention, FIG. 12A being a frontal view, FIG. 12B a cross-section view in the depth direction of the apparatus, FIG. 12C a rear view, and FIG. 12D a side cross-section view.

As shown in FIGS. 12A, 12B, 12C and 12D, the present embodiment is comprised of a face plate 1301 formed of an insulating material such as glass and serving as an image display portion, a rear plate 1302 formed of an insulating material such as glass and situated so as to oppose the face plate 1301, and an outer frame 1303 for supporting the structure against the external pressure and provided with an evacuation tube 1304 for evacuation of the gas within the envelope. The areas where the face plate 1301 and outer frame 1303 are connected, as well as the areas where the rear plate 1302 and outer frame 1303 are connected, are bonded by means of glass with a low melting point, or the like. Also, the line connecting the apexes of the V-shaped getter scattering prevention walls is parallel with a partition 1305.

Further, the envelope is separated into two chambers by means of a partition 1305, with a chevron-type getter scattering prevention member 1309 provided to either side of the partition 1305. Bonded to the partition 1305, rear plate 1302, and outer frame 1303 in a generally vertical direction by means of glass with a low melting point or the like, is a getter holding jig 1307. Bonded to the getter holding jig 1306 are getter holding rods 1308, and bonded to the ends of the getter holding rods 1307 is getter 1306. Further, in the drawings, the edge of the getter scattering prevention member which protrudes toward the face plate 1301 from the partition 1305 and is parallel with the outer frame 1303 comes into contact with a flat plate 1312, and this flat plate 1312 covers each getter scattering prevention wall to the ends thereof. Further, on the face plate 1301 situated on the other side of the partition 1306 from the side provided with getter 1306, a plurality of display units serving as the image display portion are arrayed, with each display unit comprising an image pattern (not shown), a control grid 1311 for controlling the content of the image, and a filament 1310.

Next, the method of constructing the above-described image display apparatus will now be described. Glass which melts at a low temperature is coated at the points of connection with the face plate 1301, rear plate 1302, outer frame 1303, partition 1305, getter scattering prevention member 1308, and the getter holding jig 1307. The getter scattering prevention member 1309, getter holding jig 1307, and outer frame 1303 are positioned by means of a positioning jig, following which the glass which melts at a low temperature is heated and softened, and subsequently hardened, thus bonding the respective members.

After all of the members have been bonded, the gas within the envelope is evacuated from the evacuation tube 1304 by means of a turbo molecular pump or the like, and the evacuation tube 1304 is sealed at the point the interior of the envelope reaches a sufficient degree of vacuum. Further, the evacuation tube 1304 may be formed on the side to which getter is situated. After sealing off the evacuation tube 1304, the getter 1306 is flashed by means of electrical induction heating or the like, thus completing the image display apparatus.

After completion of the image display apparatus, heating the filament 1310 causes emit electrons, to be accelerated by means of the anode (not shown), and strike the image pattern. Consequently, an image is displayed on the face plate 1301.

The image display apparatus shown in FIGS. 12A, 12B, 12C and 12D was assembled, and it was found that this image display apparatus could be evacuated in a short time, a high degree of vacuum could be attained within the image display apparatus, there was no passing over of getter material to the image display portion observed therein, and exhibited little screen brightness modifiedity. Further, with a double-chamber structure such as according to the present embodiment, getter adhering area approximating that of the image display portion is available, and thus such an arrangement is advantageous for maintaining vacuum.

Ninth Embodiment

A ninth embodiment will be used for description of using surface-conductive electron-emitting devices as a fluorescence excitation means.

Figure 13:
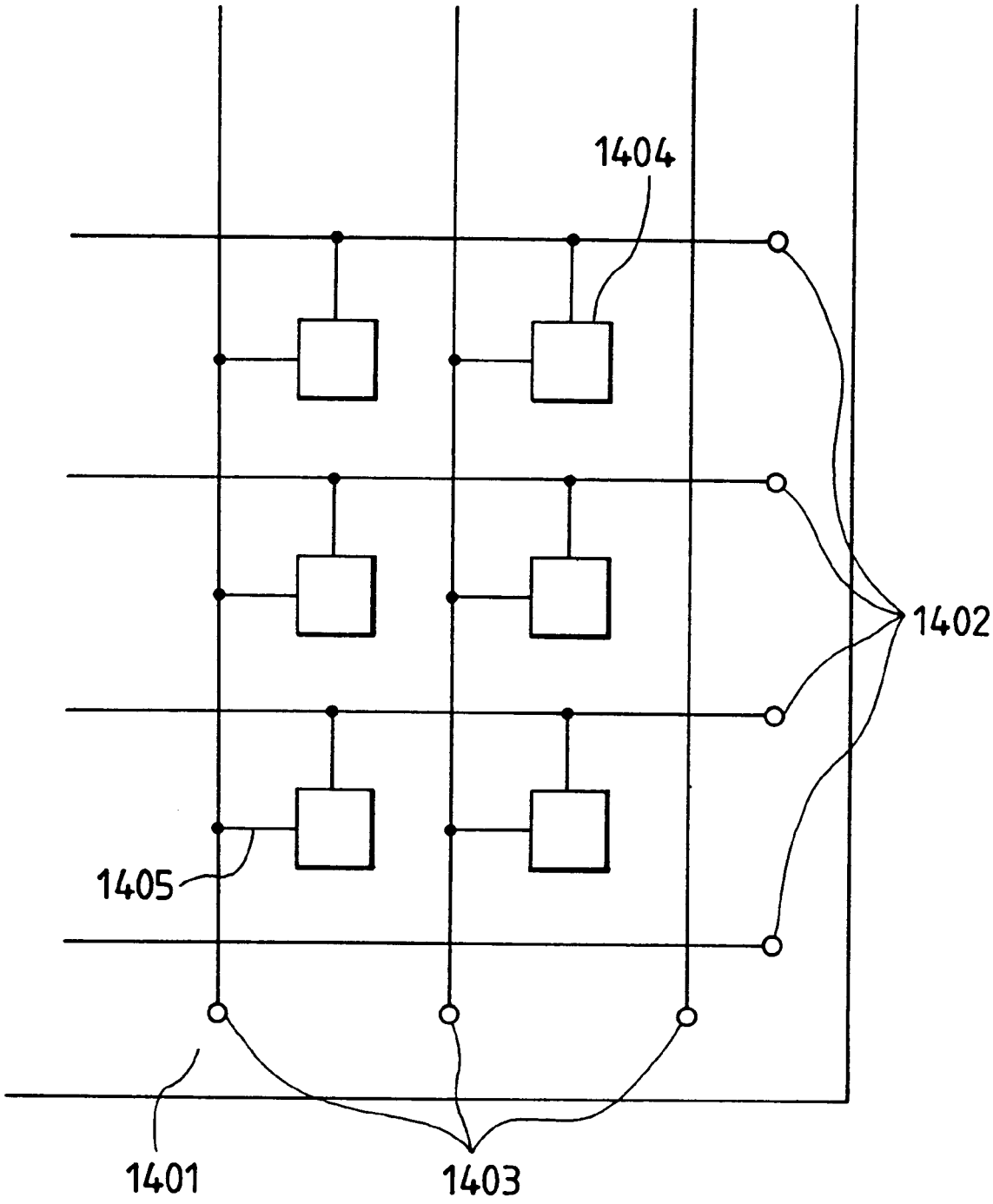
FIG. 13 is a schematic drawing illustrating surface-conductive electron-emitting devices.

FIG. 13 is a schematic drawing illustrating surface-conductive electron-emitting devices.

As shown in FIG. 13, the surface-conductive electron-emitting device according to the present embodiment is comprised of lower wiring 1402 which is formed upon a rear plate 1401 formed of an insulating material such as glass and connected to lead electrodes (not shown), upper wiring 1403 which is formed upon insulating layer formed upon the lower wiring 1402 and connected to lead electrodes (not shown), surface-conductive electron-emitting devices 1404 which employ Pd thin film, and wiring 1405 electrically connecting the upper wiring 1403, lower wiring 1402, and surface-conductive electron-emitting devices 1404. Further, an external driving power source (not shown) is connected to the lead electrodes for driving the surface-conductive electron-emitting devices.

The method of forming the above-described surface-conductive electron-emitting devices will now be described. Lower wiring is formed upon the rear plate 1401 by means of vapor deposition or the like. Next, an insulating layer is formed upon the formed lower wiring 1402, by means of chemical vapor deposition (CVD) or the like. Then, upper wiring 1403 is formed upon the formed insulating layer, by means of vapor deposition or the like. Subsequently, the upper wiring 1403 and the lower wiring 1402 are electrically connected with the surface-conductive electron-emitting devices 1404 by means of the wiring 1405.

The following is a detailed description of the surface-conductive electron-emitting devices 1404.

Figure 14A:
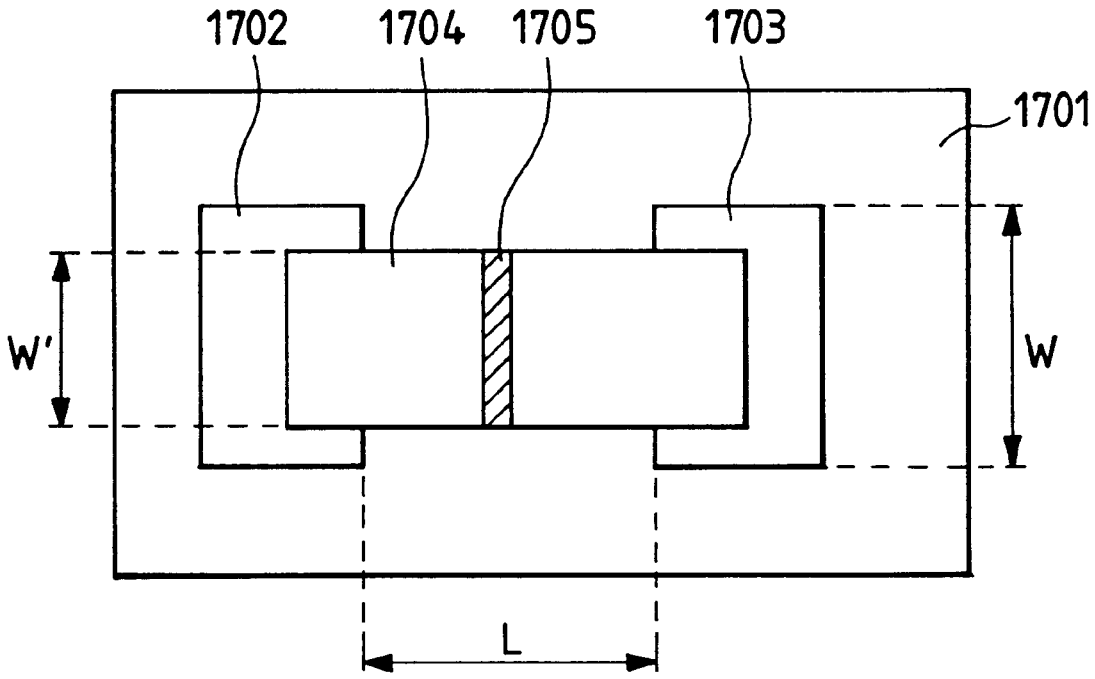
FIGS. 14A and 14B are drawings illustrating the structure of surface-conductive electron-emitting devices shown in FIG. 13, FIG. 14A being a plan view, and FIG. 14B a cross-section view.
Figure 14B:
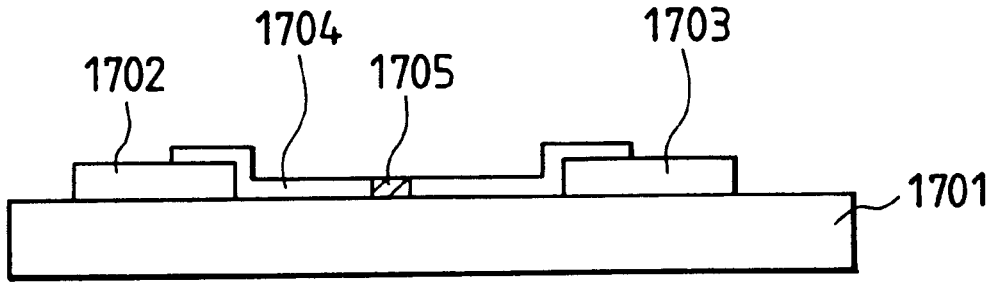

FIGS. 14A and 14B are drawings illustrating the structure of surface-conductive electron-emitting devices shown in FIG. 13, FIG. 14A being a plan view, and FIG. 14B a cross-section view.

As shown in FIGS. 14A and 14B, device electrodes 1702 and 1703 are provided on the substrate 1701, the device electrodes 1702 and 1703 being connected by electro-conductive thin film 1704, and an electron emitting portion 1705 being provided at apart of the electro-conductive thin film 1704. Any highly conductive material can be used for the material comprising the opposing device electrodes 1702 and 1703.

The distance L between the device electrodes 1702 and 1703 is designed taking in to account the form of application. The length W of the device electrodes 1702 and 1703 may be set within a range between several $\mu$m to several hundred $\mu$m, taking into consideration the resistance of the electrode and the electron emission properties thereof. Further, the film thickness of the device electrodes 1702 and 1703 may be set within a range between several hundred Å to several $\mu$m.

The thickness of the electro-conductive thin film 1704 is set appropriately taking into consideration the step coverage of the device electrodes 1702 and 1703, the resistance value between the device electrodes 1702 and 1703, and the later-described forming conditions, but generally a film thickness within the range of several Å to several thousand Å is preferable.

The following can be given as examples of material to appropriately select from for forming the electro-conductive thin film 1704: metals such as Pd, Pt, Ru, Ag, Au, Ti, In, Cu, Cr, Fe, Zn, Sn, Ta, W, Pb and the like; oxides such as PdO, $SnO_2$, $In_2O_3$, PbO, $Sb_2O_3$ and the like; borides such as $HfB_2$, $ZrB_2$, $LaB_6$, $CeB_6$, $YB_4$, $GdB_4$ and the like; carbides such as TiC, ZrC, HfC, TaC, SiC, WC and the like; nitrides such as TiN, ZrN, HfN and the like; semiconductors such as Si, Ge and the like; carbon; and the like.

The electron-emitting portion 1705 is constructed of a high-resistance fissure formed at one part of the electro-conductive thin film 1704, and is dependent of the film thickness and film properties of the electro-conductive thin film 1704, and the later-described forming conditions. Electro-conductive fine particles within the range of several Å to several hundred Å may be present in the electron emission portion 1705. Such electro-conductive fine particles contain part or all of the elements of the material comprising the electro-conductive thin film 1704. The electron-emitting portion 1705 and the electro-conductive thin film 1704 nearby may have carbon and carbon compounds.

Next, the method of manufacturing the surface-conductive electron-emitting device employed in the present invention will now be described.

Figure 15A:
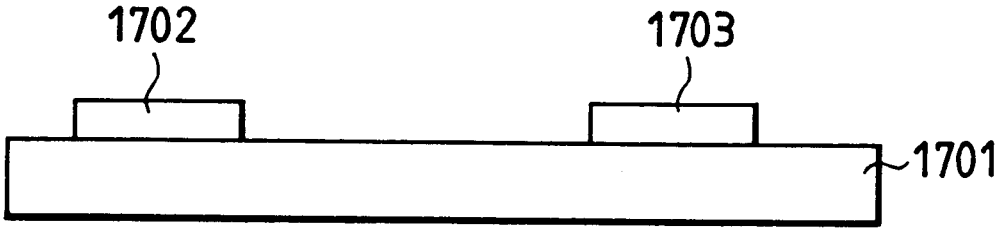
FIGS. 15A, 15B and 15C are drawings illustrating the fabrication method of the surface-conductive electron-emitting devices shown in FIGS. 14A and 14B.
Figure 15B:
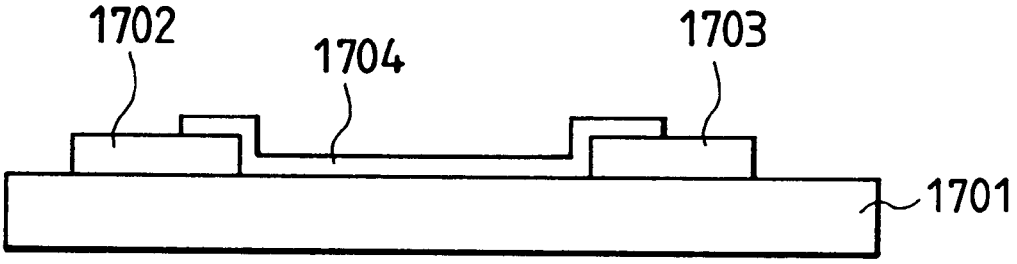
Figure 15C:
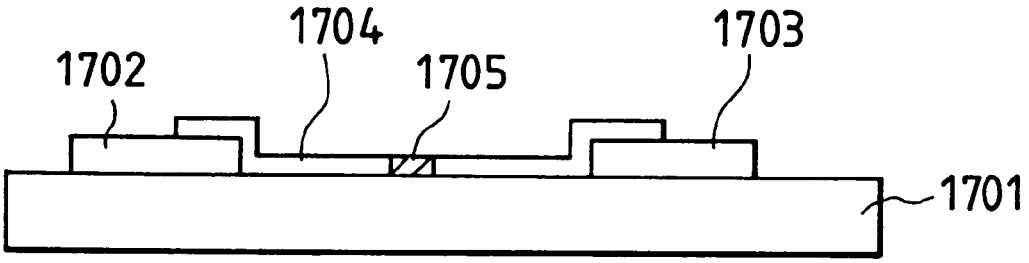

FIGS. 15A, 15B and 15C are drawings illustrating the fabrication method of the surface-conductive electron-emitting devices shown in FIGS. 14A and 14B (FIG. 13).

First, soda-lime glass comprising the substrate 1701 (the rear plate 1401 shown in FIG. 13) was cleaned sufficiently with detergent, pure water, and organic solvent, and upon this was layered the material of the device electrodes 1702 and 1703, i.e., Pt, to a thickness of 800 Å by means of sputtering, as shown in FIG. 15A. L shown in FIG. 14A was set at 10 $\mu$m, and W at 200 $\mu$m.

Next, a lift-off Cr film (not shown) was formed by means of vacuum vapor deposition to a film thickness of 1,000 Å, for the purpose of electro-conductive thin-film patterning. At this time, the opening of the Cr film corresponding to the width W' of the electro-conductive thin film 1704 as shown in FIG. 14A was made to be 100 $\mu$m.

An organic palladium solution (ccp-4230, manufactured by OKUNO SEIYAKU, INC.) was applied to substrate 1701

(the rear plate 1401 shown in FIG. 13) on which the device electrodes 1702 and 1703 are formed, the application being conducted by means of rotational application using a spinner, following which the device being fabricated was allowed to set, thus forming an organic Pd thin film. Following formation of the organic Pd thin film, the Pd thin film was baked in the atmosphere for 10 minutes at 300° C., thus forming an electro-conductive thin film 1704 comprised mainly of PdO fine particles. The thickness of this electro-conductive thin film 1704 was approximately 120 Å, and the sheet resistance was $5\times10^4$ Ω/□.

Subsequently, wet etching of the Cr thin film and the electro-conductive thin film 1704 was conducted using acid etching, thus obtaining the electro-conductive thin film 1704 with the desired pattern, as shown in FIG. 15B.

Figure 18A:
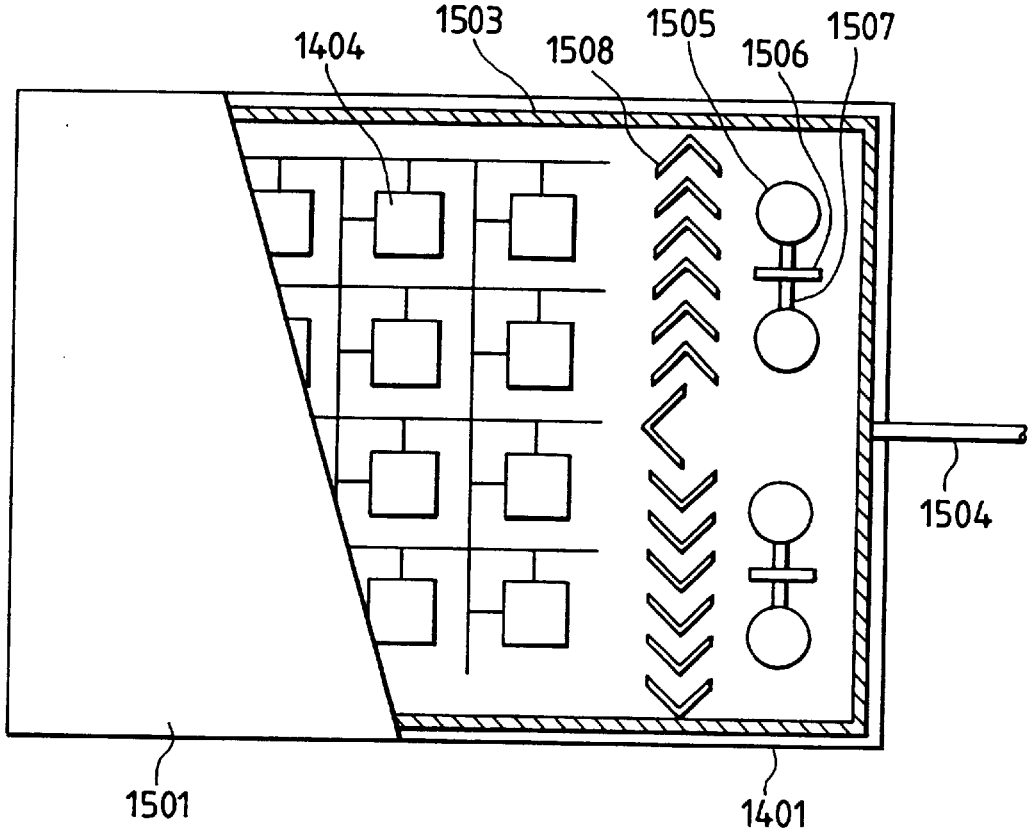
FIGS. 18A and 18B are diagrams illustrating an embodiment of an image display apparatus employing surface-conductive electron-emitting devices, FIG. 18A being a plan view, and FIG. 18B a cross-section view.
Figure 18B:
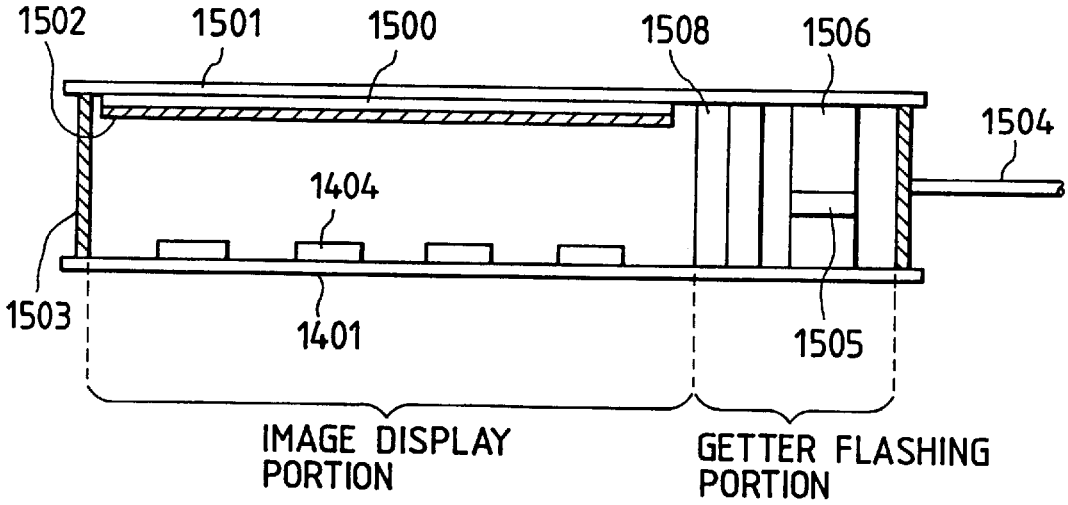

A great number of the surface-conductive electron-emitting devices manufactured as described above formed so as to be arrayed in a matrix upon the substrate 1701 (the rear plate 1401 shown in FIG. 13), and deployed within the image display apparatus shown in FIGS. 18A and 18B. Subsequently, the evacuation tube 1504 was used to evacuate the image display apparatus to a vacuum of $2\times10^{-7}$ Torr, voltage was applied to the device electrodes 1702 and 1703 to conduct electro-conductive forming, and thus forming the electron-emitting portion 1705 as shown in FIG. 15C.

In the event that electricity is applied to device electrodes 1702 and 1703 using an electrical power source, an electron-emitting portion 1705 with an altered structure is formed to the electro-conductive thin film 1704, but with electro-conductive forming, a member of altered structure is formed on the electro-conductive thin film 1704 which is locally destroyed, deformed, or changed in nature.

Figure 16:
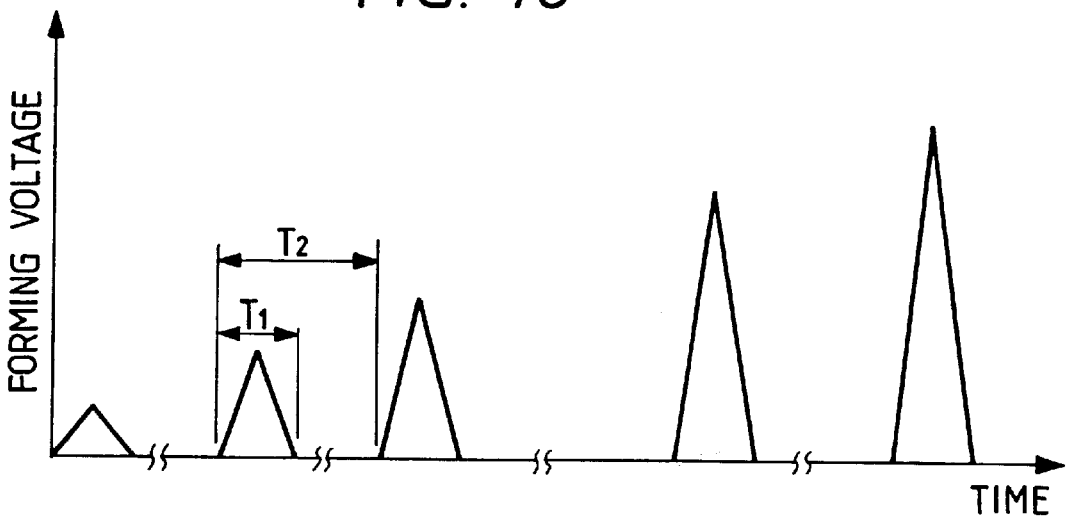
FIG. 16 is a diagram illustrating the forming voltage for when conducting electroconductive forming processing between the device electrodes.

FIG. 16 shows forming voltage for conducting electro-conductive forming between the device electrodes.

In the present embodiment, T1 in FIG. 16 was set at 1 mm second, T2 at 10 mm seconds, and electro-conductive forming was conducted by increasing the peak value of the triangular wave by increments of 0.1 V. Also, during forming, 0.1 resistance measurement pulses of 0.1 V were inserted simultaneously between T2, and the resistance was measured. Further, forming was considered to be completed when the measurement value of the resistance measurement pulse exceeded approximately 1 MΩ, and application of voltage to the device was terminated at the same time.

Then, after evacuating the image display apparatus to a vacuum of $1\times10^{-8}$ Torr by means of the evacuation tube 1504, acetone was introduced into the image display apparatus, as an organic substance. The partial pressure of the acetone at this time was $1\times10^{-5}$ Torr.

Figure 17:
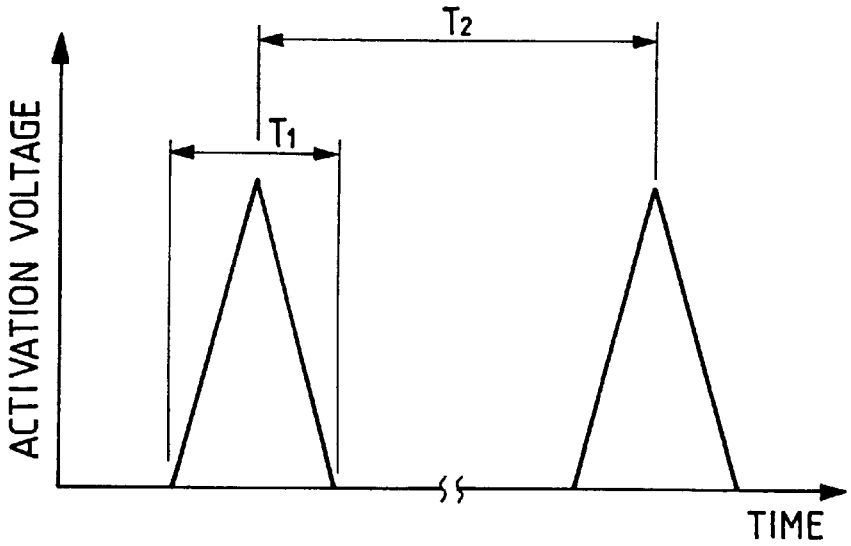
FIG. 17 is a diagram illustrating the activation voltage for when conducting activation processing to the surface-conductive electron-emitting devices.

Next, voltage pulses were applied to each of the surface-conductive electron-emitting devices formed upon the substrate 1701 (the rear plate 1401 shown in FIGS. 13, 18A and 18B), as activation processing. FIG. 17 is a diagram illustrating the activation voltage for when conducting activation processing to the surface-conductive electron-emitting devices. The voltage pulse applied to the surface-conductive electron-emitting devices was set so that the T1 in FIG. 17 was 1 mm second, T2 at 10 mm seconds, and the peak value at 15 V.

Voltage was applied to the metal back 1502 formed on the face plate within the image display apparatus shown in FIGS. 18A and 18B, and activation was conducted while measuring the emission current (Ie) being emitted from the electron-emitting device. This activation process was terminated at the point that Ie reached saturation.

Subsequently, the image display apparatus was evacuated from the evacuation tube 1504 to a vacuum of $1\times10^{-8}$ Torr, the evacuation tube 1504 was sealed, and the getter was flashed.

The following is a description of an image display apparatus employing surface-conductive electron-emitting devices such as have been described above. FIGS. 18A and 18B are typical diagrams illustrating an embodiment of an image display apparatus employing surface-conductive electron-emitting devices, FIG. 18A being a plan view, and FIG. 18B a cross-section view.

As shown in FIGS. 18A and 18B, an envelope is formed of a rear plate 1401, a face plate 1501 which is formed of the same insulating material as the rear plate 1401 and is formed of fluorescent material 1500 and aluminum metal back 1502 in that order from the side of the image display apparatus, and an outer frame 1503 which is connected with the periphery portions of both the face plate 1501 and rear plate 1401. This outer frame 1503 is for supporting the structure against the external pressure, and is provided with an evacuation tube 1504 for evacuation of the gas within the envelope. Fluorescent material 1500 and metal backing 1502 are formed on the face plate 1501. The spacing between the face plate and the rear plate is 3 mm. The areas where the face plate 1501 and outer frame 1503 are connected, as well as the areas where the rear plate 1401 and outer frame 1503 are connected, are bonded by means of glass with a low melting point.

Further, within the envelope, bonded to the face plate 1501 and rear plate 1401 in a generally vertical direction by means of glass with a low melting point or the like, is a getter scattering prevention member 1508 comprised of multiple V-shaped plates (modified chevron-type getter scattering prevention member) forming a getter scattering prevention wall, and also bonded is a getter holding jig 1506. Bonded to the getter holding jig 1506 are getter holding rods 1507, and bonded to the ends of the getter holding rods 1507 is getter 1505.

At the getter scattering prevention member 1508, at least two V-shaped getter scattering prevention walls are arrayed linearly so that the plates not to come into contact with one another, and so that there is no gap when viewed from the image display portion. With the present embodiment, two sets of V-shaped plates are situated upon a single line in a symmetrical manner, the apexes of the Vs in each set all facing in the same direction within that set, and the plates arrayed so that the apexes are situated at the point which is the center of a line connecting the two ends of the neighboring V. At the symmetrical center thereof, there is situated a single V-shaped plate, with the side opposite to the apex thereof facing the getter flashing portion.

Further, an image display portion comprised of surface-conductive electron-emitting devices 1404 is situated on the other side of the getter scattering prevention member 1508 from the side provided with getter 1505.

Next, the method of constructing the above-described image display apparatus will now be described. Glass which melts at a low temperature is coated at the points of connection with the face plate 1501, rear plate 1401, outer frame 1503, getter scattering prevention member 1508, and the getter holding jig 1506. The getter scattering prevention member 1508, getter holding jig 1506, and outer frame 1503 are positioned by means of a positioning jig, following which the glass which melts at a low temperature is heated and softened, and subsequently hardened, thus bonding the respective members.

After all of the members have been bonded, the gas within the envelope is evacuated from the evacuation tube 1504 by means of a turbo molecular pump or the like, and the evacuation tube 1504 is sealed at the point the interior of the envelope reaches a sufficient degree of vacuum. After sealing off the evacuation tube 1504, the getter 1505 is flashed by means of electrical induction heating or the like, thus completing the image display apparatus.

After completion of the image display apparatus, the voltage (several kV) applied to the metal back 1502 formed on the face plate 1501 causes the electrons emitted from the surface-conductive electron-emitting devices 1404 to be accelerated, and strike the phosphor 1500. Consequently, an image is displayed on the face plate 1501.

An image display apparatus as shown in FIGS. 18A and 18B was assembled, and it was found that this image display apparatus could be evacuated in a short time, a high degree of vacuum could be attained within the image display apparatus, and exhibited little screen brightness modifiedity, as with the third embodiment. Further, no passing over of getter material to the image display portion was observed therein, and there was no short-circuiting of wiring.

With the image display apparatus according to the present invention, the present invention is not particularly limited to any type of getter so long as it is of the evaporation type, with examples of the main component being Ba (barium), Ti (titanium), Ta (tantalum), Mo (molybdenum) and the like, but the present invention is not particularly limited to any of these. Also, there are several methods of getter flashing, such as electro-conductive heating, electrical induction heating, and the like, but the present invention is not particularly limited to any of these methods.

Further, with the image display apparatus according to the present invention, glass with a low melting point, supersonic soldering, or resin which hardens in the presence of ultraviolet rays are examples of the material which may be used to seal the face plate, rear plate outer frame, getter holding jig, getter holding rods, getter scattering prevention member, evacuation tube, etc., but the present invention is not particularly limited to any of these, so long as sealing and bonding can be conducted while maintaining vacuum-tightness.

Also, regarding the material for constructing the getter scattering prevention member formed within the image display apparatus according to the present invention, insulating material plates such as glass or the like is used. Regarding the thickness, the thinner the member is the better, but taking necessary strength into consideration, the thickness should be set appropriately.

Figure 19:
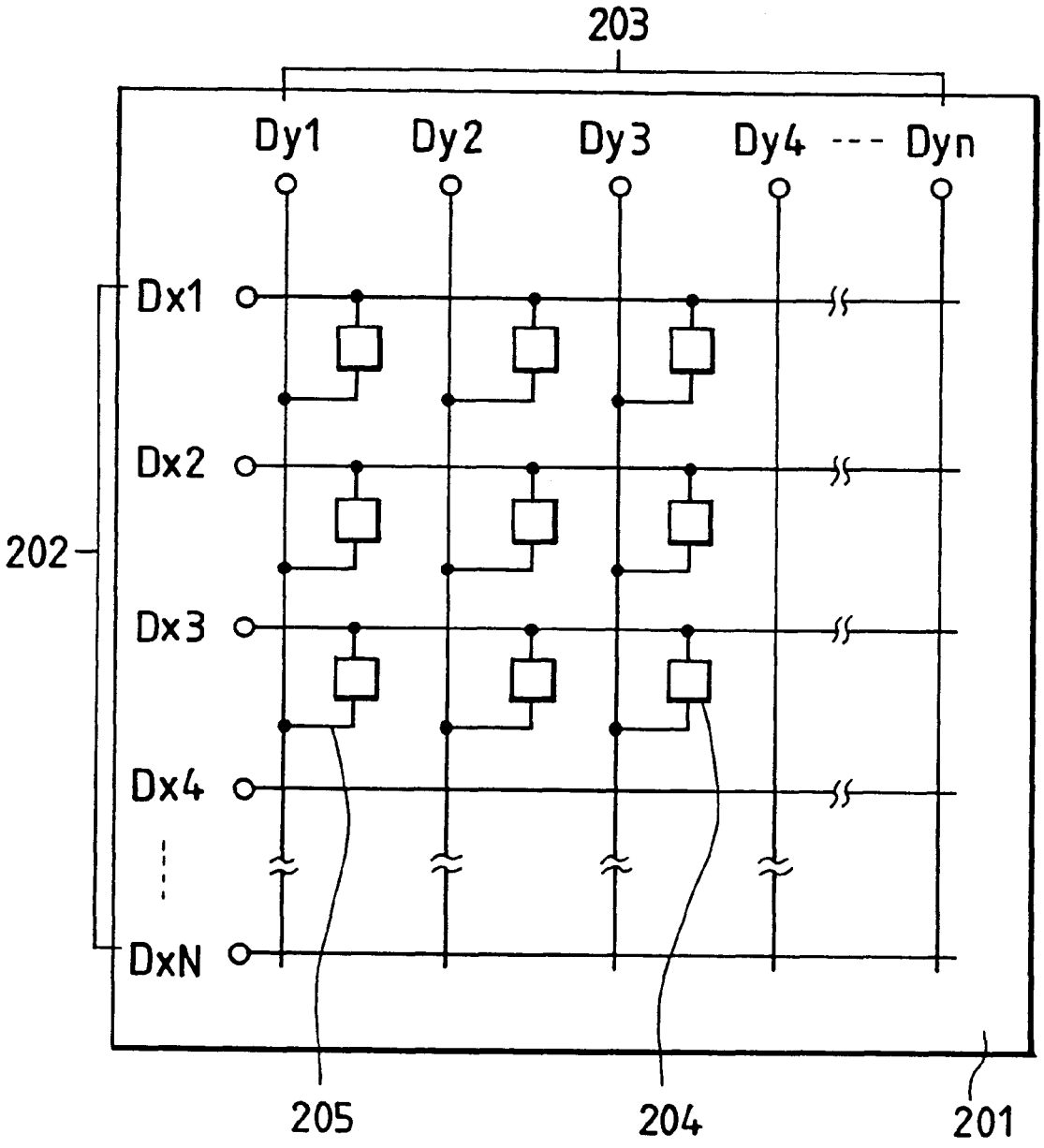
FIG. 19 is a schematic diagram illustrating an electron source substrate capable of being employed in the image display apparatus according to the present invention.

FIG. 19 is an explanatory diagram illustrating the driving method for driving the electron-emitting device employed in the image display apparatus according to the present invention.

The electron source substrate 201 (corresponding with 1401 shown in FIG. 13) shown in FIG. 19 is comprised of: X-directional wires 202 (corresponding with 1402 shown in FIG. 13) formed upon the substrate 201 of a conductive metal or the like being formed by vacuum evaporation, printing, spattering, etc., consisting of an N number of wires as in Dx1, Dx2, . . . , DxN; Y-directional wires 203 (corresponding with 1403 shown in FIG. 13) formed in the same manner as with the X-directional wires 202 and consisting of an n number of wires as in Dy1, Dy2, . . . , Dyn; wiring 205 (corresponding with 1405 shown in FIG. 13) formed of a conductive metal or the like; and surface-conductive electron-emitting devices 204 which are electrically connected by means of the X-directional wires 202, Y-directional wires 203, and wiring 205. Here, an unshown inter-layer insulation layer is formed between the X-directional wires 202 and Y-directional wires 203, thereby achieving electrical separation of X-directional wires 202 and Y-directional wires 203. Further, both the X-directional wires 202 and Y-directional wires 203 are extended as external terminals.

Regarding the material comprising the X-directional wires 202, Y-directional wires 203, and wiring 205, and the material comprising the pair of electrodes comprising the surface-conductive electron-emitting devices 204, the component elements of part or of all may be all the same or may be different. This material may be appropriately selected, e.g., according to the material comprising the pair of electrodes comprising the surface-conductive electron-emitting device 204. In the event that the material comprising the pair of electrodes comprising the surface-conductive electron-emitting devices 204 is the same material as the material comprising the X-directional wires 202, Y-directional wires 203, and wiring 205, the wiring coming into contact with the surface-conductive electron-emitting devices 204 can be considered to be device electrodes.

The inter-layer insulation layer is formed of $SiO_2$ or the like, formed by vacuum evaporation, printing, sputtering, etc. The inter-layer insulation layer formed between the X-directional wires 202 and Y-directional wires 203 is formed in a desired shape, with the film thickness, material, and fabrication method thereof being selected appropriately so as to be able to withstand the electric potential difference at the intersection point of the X-directional wiring 202 and the Y-directional wiring 203.

A scanning signal generating means (not shown) for applying scanning signals is connected to the X-directional wiring 202 in order to conduct scanning of rows of surface-conductive electron-emitting devices 204 arrayed in the X-direction, and a modulation signal generating means is connected to the Y-directional wiring 203 in order to conduct modulation, according to input signals, of columns of surface-conductive electron-emitting devices 204 arrayed in the Y-direction. Further, the drive voltage applied to each of the electron-emitting devices is provided as the difference voltage between the scanning signals and modulation signals thereof.

With the above construction, it becomes possible to select and drive individual devices by means of only a simple matrix wiring.

Tenth Embodiment

Figure 28:
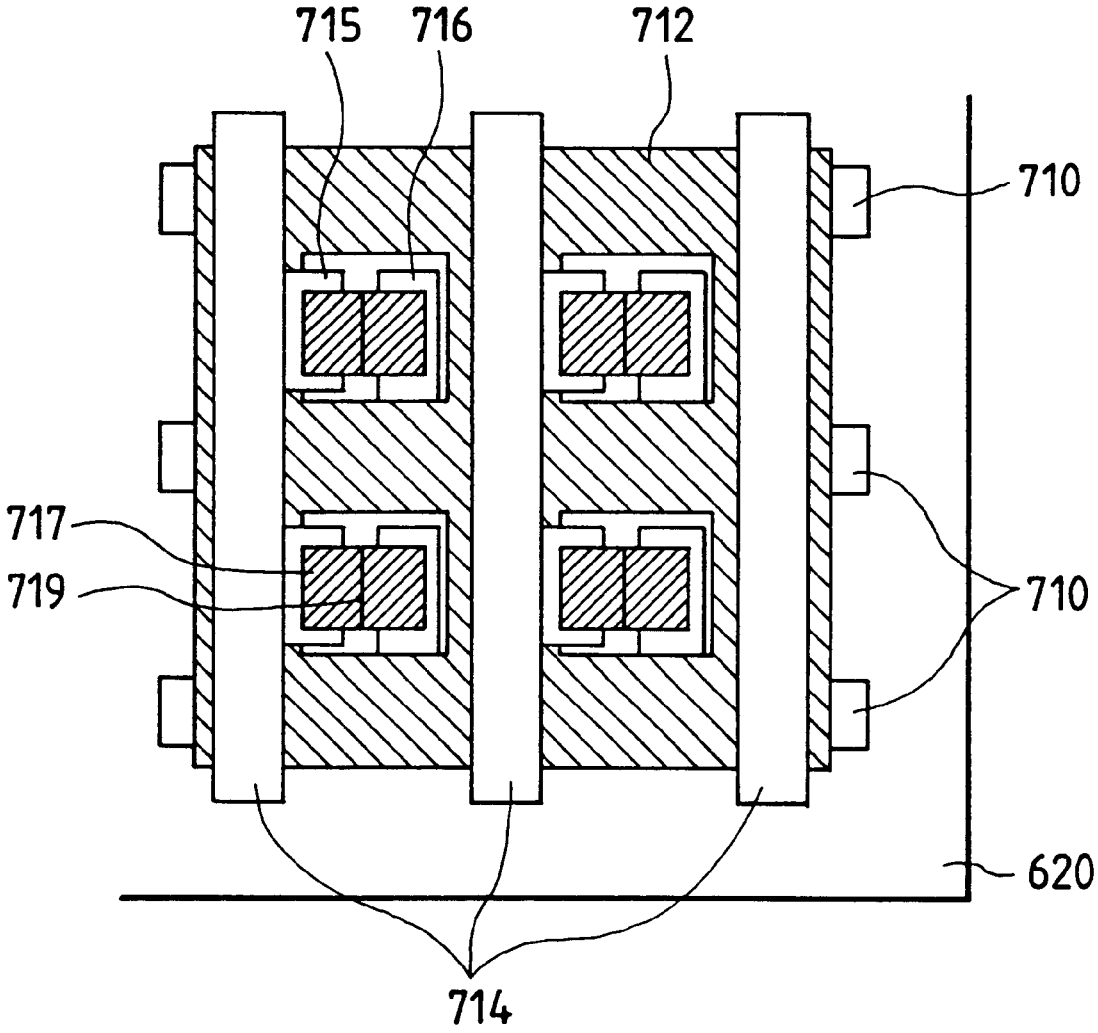
FIG. 28 is a schematic diagram of surface-conductive electron-emitting devices.

A tenth embodiment will be used for description of using surface-conductive electron-emitting devices as a fluorescence excitation means. FIG. 28 is a schematic diagram of surface-conductive electron-emitting devices.

As shown in FIG. 28, the surface-conductive electron-emitting device according to the present embodiment is formed upon a rear plate 620 which is a substrate formed of an insulating material such as soda-lime glass or the like, and is comprised of lower wiring 710 which is connected to lead electrodes (not shown), an insulating layer 712 formed upon the lower wiring 710, upper wiring 714 which is formed upon the insulating layer 712 and is connected to lead electrodes (not shown), and device electrodes 715 and 716. Further, an external driving power source (not shown) is connected to the lead electrodes for driving the surface-conductive electron-emitting devices.

The method of forming the above-described surface-conductive electron-emitting device will now be described. Lower wiring 710 and device electrode 716 are formed upon the rear plate 620 by means of vapor deposition or the like. Next, an insulating layer 712 is formed upon the formed lower wiring 710, by means of chemical vapor deposition or the like. Then, upper wiring 714 is formed upon the formed insulating layer, by means of vapor deposition or the like. Next, device electrodes 715 is extended from the upper wiring 714, so that the spacing between the two electrodes is approximately 10 $\mu$m.

Subsequently, a PdO thin film (palladium oxicide) 717 is formed upon the device electrodes 715 and 716, and by means of electrical conductance between the upper wiring 714 and lower wiring 710, an electron-emitting portion 719 which is a high-resistance area is formed at apart of the PdO thin film 717.

When voltage from an external drive power source is applied to the surface-conductive electron-emitting device formed as described above, the voltage is applied to the Pd thin film 717 via the lead electrode, upper wiring 714, and lower wiring 710, and electrons are thus emitted from the electron-emitting portion 719.

Figure 29A:
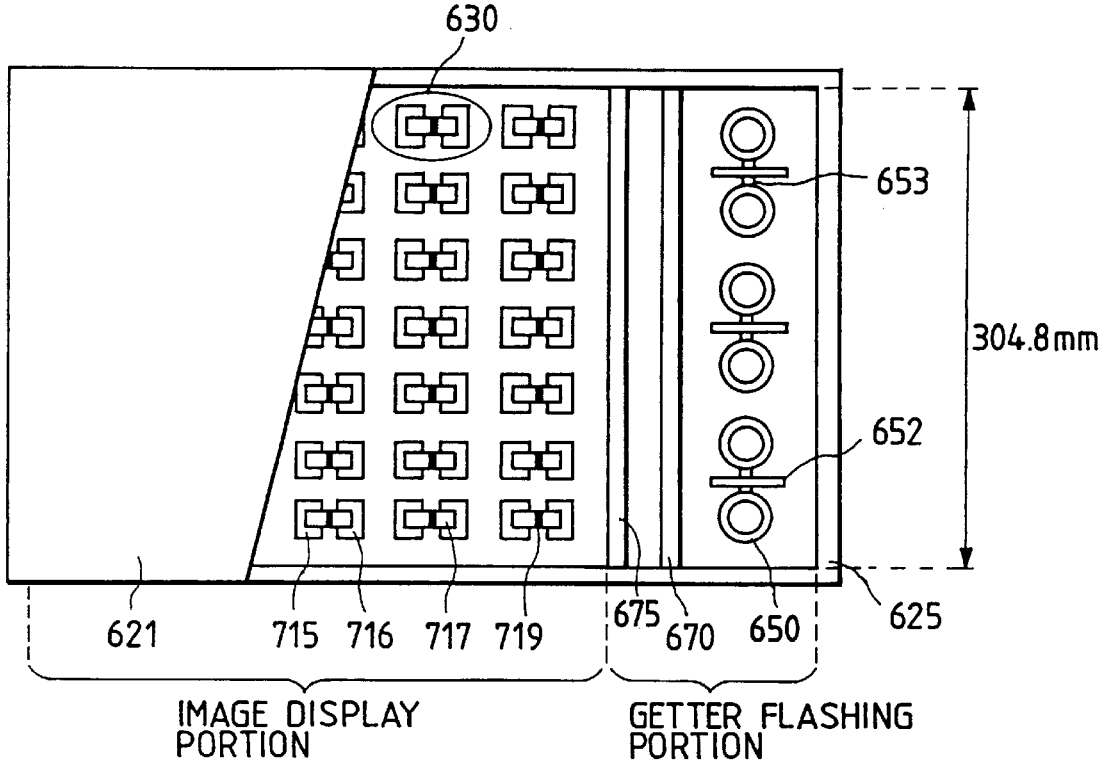
FIGS. 29A and 29B are drawings illustrating a tenth embodiment of the image display apparatus according to the present invention, FIG. 29A being a plan view, and FIG. 29B a cross-section view.
Figure 29B:
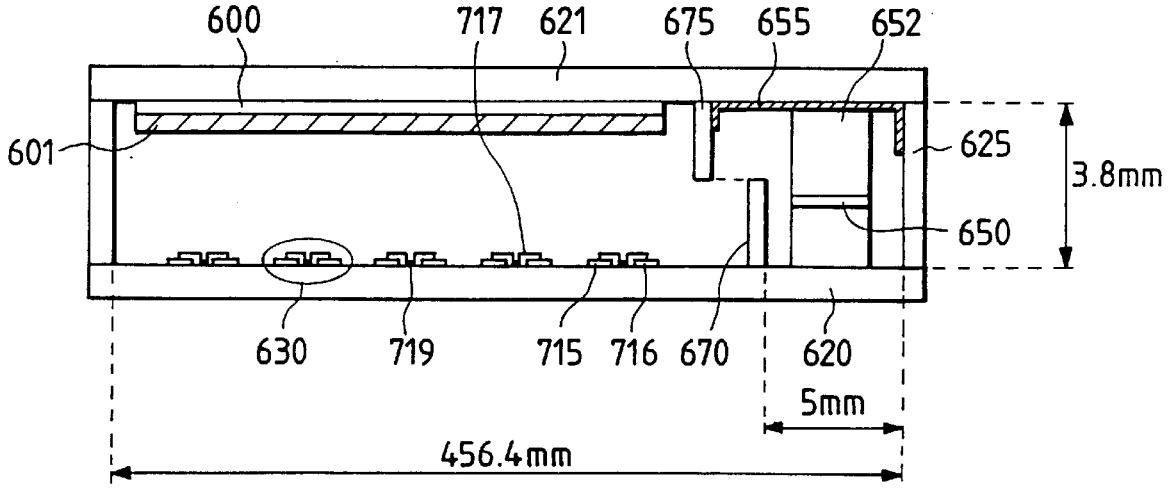

The following is a description of an image display apparatus according to the present invention employing surface-conductive electron-emitting devices such as have been described above. FIGS. 29A and 29B are drawings illustrating the present embodiment of the image display apparatus according to the present invention employing surface-conductive electron-emitting devices, FIG. 29A being a plan view, and FIG. 29B a cross-section view. The image display apparatus according to the present invention has an image display portion which is 20 inches diagonally with a ratio of 4:3.

As shown in FIGS. 29A and 29B, an envelope is formed of a rear plate 620, a face plate 621 which is formed of the same insulating material as the rear plate 620 and is formed of fluorescent material 600 and metal back 601 in that order from the side of the image display apparatus, and an outer frame 625 which is connected with the periphery portions of both the face plate 621 and rear plate 620. This outer frame 625 is for supporting the structure against the external pressure. The areas where the face plate 621 and outer frame 625 are connected, as well as the areas where the rear plate 620 and outer frame 625 are connected, are bonded by means of glass with a low melting point. The spacing between the face plate 621 and the rear plate 620 was set at 3.8 mm. Also, the size of the interior of the vacuum container was set at 304.8 mm vertically and 456.4 mm horizontally.

Further, within the envelope, bonded to the face plate 621 and rear plate 620 in a generally vertical direction by means of glass with a low melting point or the like, is a getter holding jig 652. Bonded to the getter holding jig 652 are getter holding rods 653, and bonded to the ends of the getter holding rods 653 is getter 650. The main components used for this getter material is nitrogen-doped Ba (barium), Al (aluminum), and Ni (nickel). The diameter of the ring-shaped getter 650 was set at 4 mm. Further, getter scattering prevention wall 675 and getter scattering prevention wall 670 are respectively bonded to the face plate 621 and rear plate 620 so that the position of bonding is parallel each one to another. The getter scattering prevention walls 670 and 675 are situated in a generally vertical direction to the face plate 621 and rear plate 620, with the distance between the getter scattering prevention wall 670 and the outer frame 625 being 5 mm. The getter scattering prevention member according to the present embodiment thus prevents getter material from passing over from the getter 650 to the image display portion.

Now, the getter scattering prevention walls 670 and 675 are formed at a thickness of 0.1 mm, and situated so that the closest distance between the getter scattering prevention walls 670 and 675 is 1.9 mm, that the closest distance between the getter scattering prevention wall 670 and the face plate 621 is 1.9 mm, and so that the closest distance between the getter scattering prevention wall 675 and the rear plate 620 is 1.9 mm. The getter holding rods 653 are provided in order to prevent the getter holding jig 652 from being damaged due to the heat generated when the getter 650 is flashed.

When forming the above-described image display apparatus, the getter 650 is baked while the interior of the apparatus is being evacuated by means of an evacuation tube (not shown). The evacuation tube is sealed at the point the interior of the envelope reaches approximately $1\times10^{-8}$ Torr, meaning that sufficient evacuation has been conducted. After sealing off the evacuation tube, the getter is heated and flashed by means of electrical induction heating or the like, thus completing the image display apparatus.

After completion of the image display apparatus, the voltage (several kV) applied to the metal back 601 formed on the face plate 621 causes the electrons emitted from the surface-conductive electron-emitting devices 630 to be accelerated, and strike the fluorescent material 600 on the face plate 621. Consequently, an image is displayed.

Now, a comparison will be made to find out how much of an advantage in evacuation the getter scattering prevention member comprised by attaching the getter scattering prevention walls 670 and 675 to the face plate 621 and rear plate 620 in a generally vertical manner has, as compared to the known getter scattering prevention member comprised of a simple plate. As an example, the pressure distribution within the envelope of image display apparatuses will be calculated by means of computer simulation regarding FIGS. 37B1 and 37B2 showing the typified image display apparatus according to the present invention showing FIGS. 29A and 29B, and FIGS. 37A1 and 37A2 showing the typified known image display apparatus, thus comparing the two.

The "3-Dimensional Dilute Gas Flow Analysis Program RAFAL-3D Ver.3.4" (by Kagaku Gijutsu Software, Inc.) was used for the simulation. Description of the calculation method regarding this simulation will be omitted here, as it has already been described in the first embodiment.

FIGS. 37A1 and 37A2 are drawings illustrating an envelope of an image display apparatus provided with a known getter scattering prevention member 101 and an area 102 with getter material adhered thereto (getter flashing portion), wherein FIG. 37A1 is a frontal view and FIG. 37A2 a cross-section view.

The envelope is a rectangular parallelepiped with the dimensions of 304.8 mm in length, 456.4 mm in width, and 3.8 mm in height, i.e., the spacing between the face plate 621 and the rear plate 620. When this rectangular parallelepiped envelope is viewed from the front, with the getter scattering prevention member 101 comprised of a simple plate as the boundary, the area of 304.8 mm (12 inches) in length and 406.4 mm (16 inches) in width opposite to the area 102 to which getter is adhered becomes the image display portion. Accordingly, this envelope is a comparative model with the thin flat-type display according to the present embodiment, 20 inches diagonally.

As shown in the cross-section view in FIG. 37A2, the getter material adheres only to the face plate side. In order to prevent the getter material particles from scattering to the image display portion upon flashing of the getter, the area 102 to which getter is adhered is limited only to the area behind the getter scattering prevention member 101 comprised of a simple plate.

FIGS. 37B1 and 37B2 are drawings illustrating an image display apparatus employing the getter scattering prevention member 103 according to the present invention constructed by attaching the getter scattering prevention walls 670 and 675 to the face plate and rear plate in a generally vertical manner, and an area 104 to which getter is adhered, wherein FIG. 37B1 is a frontal view and FIG. 37B2 a cross-section view.

The envelope is a rectangular parallelepiped with the dimensions of 304.8 mm in length, 456.4 mm in width, and 3.8 mm in height. When this rectangular parallelepiped envelope is viewed from the front, with the getter scattering prevention member 103 comprised of two opposing plates as the boundary, the area of 304.8 mm (12 inches) in length and 406.4 mm (16 inches) in width opposite to the area 104 to which getter is adhered becomes the image display portion.

As shown in the cross-section of FIG. 37B2, the getter scattering prevention member 103 comprised of two opposing plates consists of two plates 304.8 mm in length and 1.9 mm in width being attached to the face plate and rear plate in a generally vertical manner. The spacing between the two plates comprising the getter scattering prevention member 103 is 1.9 mm. The thickness of the plates comprising the getter scattering prevention member 103 will be ignored.

The getter material is caused to adhere to the face plate side and part of the getter scattering prevention member. The area 104 to which getter is adhered may cover the entirety of the face plate side of the getter flashing portion.

The conditions for the computer simulation are as follows: the temperature of the entire envelope was set at a constant 300K, and it was assumed that $H_2O$ (water vapor) was being emitted from the surface of the envelope and the getter scattering prevention member 101 and 103 at a rate of $1.0\times10^{-10}$ Torr·liter/cm$^2$/sec. It was also assumed that there is no emission of $H_2O$ (water vapor) from the areas 102 and 104 with adhesion of getter material.

The adsorption rate of the getter was assumed to be 0.01. An adhesion rate of 0.01 means that if 100 $H_2O$ molecules strike the areas 102 and 104 with adsorption of getter material, 1 $H_2O$ molecule will adsorb to the getter.

Collision of the $H_2O$ molecules one with another is ignored, taking into account only the collision of the $H_2O$ molecules with the solid walls.

With the envelope provided with the known getter scattering prevention member 101 comprised of a simple plate shown in FIGS. 37A1 and 37A2, the area emitting $H_2O$ (water vapor) is 2727.8 cm$^2$, and the area 102 to which getter is adhered is 132.4 cm$^2$. On the other hand, with the envelope provided with the getter scattering prevention member 103 comprised of two opposing plates shown in FIGS. 37B1 and 37B2, the area emitting $H_2O$ (water vapor) is 2705.0 cm$^2$, and the area 104 to which getter is adhered is 146.6 cm$^2$.

Atmospheric pressure supporting structures (spacers) are not provided within the envelope for this computer simulation.

Emitting of $H_2O$ molecules and getter adsorption begins from time zero. The number of $H_2O$ molecules within the envelope increases with the passing of time, and the number of molecules eventually reaches a constant value, and attains a constant state with no more change in the number than some fluctuation around the constant. Once judgment is made that the system is in a sufficiently constant state, the time average of pressure distribution is obtained.

The results were as follows: with the envelope provided with the known getter scattering prevention member 101 comprised of a simple plate shown in FIGS. 37A1 and 37A2, the pressure was within a range between $3.5\times10^{-8}$ Torr to $8.5\times10^{-8}$ Torr, and with the envelope provided with the getter scattering prevention member 103 comprised of two opposing plates shown in FIGS. 37B1 and 37B2, the pressure was within a range between $1.7\times10^{-8}$ Torr to $3.9\times10^{-8}$ Torr.

As can be understood from the above, using the getter scattering prevention member 103 comprised of two opposing plates according to the present invention makes for a smaller difference in the maximum and minimum values or the pressure of the image display portion, and the pressure distribution is more even, as compared to the known getter scattering prevention member 101 comprised of a simple plate. Accordingly, irregularities in brightness can also be diminished. Further, the pressure of the image display portion can also be further decreased, due to the area to which getter can be adhered being a wider area. This makes it possible for the working life expectancy of the image display apparatus to be extended.

Incidentally, the reason that the image display apparatus employing the known getter scattering prevention member was provided with gaps of 20 mm in width on-both side between the plate and outer frame was to allow the degree of vacuum to be brought to a value similar to that of the image display apparatus employing the getter scattering prevention member according to the present invention, i.e., in the $10^{-8}$ Torrs, so as to make a comparison in the form thereof.

The image display apparatus according to the present embodiment constructed as described above was excellent, with no short-circuiting of wiring between the upper and lower wiring and no passing over of getter material following getter flashing. Further, the pressure distribution within the image display apparatus was more uniform than that of the known image display apparatus, and thus the life expectancy of the image display apparatus was extended markedly.

Eleventh Embodiment

Figure 23A:
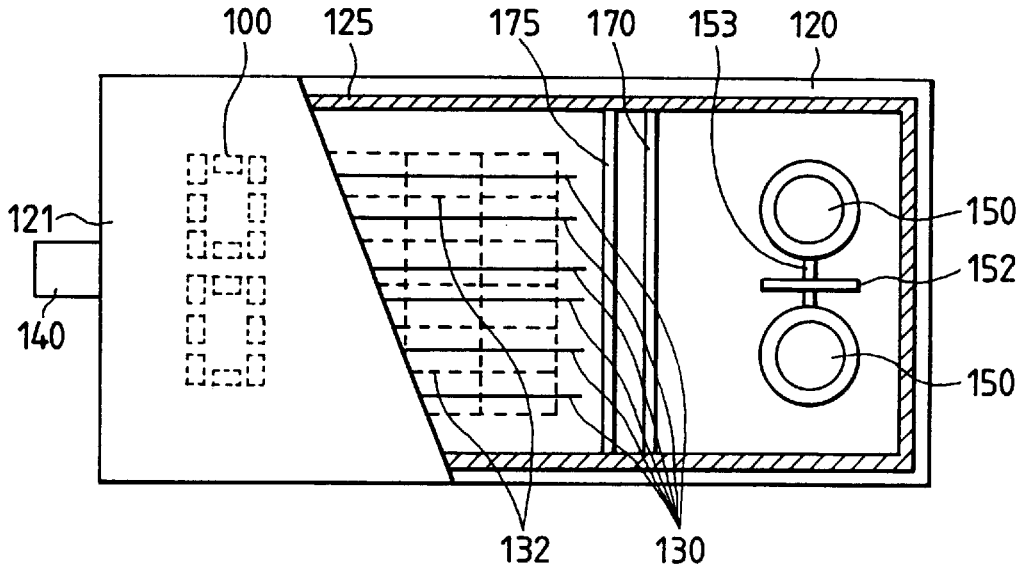
FIGS. 23A and 23B are drawings illustrating an eleventh embodiment of the image display apparatus according to the present invention, FIG. 23A being a plan view, and FIG. 23B a cross-section view.
Figure 23B:
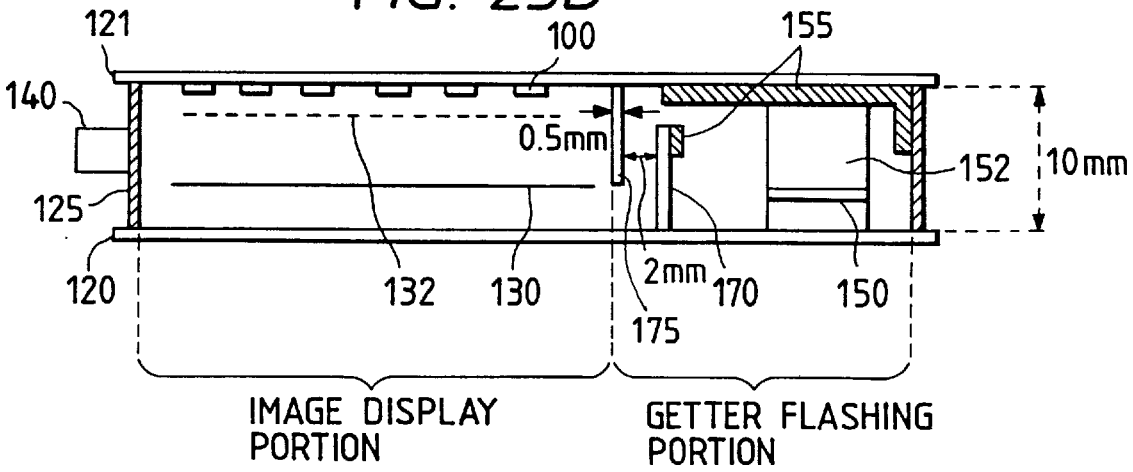

FIGS. 23A and 23B are drawings illustrating an eleventh embodiment of the image display apparatus according to the present invention, FIG. 23A being a plan view, and FIG. 23B a cross-section view.

As shown in FIGS. 23A and 23B, the present embodiment is comprised of a face plate 121 formed of an insulating material such as glass and serving as an image display portion, a rear plate 120 formed of an insulating material such as glass and situated so as to oppose the face plate 121, and an outer frame 125 10 mm in width for supporting the structure against the external pressure. The areas where the face plate 121 and outer frame 125 are connected, as well as the areas where the rear plate 120 and outer frame 125 are connected, are bonded by means of glass with a low melting point, or the like. The spacing between the face plate 121 and the rear plate 120 was set at 10 mm. Reference numeral 100 denotes image patterns.

Further, within the envelope, bonded to the face plate 121 and rear plate 120 in a generally vertical direction by means of glass with a low melting point or the like is a getter holding jig 152. Bonded to the getter holding jig 152 are getter holding rods 153, and bonded to the ends of the getter holding rods 153 is getter 150, the main component thereof being Ba (barium). Further, getter scattering prevention wall 175 and getter scattering prevention wall 170 are respectively bonded to the face plate 121 and rear plate 120 so that the position of bonding is parallel each one to another, the getter scattering prevention walls 170 and 175 comprising the getter scattering prevention member being flat glass plates. The getter scattering prevention walls 170 and 175 are situated in a generally vertical direction to the face plate 121 and rear plate 120, thus preventing getter material from passing over from the getter 150 to the image display portion.

Now, the getter scattering prevention walls 170 and 175 are formed at a thickness of 0.5 mm, and situated so that the closest distance between the getter scattering prevention walls 170 and 175 is 2 mm, and so that the closest distance between the getter scattering prevention wall 170 and the face plate 121, as well as the closest distance between the getter scattering prevention wall 175 and the rear plate 120 both are 4 mm. The getter holding rods 153 are provided in order to prevent the getter holding jig 152 from being damaged due to the heat generated when the getter 150 is flashed.

Further, on the other side of the getter scattering prevention walls 170 and 175 from the side provided with getter 150, i.e., on the image display portion side, a plurality of display portions are arrayed, with each display portion comprising an image pattern formed of an anode and fluorescent material (not shown), a control grid 132 for controlling the content of the image, and a filament 130.

Next, the method of constructing the above-described image display apparatus will now be described. Glass which melts at a low temperature is each coated at the points of connection with the face plate 121, rear plate 120, outer frame 125, getter scattering prevention walls 170 and 175, and the getter holding jig 152. The getter scattering prevention walls 170 and 175, getter holding jig 152, and outer frame 125 are positioned by means of a positioning jig, following which the glass which melts at a low temperature is heated and softened, and subsequently hardened, thus bonding the respective members.

After all of the members have been bonded, the gas within the envelope is evacuated from the evacuation tube 140, and the evacuation tube 140 is sealed at the point the interior of the envelope reaches a degree of vacuum approximating $1\times10^{-7}$ Torr.

While conducting evacuation of the envelope by means of the evacuation tube 140, the getter 150 is baked by means of electrical induction heating. After sealing off the evacuation tube 140, the getter 150 is flashed by means of electrical induction heating or the like, forming a getter adhesion surface 155, and thus completing the image display apparatus.

After completion of the image display apparatus, heating the filament 130 which is a thermionic-cathode causes to emit electrons, to be accelerated by means of an anode (not shown), and strike the image pattern. Consequently, an image is displayed on the face plate 121.

Figure 24:
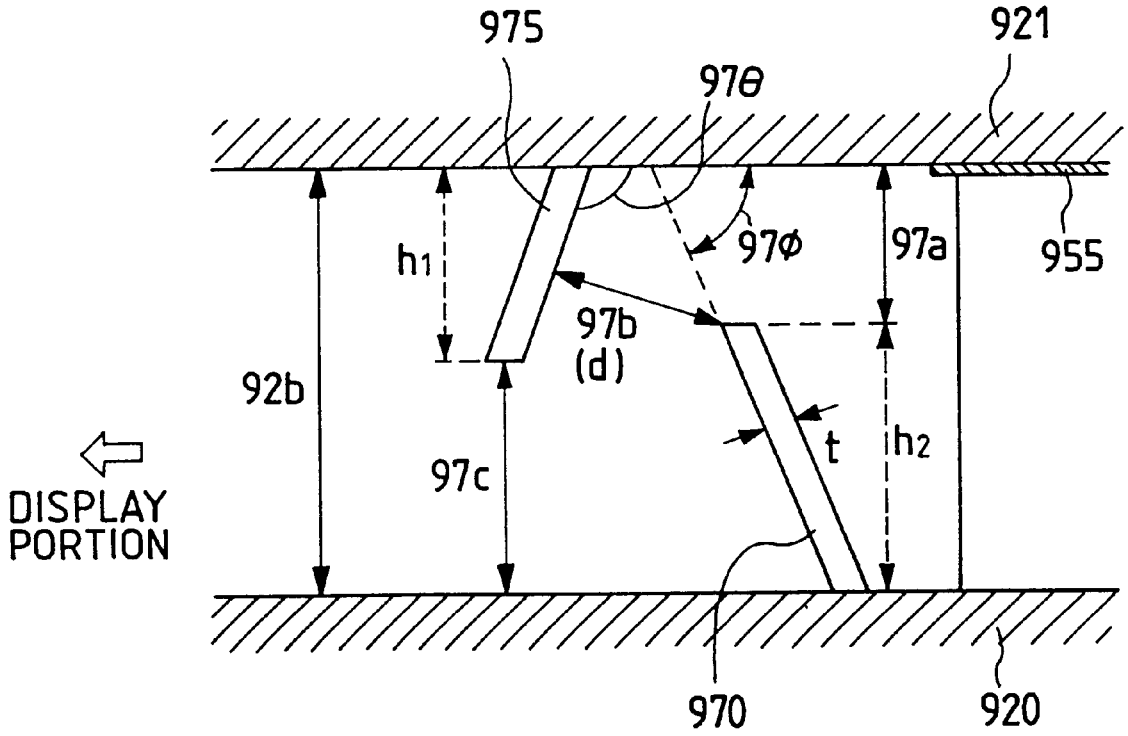
FIG. 24 is an explanatory drawing illustrating the position of the getter scattering prevention wall within the image display apparatus according to the present invention.

Next, description will be made regarding the position of the getter scattering prevention walls comprising the getter scattering prevention member according to the present invention. FIG. 24 is an explanatory drawing illustrating the position of the getter scattering prevention wall within the image display apparatus according to the present invention.

The minimum distance 97*a* between the getter scattering prevention wall 970 and the face plate 921, and the minimum distance 97*c* between the getter scattering prevention wall 975 and the rear plate 920 effect the conductance, i.e., the flowability of gas particles in the area of the image display apparatus where the getter scattering prevention walls are formed. Here, the thickness of the getter scattering prevention wall 970 is denoted by "t".

It is desirable that the minimum distance between the side of the getter scattering prevention wall 970 which is closer to the getter adhesion area 955 and the apparatus wall (face plate 921), i.e., the distance 97*a*, be narrow in order to prevent passing over of the getter material to the image display portion. On the other hand, it is desirable that the minimum distance between the side of the getter scattering prevention wall 975 which is farther from the getter adhesion area and the apparatus wall (rear plate 920), i.e., the distance 97*c*, be wide in order to allow for removal of residual gas particles in the image display apparatus following getter flashing, by means of the getter adhesion surface 955.

As shown in FIG. 24, the second getter scattering prevention member according to the present invention is comprised of at least a first getter scattering prevention wall (970 or 975) and a second getter scattering prevention wall (970 or 975).

It is also desirable that the respective attachment positions of the first and second getter scattering prevention walls to the face plate and rear plate be generally parallel.

Also, as shown in FIG. 24, the respective angles of the first and second getter scattering prevention walls to the face plate and rear plate may differ.

Further, with the respective lengths of the first and second getter scattering prevention walls when measured in the direction of the gap with the face plate and rear plate represented by h1 and h2, and with the spacing between the face plate and rear plate represented by H, the second getter scattering prevention member according to the present invention satisfies both of the following expressions at the same time:

$$h1\neq0,\ h2\neq0 \qquad \text{Expression A}$$

$$H\leqq h1+h2<2H \qquad \text{Expression B}$$

Further, with the minimum distance between the getter scattering prevention walls represented by "d" (97*b*), preferably, the second getter scattering prevention member according to the present invention satisfies the following expression at the same time as with the above expressions A and B.

$$0<d\leqq H \qquad \text{Expression C}$$

Moreover, the most desirable form, i.e., the form where the conductance is optimal, is one wherein the angle of the first and second getter scattering prevention walls to the face plate and rear plate is generally vertical thereto, and wherein the following expression holds:

$$d=h1=h2=H/2 \qquad \text{Expression D}$$

The number of getter scattering prevention walls employed in the present embodiment was two. Two or more getter scattering prevention walls are necessary, as they are each situated on opposing parallel apparatus walls. Two getter scattering prevention walls are most desirable, as the positioning and method of providing the getter scattering prevention walls becomes more complicated when three or more are disposed; however, the present invention is not limited to this arrangement.

Regarding the spacing between the face plate 123 and rear plate 120 shown in FIGS. 23A and 23B, a distance of 10 mm was set for the present embodiment, but the present invention is not limited to this arrangement, as long as this spacing is sufficient to cause excitation of the fluorescent material (not shown) by means of the electrons generated by the filament 130, thereby forming an image. Also, the present invention is not particularly limited to any fluorescent material for displaying an image.

Although Ba (barium) was used for getter in the image display apparatus according to the present embodiment, the present invention is not particularly limited to any type of getter so long as it is of the evaporation type, without being dependent on the type of getter material. Also, there are several methods of getter flashing, such as conductive heating, electrical induction heating, and the like, but the present invention is not particularly limited to any of these methods.

Further, although glass with a low melting point was employed as material for sealing the face plate, rear plate, outer frame, getter holding jig, and getter scattering prevention member for the image display apparatus according to the present invention, the glass with a low melting point being provided to the contact points thereof, supersonic soldering, or resin which hardens in the presence of ultraviolet rays may be used instead. The present invention is not particularly limited to any of these, so long as sealing and bonding can be conducted while maintaining vacuum-tightness.

Also, regarding the thickness of the getter scattering prevention walls, the thickness should be set appropriately taking into consideration the size of the aforementioned image display apparatus, the distance between the face plate and rear plate, the angle and spacing of the getter scattering prevention walls, and the minimum distance of each.

As for a fluorescent material excitation source preferably used in the present invention, electron beams which require a high degree of vacuum are appropriate. Although the present embodiment used electrons generated by heating the filament 130 as an electron generating means, the present invention is not limited to such an arrangement; electron emission from a field emitter device such as employed in the first embodiment, or electron emission from a surface-conductive electron-emitting device such as employed in the ninth embodiment are also applicable, with the present invention not be limited to any particular method as long as excitation of the fluorescent material is possible.

With the image display apparatus according to the present embodiment constructed as described above, it was found that this image display apparatus could be evacuated in a short time via the evacuation tube, the pressure distribution within the image display apparatus was uniform, a high degree of vacuum could be attained within the image display apparatus, and thus the working life expectancy of the image display apparatus was extended markedly. Further, no passing over of getter material to the image display portion was observed therein.

Twelfth Embodiment

As a twelfth embodiment, description will be made regarding increasing the distance between the getter scattering prevention wall and the surface opposite to the surface to which the getter scattering prevention wall is bonded, this distance being indicated in FIG. 24 as 97*a* and 97*c*, in proportion with the distance from the position to which getter is situated.

Figure 25A:
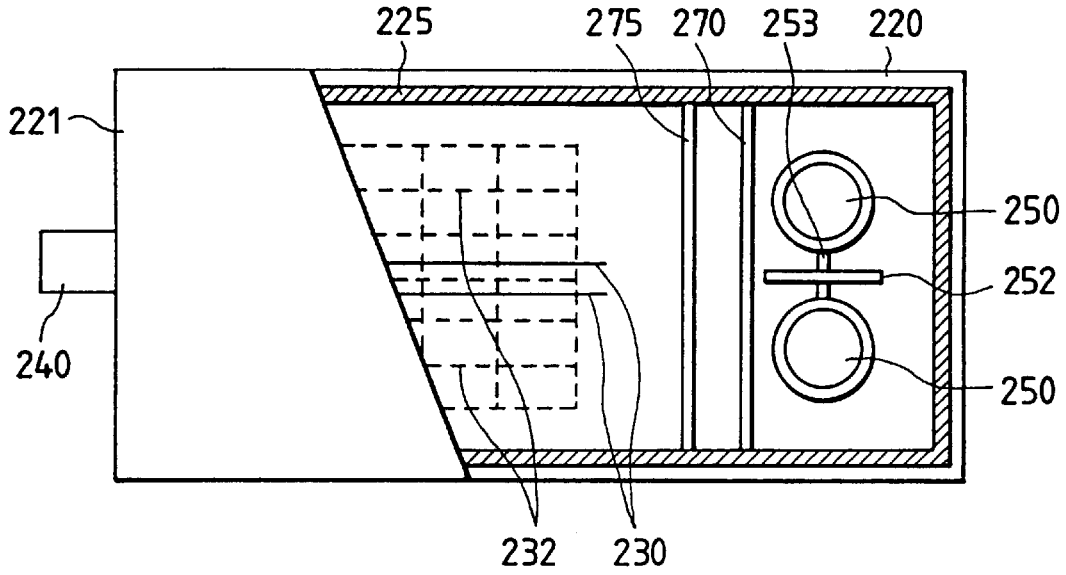
FIGS. 25A and 25B are drawings illustrating a twelfth embodiment of the image display apparatus according to the present invention, FIG. 25A being a plan view, and FIG. 25B a cross-section view.
Figure 25B:
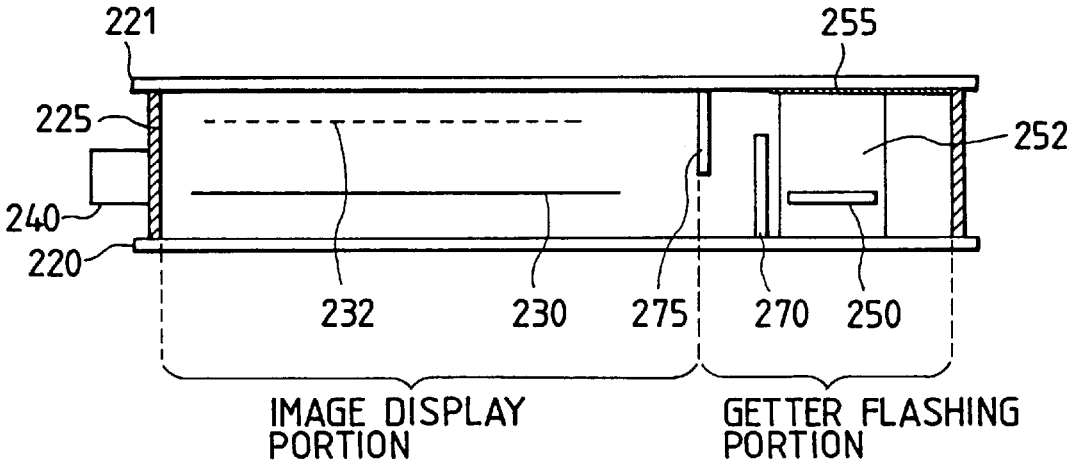

FIGS. 25A and 25B are drawings illustrating a twelfth embodiment of the image display apparatus according to the present invention, FIG. 25A being a plan view, and FIG. 25B a cross-section view.

As shown in FIGS. 25A and 25B, the present embodiment is comprised of a face plate 221 formed of an insulating material such as glass and serving as an image display portion, a rear plate 220 formed of an insulating material such as glass and situated so as to oppose the face plate 221, and an outer frame 225 10 mm in width for supporting the structure against the external pressure. The areas where the face plate 221 and outer frame 225 are connected, as well as the areas where the rear plate 220 and outer frame 225 are connected, are bonded by means of glass with a low melting point, or the like. The spacing between the face plate 221 and the rear plate 220 was set at 10 mm.

Also, within the envelope, bonded to the face plate 221 and rear plate 220 in a generally vertical direction by means of glass with a low melting point or the like is a getter holding jig 252. Bonded to the getter holding jig 252 are getter holding rods 253, and bonded to the ends of the getter holding rods 253 is getter 250, the main component thereof being Ba (barium). Further, getter scattering prevention walls 270 and 275 form a getter scattering prevention, with the getter scattering prevention wall 275 and getter scattering prevention wall 270 being respectively bonded to the face plate 221 and rear plate 220 so that the position of bonding is parallel each one to another. The getter scattering prevention walls 270 and 275 are situated in a generally vertical direction to the face plate 221 and rear plate 220, thus preventing getter material from passing over from the getter 250 to the image display portion.

Now, the getter scattering prevention walls 270 and 275 are formed at a thickness of 0.3 mm, and situated so that the closest distance between the getter scattering prevention walls 270 and 275 is 3 mm, and so that the closest distance between the getter scattering prevention wall 270 and the face plate 221 is 3 mm as well, and the closest distance between the getter scattering prevention wall 275 and the rear plate 220 is 4 mm. The getter holding rods 253 are provided in order to prevent the getter holding jig 252 from being damaged due to the heat generated when the getter 250 is flashed.

Further, on the other side of the getter scattering prevention walls 270 and 275 from the side provided with getter 250, a plurality of display portions are arrayed, with each image display portion comprising an image pattern (not shown) on the face plate 221, a control grid 232 for controlling the content of the image, and a filament 230.

With the image display apparatus according to the present embodiment constructed as described above, as with that of the eleventh embodiment, no passing over of getter material to the image display portion was observed therein.

Thirteenth Embodiment

As a thirteenth embodiment, description will be made regarding making the distance between the getter scattering prevention walls, this distance being indicated in FIG. 24 as 97*b*, to be equal to or greater than the distance between getter scattering prevention wall closer to the getter and the surface opposite to the surface to which the getter scattering prevention wall is bonded, this distance being indicated in FIG. 24 as 97*a*, but equal to or closer than the distance between the face plate and the rear plate, this distance being indicated in FIG. 24 as 92*d*.

Figure 26A:
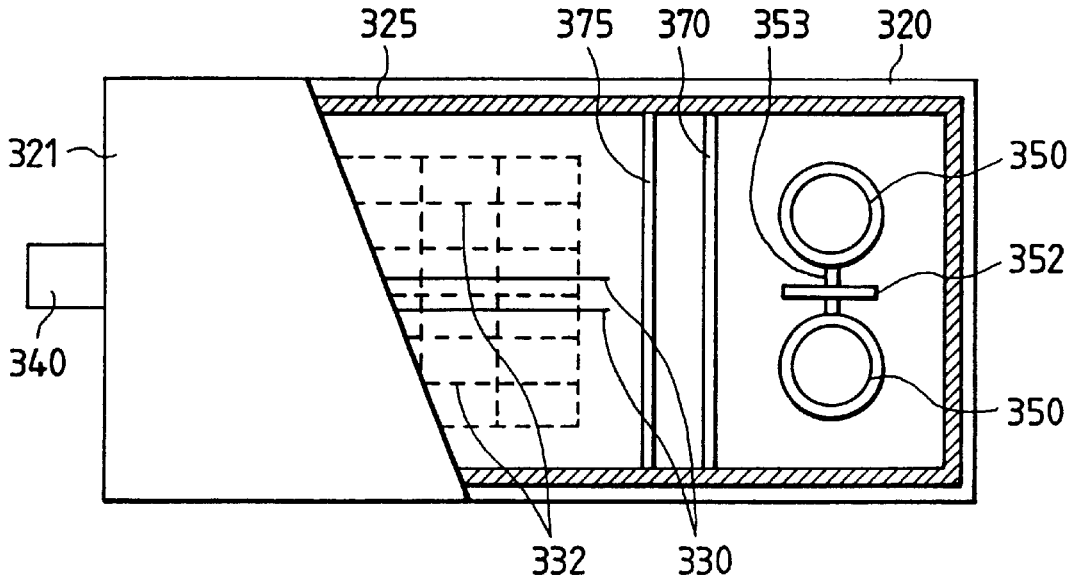
FIGS. 26A and 26B are drawings illustrating a thirteenth embodiment of the image display apparatus according to the present invention, FIG. 26A being a plan view, and FIG. 26B a cross-section view.
Figure 26B:
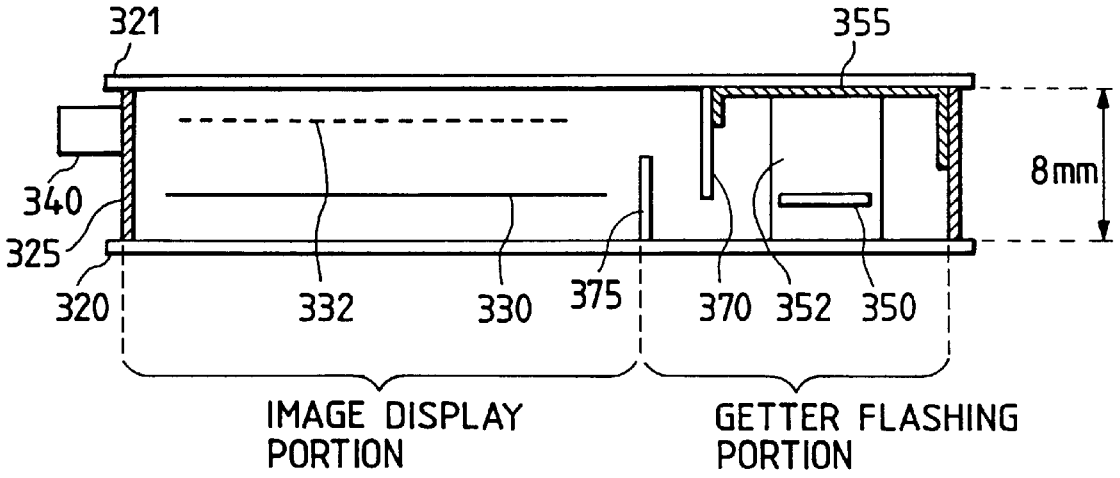

FIGS. 26A and 26B are drawings illustrating a thirteenth embodiment of the image display apparatus according to the present invention, FIG. 26A being a plan view, and FIG. 26B a cross-section view.

As shown in FIGS. 26A and 26B, the present embodiment is comprised of a face plate 321 formed of an insulating material such as glass and serving as an image display portion, a rear plate 320 formed of an insulating material such as glass and situated so as to oppose the face plate 321, and an outer frame 325 10 mm in width for supporting the structure against the external pressure. The areas where the face plate 321 and outer frame 325 are connected, as well as the areas where the rear plate 320 and outer frame 325 are connected, are bonded by means of glass with a low melting point, or the like. The spacing between the face plate 321 and the rear plate 320 was set at 8 mm.

Also, within the envelope, bonded to the face plate 321 and rear plate 320 in a generally vertical direction by means of glass with a low melting point or the like is a getter holding jig 352. Bonded to the getter holding jig 352 are getter holding rods 353, and bonded to the ends of the getter holding rods 353 is getter 350, the main component thereof being Ba (barium). Further, getter scattering prevention wall 375 and getter scattering prevention wall 370 are respectively bonded to the face plate 321 and rear plate 320 so that the position of fixing is parallel each one to another. The getter scattering prevention walls 370 and 375 are situated in a generally vertical direction to the face plate 321 and rear plate 320, thus preventing getter material from passing over from the getter 350 to the image display portion.

Now, the getter scattering prevention walls 370 and 375 are formed at a thickness of 0.2 mm, and situated so that the closest distance between the getter scattering prevention walls 370 and 375 is 5 mm, and so that the closest distance between the getter scattering prevention wall 370 and the rear plate 320 is 3 mm, and the closest distance between the getter scattering prevention wall 375 and the face plate 321 is 4 mm. The getter holding rods 353 are provided in order to prevent the getter holding jig 352 from being damaged due to the heat generated when the getter 350 is flashed.

Further, on the other side of the getter scattering prevention walls 370 and 375 from the side provided with getter 350, a plurality of display units are arrayed, with each display unit comprising an image pattern (not shown) on the face plate 321, a control grid 232 for controlling the content of the image, and a filament 330.

Now, the conductance at the getter scattering preventive member where the getter scattering preventive walls have been provided is greatly effected by the distance between the getter scattering prevention wall 370 and the getter scattering prevention wall 375. The conductance during evacuation following getter flashing is greatly effected by the distance between the getter scattering prevention wall 370 which is closer to the getter adhesion surface 355 and the rear plate 320, with evacuation efficiency increasing with increased spacing. Accordingly, it is necessary to provide a great distance between the getter scattering prevention wall 370 and the getter scattering prevention wall 375 in order to allow gas to flow smoothly from the side provided with getter 350 through the portion provided with the getter scattering prevention walls when conducting evacuation by means of the evacuation tube 340. However, there are no increased effects when this distance exceeds the distance between the rear plate 320 and the face plate 321; the size of the image display apparatus proper is only increased.

Regarding FIG. 24, with consideration to the size of the image display apparatus and evacuation effectiveness, it is preferable to set the distance 92*b* so as to be equal to or closer than the distance between the face plate and the rear plate of the image display apparatus.

With the image display apparatus according to the present embodiment constructed as described above, it was found that the time required to evacuate this image display apparatus via the evacuation tube could be shortened, and an image display apparatus with excellent vacuum effectiveness and degree of vacuum was thus provided.

Fourteenth Embodiment

As a fourteenth embodiment, description will be made regarding making the angle between the getter scattering prevention wall and the surface to which the getter scattering prevention wall is bonded to be equal or greater than 30° to less than 90°.

Figure 27A:
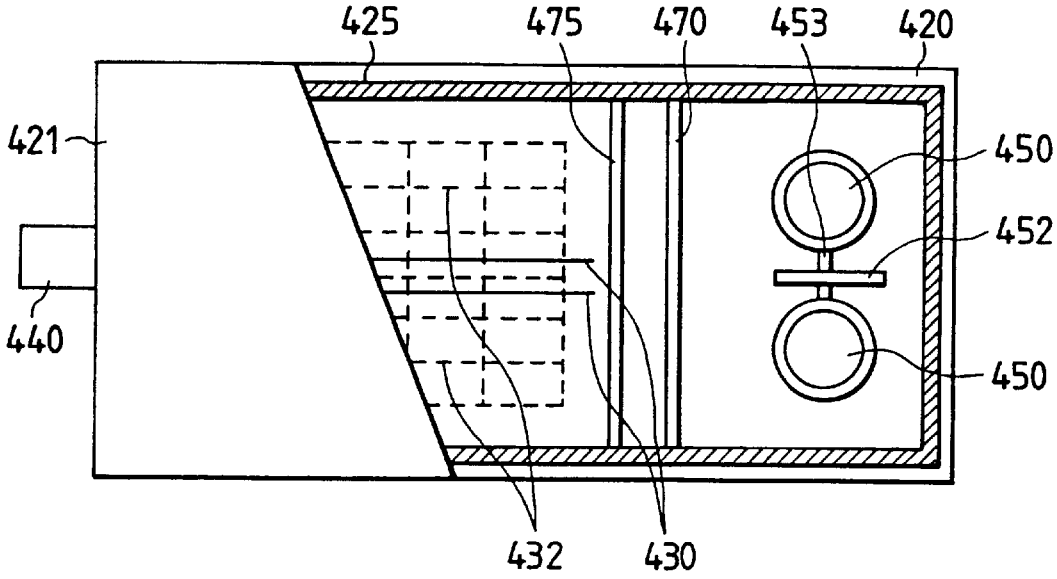
FIGS. 27A and 27B are drawings illustrating a fourteenth embodiment of the image display apparatus according to the present invention, FIG. 27A being a plan view, and FIG. 27B a cross-section view.
Figure 27B:
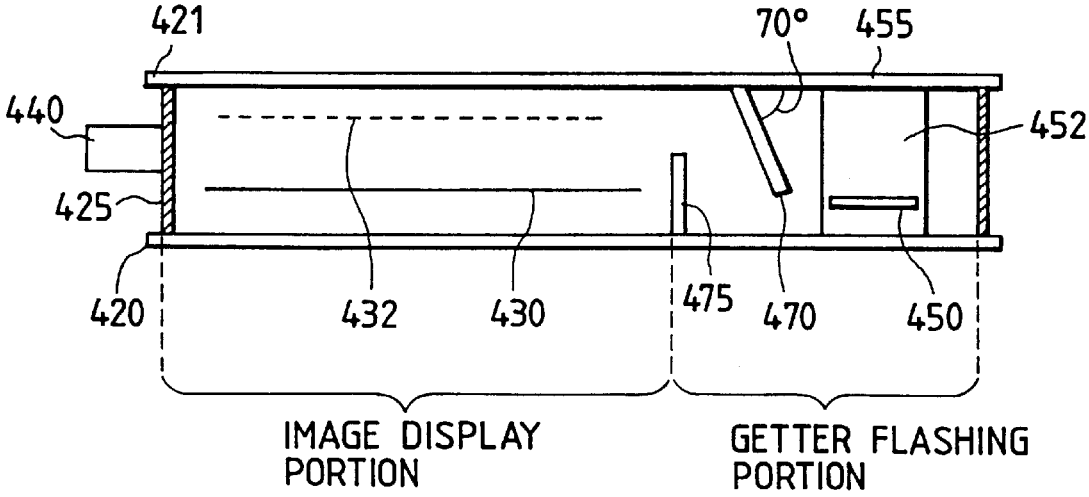

FIGS. 27A and 27B are drawings illustrating a fourteenth embodiment of the image display apparatus according to the present invention, FIG. 27A being a plan view, and FIG. 27B a cross-section view.

As shown in FIGS. 27A and 27B, the present embodiment is comprised of a face plate 421 formed of an insulating material such as soda-lime glass and serving as an image display portion, a rear plate 420 formed of an insulating material such as glass and situated so as to oppose the face plate 421, and an outer frame 425 10 mm in width for supporting the structure against the external pressure. The areas where the face plate 421 and outer frame 425 are connected, as well as the areas where the rear plate 420 and outer frame 425 are connected, are bonded by means of glass with a low melting point, or the like. The spacing between the face plate 421 and the rear plate 420 was set at 9 mm.

Also, within the envelope, bonded to the face plate 421 and rear plate 420 in a generally vertical direction by means of glass with a low melting point or the like is a getter holding jig 452. Bonded to the getter holding jig 452 are getter holding rods 453, and bonded to the ends of the getter holding rods 453 is getter 450, the main component thereof being Ba (barium). Further, getter scattering prevention wall 475 and getter scattering prevention wall 470 are respectively bonded to the face plate 421 and rear plate 420 so that the position of bonding is parallel each one to another. The getter scattering prevention wall 475 is situated in a generally vertical direction to the rear plate 420, and the getter scattering prevention wall 470 is situated at an angle 70° to the face plate 421, thus preventing getter material from passing over from the getter 450 to the image display portion.

Now, the getter scattering prevention walls 470 and 475 are formed at a thickness of 0.5 mm, and situated so that the closest distance between the getter scattering prevention walls 470 and 475 is 5 mm, and so that the closest distance between the getter scattering prevention wall 470 and the rear plate 420 is 3 mm, and the closest distance between the getter scattering prevention wall 475 and the face plate 421 is 4 mm. The getter scattering prevention wall 470 is situated at a 70° angle to the face plate 421. The getter holding rods 453 are provided in order to prevent the getter holding jig 452 from being damaged due to the heat generated when the getter 450 is flashed.

Further, on the other side of the getter scattering prevention walls 470 and 475 from the side provided with getter 450, a plurality of display units are arrayed, with each display unit comprising an image pattern (not shown) on the face plate 421, a control grid 432 for controlling the content of the image, and a filament 430.

Now, description will be made regarding the angle of the getter scattering prevention walls to the rear plate, with reference to FIG. 24.

It has been confirmed that in an image display apparatus, the angles 97$\phi$ and 97$\theta$ formed between the getter scattering prevention walls 970 and 975 and the rear plate are effective within the range of 30° to 150°.

Particularly, with consideration to prevention of scattering of getter material to the image display portion, the area of the getter adhesion surface 955, and conductance of evacuation of the container, it has been found to be effective when the getter scattering prevention wall 970 which neighbors the getter is provided to the surface which opposes the getter adhesion surface 955, i.e., the rear plate 920, and when the angle 97$\phi$ formed between the getter adhesion surface 955 and the getter scattering prevention wall 975 which neighbors the getter adhesion surface 955 is 30° or greater but less than 90°.

Accordingly, determining of the spacing of the getter scattering prevention walls when positioning in a parallel manner should be conducted after calculating the percentage of the image display apparatus that the getter scattering prevention walls will comprise, the closest distance between the getter scattering prevention walls, and the angle of the getter scattering prevention walls to the surface to which the getter scattering prevention walls are situated.

With the image display apparatus constructed as described above, it was found that the time required to evacuate this image display apparatus via the evacuation tube could be shortened, and achievement of a high degree of vacuum was observed.

Fifteenth Embodiment

Figure 30A:
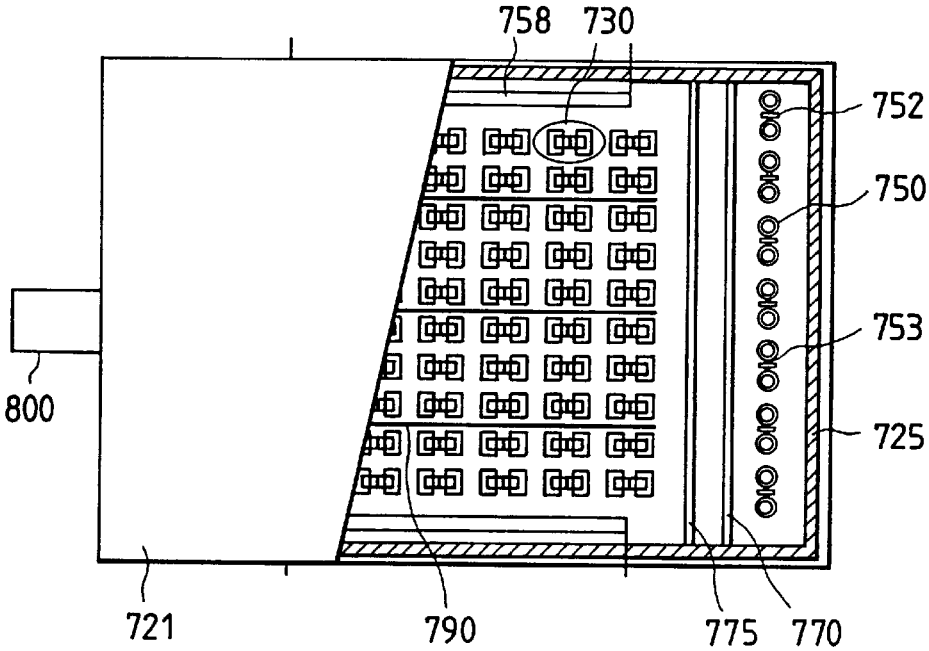
FIGS. 30A, 30B and 30C are drawings illustrating a fifteenth embodiment of the image display apparatus according to the present invention, FIG. 30A being a plan view, FIG. 30B a cross-section view, and FIG. 30C a close-up of the getter scattering prevention member.
Figure 30B:
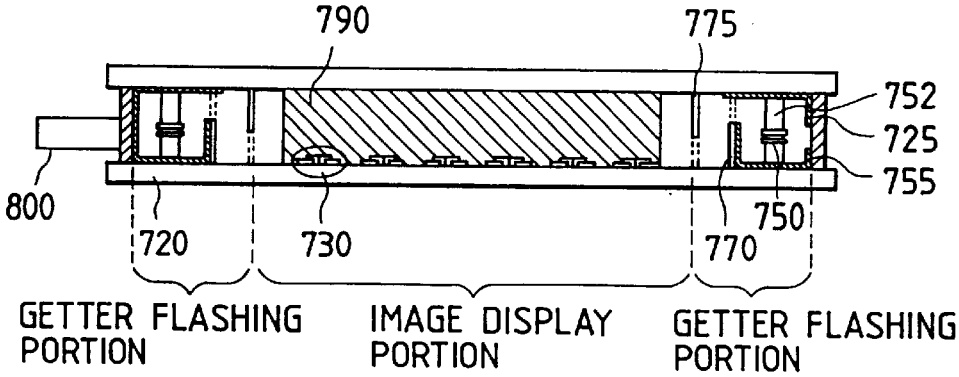
Figure 30C:
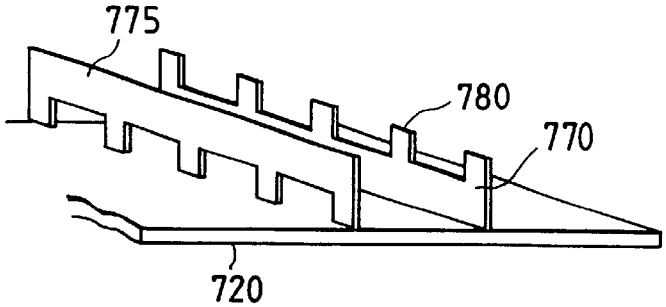

A fifteenth embodiment will be used for description of using surface-conductive electron-emitting devices as an electron source, as with the tenth embodiment. FIGS. 30A, 30B and 30C are drawings illustrating a fifteenth embodiment of the image display apparatus according to the present invention, FIG. 30A being a plan view, FIG. 30B a cross-section view, and FIG. 30C a partial perspective view of the getter scattering prevention member.

The surface-conductive electron-emitting device according to the present embodiment is the same as the surface-conductive electron-emitting device according to the tenth embodiment as shown in FIGS. 28, 29A and 29B, except for some alterations, these being the following:

A double flashing structure was employed, with getter flashing portions comprised of a getter scattering prevention member and evaporation type getter being provided on both sides of the image display portion. The getter 750 was arranged so that the getter adhesion surface 755 was situated on both the face plate 721 and the rear plate 720, spacers 790 were provided to the image display portion as atmospheric pressure resistant members, and non-evaporation getter was provided facing the image display portion and above and below the group of surface-conductive electron-emitting devices, as shown in FIG. 30A. Otherwise, the arrangement is the same as with the tenth embodiment.

The method of formation of the surface-conductive electron-emitting devices and the method of assembly of the image display apparatus will be omitted, due to being the same as with the description made with the tenth embodiment. Also, the aforementioned spacers are provided with high-resistance film so that the surfaces thereof are not charged up by means of some of the electrons emitted by the devices colliding with them. These spacers are positioned so that the longitudinal direction thereof is parallel with the evacuation tube 800, so that the placement of the spacers dies not have an adverse effect on evacuation by means of the getter and evacuation by means of the evacuation tube 800. Further, while only three spacers 790 are used in FIG. 30A, the number, positioning, form, material, etc., of the spacers should be determined appropriately in accordance with the thickness of the face plate 721 and the rear plate 720, the formation in which the surface-conductive electron-emitting devices are arrayed, etc.

As with the tenth embodiment, the image display apparatus according to the present embodiment is comprised of: a rear plate 720 upon which are arrayed a great number of surface-conductive electron-emitting devices arrayed in a matrix form; a face plate 721 upon which is arrayed red, blue, and green fluorescent material (not shown) in accordance with each of the surface-conductive electron-emitting devices, and metal back (not shown) formed thereupon; an outer frame 725; and spacers 790 serving as atmospheric pressure resistant members.

Getter scattering prevention walls 770 and 775 are formed within the vacuum container (envelope) as shown in FIG. 30C, thereby preventing getter material from passing to the display portion when the evaporation type-getter 750 is flashed. The getter used in the present embodiment is ring-type getter comprised of a Ba—Al alloy. In order to allow for getter adhesion surface 755 to be formed by means of flashing getter material on both the face plate 721 side and rear plate 720 side, the getter was formed with two pieces one upon another as one set, one piece having an opening facing the face plate and the other piece having an opening facing the rear plate. A total of 28 such pieces were distributed on both sides. The diameter of the getter 750 was 3 mm.

Further, with the image display apparatus according to the present embodiment, non-evaporation type getter 758 (St 101 manufactured by SAES Inc.) formed of an Zr—Al alloy was provided above and below the image display portion, in addition to the aforementioned evaporation type getter 750.

The getter scattering prevention walls 770 and 775 comprising the getter scattering prevention member used in the image display apparatus according to the present embodiment include the supporting member 780 as a getter scattering prevention wall according to the tenth embodiment, thus being formed by means of bonding to the face plate 721 and the rear plate 720, respectively. This is in order to prevent the getter scattering prevention walls from coming loose from the face plate or rear plate due to some shock in the even that the bonding of the getter scattering prevention walls described in the tenth embodiment is not sufficient. Moreover, according to this arrangement, the getter scattering prevention walls serve as assisting atmospheric pressure resistant members, in addition to the outer frame and the spacers 790. By means of such an arrangement, the face plate 721 and rear plate 720 can be made thinner than that of the tenth embodiment, consequently lightening the image display apparatus as a whole.

With the image display apparatus according to the present embodiment, the getter 750 is situated so that a getter adhesion surface 725 is formed on both the face plate 721 side and rear plate 720 side, and further, getter flashing portions have been provided on both the right and left side of the image display apparatus. As a result, when the image display apparatus according to the present embodiment is compared with the image display apparatus according to the tenth embodiment, the amount of adhesion of getter is increased four times, according to simplest calculation. Further, non-evaporation type getter 758 which has excellent hydrogen adhesion (evacuation) properties has been provided to the image display apparatus according to the present embodiment, so that following sealing of the evacuation tube (not shown), a high degree of vacuum could be maintained for a longer time than that of the tenth embodiment, and accordingly, excellent image display was obtained wherein the image display was uniform and free of irregularities in brightness for a long time.

Figure 20B:
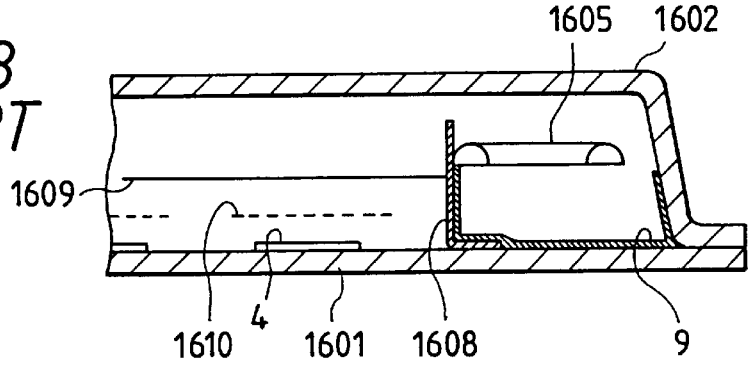
FIG. 20B PRIOR ART

Incidentally, while the vacuum container (envelope) described in the present embodiment is comprised of a face plate 721, rear plate 720, and an outer frame 725, it is needless to say that the present invention may be applied to an image display apparatus comprising a vacuum container of a structure wherein the rear plate and outer frame described in the present embodiment (or the face plate and outer frame thereof) are formed integrally, such as that of Japanese Patent Publication No. 56-44534 described regarding the known art (refer to FIGS. 20A and 20B).

Figure 36:
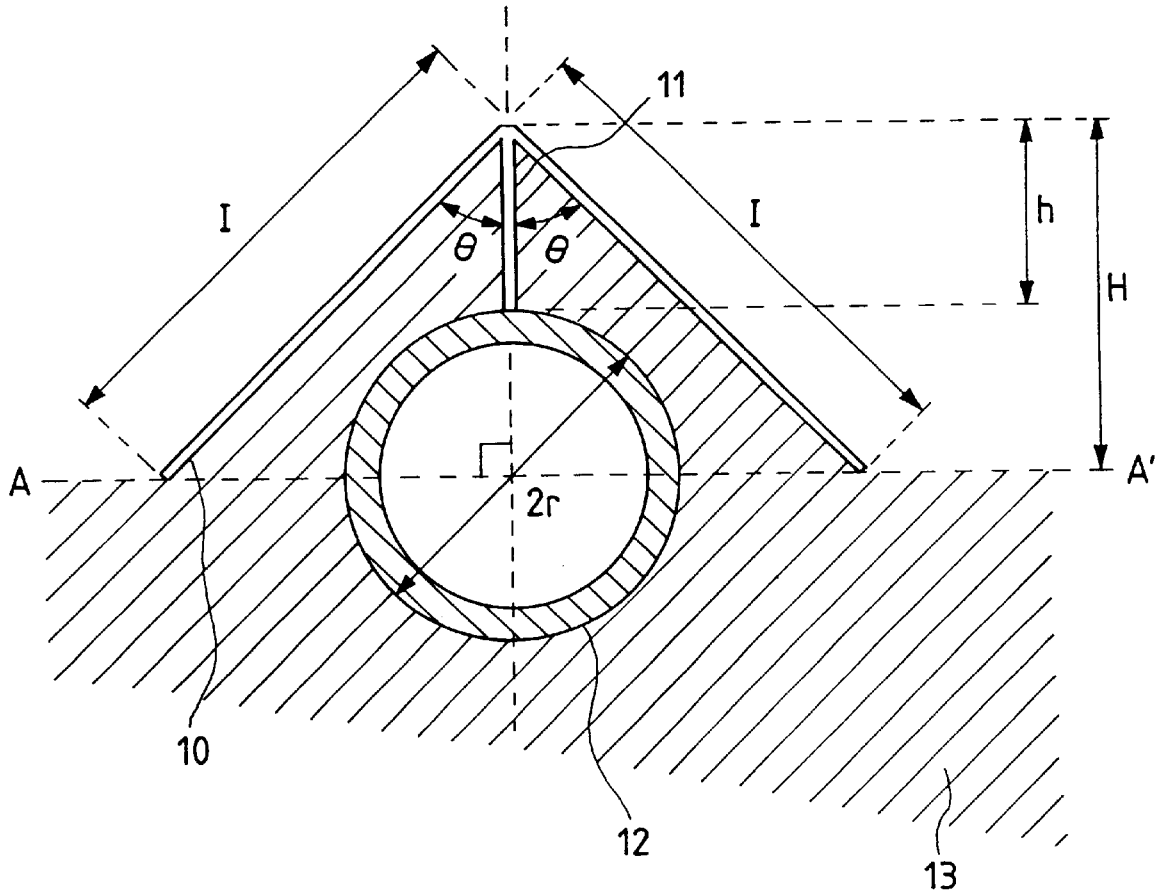
FIG. 36 is an explanatory diagram of the third getter scattering prevention member according to the present invention.

The third getter scattering prevention member according to the present invention involves the getter holding jig itself serving as a getter scattering prevention wall. This structure provides one holding jig per getter so that getter does not scatter to the image display portion when the getter is flashed. FIG. 36 is an explanatory diagram of the third getter scattering prevention member according to the present invention.

The third getter scattering prevention member according to the present invention is comprised of getter 12 (2r in diameter) being bonded to a getter holding jig 10 via a getter holding rod 11 (h in length), with the getter holding jig 10 (getter scattering prevention wall) being bent at the portion where the getter holding rod 11 is bonded, thus having a certain opening angle θ.

Here, for the sake of simplification of explanation, it will be assumed that the opening angles θ of the apex of the V-shaped getter holding jig 10 (getter scattering prevention wall) are equal with the getter holding rod 11 as an axis, and the length of the sides thereof are also the same length "1" with the getter holding rod 11 as an axis. Although the getter holding jig 10 here has been made to be V-shaped, an arc-shaped getter holding jig such as shown in FIG. 8A may be applied, as well.

The distance H from the center of the getter to the apex of the getter holding jig 10 (getter scattering prevention wall) can be expressed as h+r.

The conditions required of the third getter scattering prevention member according to the present invention are to simultaneously satisfy the following expressions:

$$1 \cos \theta > H \qquad \text{Expression 1}$$

$$H \sin \theta \geqq r \qquad \text{Expression 2}$$

Accordingly, the area 13 where getter scatters upon conducting of getter flashing does not extend beyond the area surrounded by the getter holding jig 10. Consequently, by means of making the upper area shown in FIG. 36 to be the image display portion, passing of getter to the image display portion can be avoided even if getter flashing is conducted within the image display apparatus.

Also, description of the third getter scattering prevention member according to the present invention was made above to the effect that the getter holding jig itself serves as a getter scattering prevention wall. However, the getter holding jig and the getter scattering prevention wall may be separate entities, so long as the relation between the getter and the getter scattering prevention wall satisfy both Expression 1 and Expression 2 simultaneously.

An image display apparatus employing the above-described third getter scattering prevention member according to the present invention will now be described in the sixteenth through nineteenth embodiments.

Sixteenth Embodiment

Figure 31A:
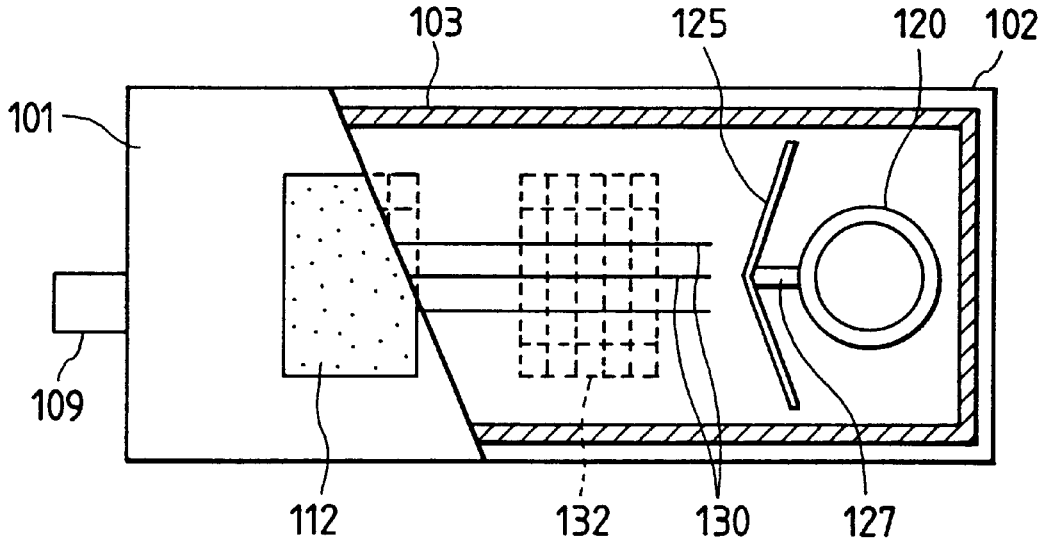
FIGS. 31A and 31B are drawings illustrating a sixteenth embodiment of the image display apparatus according to the present invention, FIG. 31A being a plan view, and FIG. 31B a cross-section view.
Figure 31B:
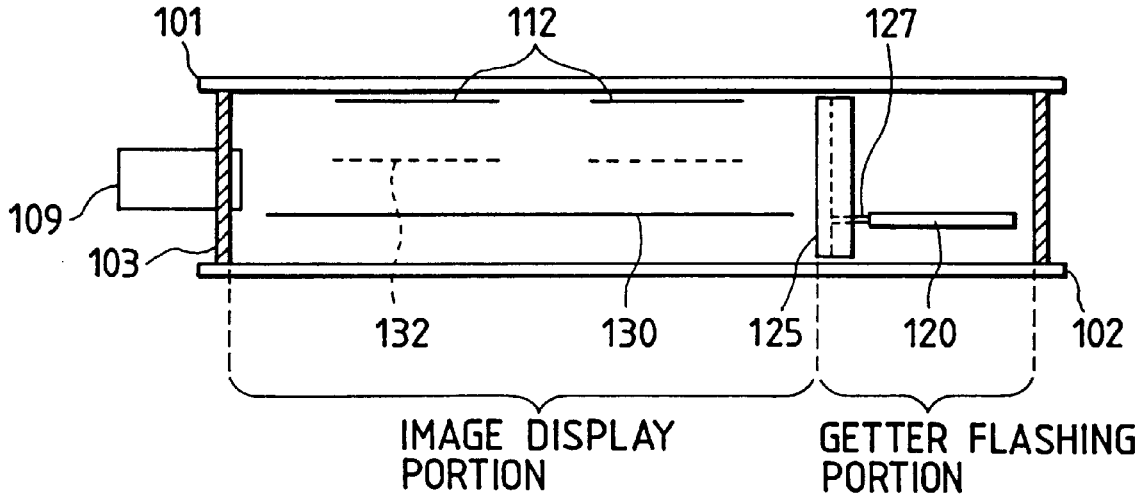

FIGS. 31A and 31B are drawings illustrating a sixteenth embodiment of the image display apparatus according to the present invention, FIG. 31A being a plan view, and FIG. 31B a cross-section view.

As shown in FIGS. 31A and 31B, the present embodiment is comprised of a face plate 101 formed of an insulating material such as glass and serving as an image display portion, a rear plate 102 formed of an insulating material such as glass and situated so as to oppose the face plate 101, and an outer frame 103 10 mm in width for supporting the structure against the external pressure. The areas where the face plate 101 and outer frame 103 are connected, as well as the areas where the rear plate 102 and outer frame 103 are connected, are bonded by means of glass with a low melting point.

Also, within the envelope, bonded to the face plate 101 and rear plate 102 in a generally vertical direction by means of glass with a low melting point or the like is a getter holding jig 125. Bonded to one side of the getter holding jig 125 is a getter holding rod 127, and bonded to the end of the getter holding rod 127 is getter 120, the main component thereof being Ba (barium), and the piece of getter being 7 mm in diameter. The getter holding jig 125 comprising the getter scattering prevention member is formed of glass 0.3 mm in thickness, is opened at an angle of approximately 1500 toward the side to which the getter holding rod 127 is bonded, with the point at which the getter holding rod 127 is bonded, i.e., the apex, being the center of the opening angle, and is a V-shape with the length of each side being the diameter of the getter 120. The getter holding rod 127 is provided generally upon a bisector of the angle formed by the getter holding jig 125, in order to prevent the getter holding jig 125 from being damaged due to the heat generated when the getter 120 is flashed. Further, on the other side of the getter holding jig 125 provided with the getter 120, i.e., the side of the image display portion, a plurality of display units are arrayed, with each display unit comprising an image pattern 112 on the face plate 101, a control grid 132 for controlling the content of the image, and a filament 130.

Next, the method of constructing the image display apparatus according to the present embodiment will now be described. Glass which melts at a low temperature is each coated at the points of connection with the face plate 101, rear plate 102, outer frame 103, and getter holding jig 125. The getter holding jig 125 and outer frame 103 are positioned by means of a positioning jig, following which the glass which melts at a low temperature is baked, thus bonded the respective members.

While conducting evacuation of the gas in the envelope by means of the evacuation tube 109, the getter 120 is baked by means of electrical induction heating.

After all of the members have been bonded, the gas within the envelope is evacuated from the evacuation tube 109, and the evacuation tube 109 is sealed at the point the interior of the envelope reaches a degree of vacuum approximating $1\times10^{-7}$ Torr.

After sealing off the evacuation tube 109, the getter 120 is flashed by means of electrical induction heating or the like, thus completing the image display apparatus.

After completion of the image display apparatus, heating the filament 130 causes emitting electrons, to be accelerated by means of an anode 132 (not shown) comprising an image pattern, and strike the fluorescent material comprising the image pattern 112. Consequently, an image is displayed on the face plate 101.

Regarding the spacing between the face plate 101 and rear plate 102, a distance of 10 mm was set for the present embodiment, but the present invention is not limited to this arrangement, as long as this spacing is sufficient to cause excitation of the fluorescent material by means of the electrons emitted from the fluorescence excitation source filament 130, thereby forming an image. Also, the present invention is not particularly limited to any fluorescent material for displaying an image.

Although Ba (barium) was used for getter in the image display apparatus according to the present embodiment, the present invention is not particularly limited to any type of getter so long as it is of the evaporation type, without being dependent on the type of getter material. Also, there are several methods of getter flashing, such as conductive heating, electrical induction heating, and the like, but the present invention is not particularly limited to any of these methods.

Further, although glass with a low melting point was employed as material for bonding the face plate, rear plate, outer frame, and getter holding jig for the image display apparatus according to the present invention, the glass with a low melting point being provided to the contact points thereof, supersonic soldering, or resin which hardens in the presence of ultraviolet rays may be used instead. The present invention is not particularly limited to any of these, so long as sealing and bonding can be conducted while maintaining vacuum tightness.

Further, the length of both sides of the V-shaped getter holding jig 125 and the angle formed thereby, i.e., the opening angle at the apex, effect the directionality of the getter being flashed. The degree of getter material passing around to the image display member thus is decreased, and making the angle to be narrower increases the directionality thereof.

Seventeenth Embodiment

Figure 32A:
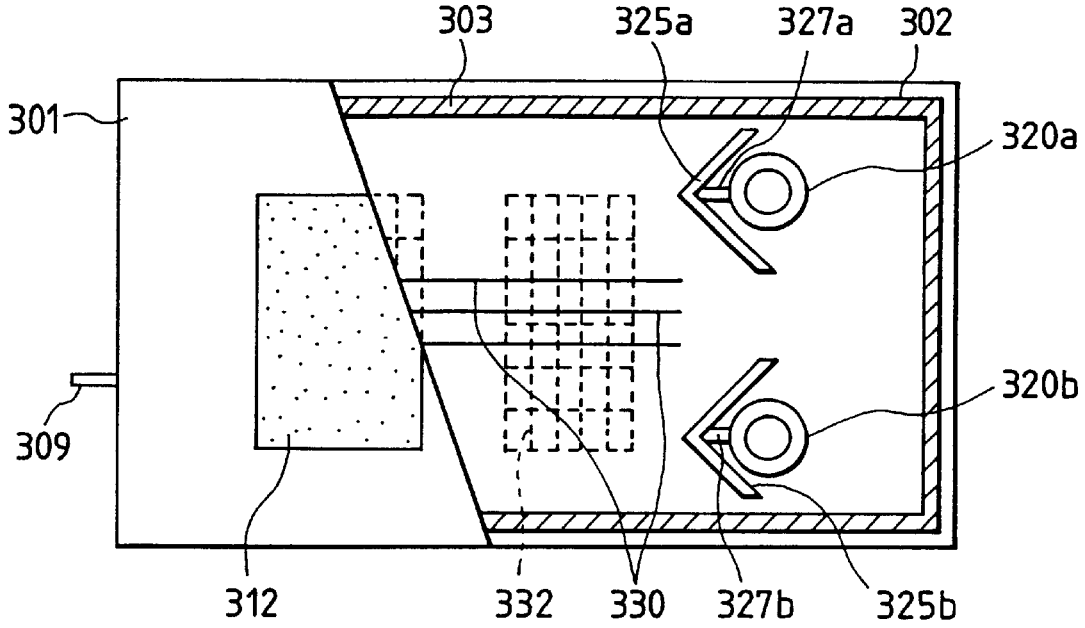
FIGS. 32A and 32B are drawings illustrating a seventeenth embodiment of the image display apparatus according to the present invention, FIG. 32A being a plan view, and FIG. 32B a cross-section view.
Figure 32B:
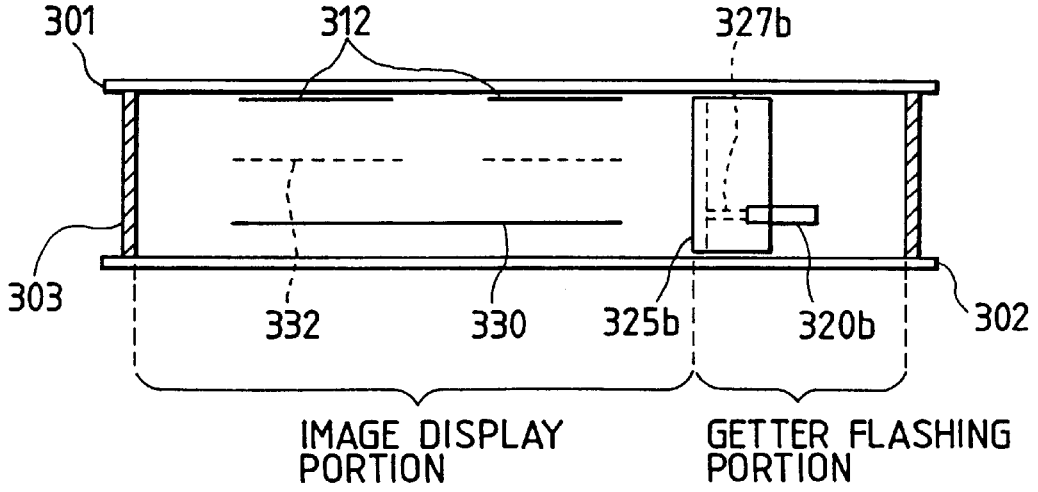

FIGS. 32A and 32B are drawings illustrating a seventeenth embodiment of the image display apparatus according to the present invention, FIG. 32A being a plan view, and FIG. 32B a cross-section view.

As shown in FIGS. 32A and 32B, the present embodiment is comprised of a face plate 301 formed of an insulating material such as glass and serving as an image display portion, a rear plate 302 formed of an insulating material such as glass and situated so as to oppose the face plate 301, and an outer frame 303 10 mm in width for supporting the structure against the external pressure. The areas where the face plate 301 and outer frame 303 are connected, as well as the areas where the rear plate 302 and outer frame 303 are connected, are bonded by means of glass with a low melting point.

Also, within the envelope, bonded to the face plate 301 and rear plate 302 in a generally vertical direction by means of glass with a low melting point or the like are getter holding jigs 325*a* and 325*b*. Bonded to one side of the getter holding jigs 325*a* and 325*b* comprising the getter scattering prevention member are getter holding rods 327*a* and 327*b*, and bonded to the end of the getter holding rods 327*a* and 327*b* are getters 320*a* and 320*b*, the main components thereof being Ba (barium), Al (aluminum), and Ni (nickel), the pieces of getter being 5 mm in diameter. The getter holding jigs 325*a* and 325*b* comprising the getter scattering prevention member are formed of glass 0.3 mm in thickness, are V-shapes opened at an angle of approximately 90° toward the side to which the getter holding rods 327*a* and 327*b* are bonded, the point at which the getter holding rods 327*a* and 327*b* are each bonded, i.e., the respective apexes, being the centers of the opening angles. The shortest distance between the getter holding jigs 325*a* and 325*b* is set at around ½ of the length of one side of the triangle formed by the V-shaped getter holding jigs 325*a* and 325*b* on the side to which the getter holding rods 327*a* and 327*b* are bonded. The getter holding rods 327*a* and 327*b* are provided generally upon a bisector of the angle formed by the getter holding jigs 325*a* and 325*b*, in order to prevent the getter holding jigs 325*a* and 325*b* from being damaged due to the heat generated when the getter 320*a* and 320*b* are flashed. Further, on the other side of the getter holding jigs 325*a* and 325*b* provided with the getter 320*a* and 320*b*, i.e., the side of the image display portion, a plurality of display portions are arrayed, with each display portion comprising an image pattern 312, a control grid 332 for controlling the content of the image, and a filament 330.

It is most preferable that the angles each formed by the getter holding jigs 325*a* and 325*b*, i.e., the opening angles at the apexes, be 90°, from consideration of preventing scattering of the getter 320*a* and 320*b*, positioning of the getter 320*a* and 320*b* and the getter holding jigs 325*a* and 325*b*, and evacuation by means of the getter holding jigs 325*a* and 325*b*.

Further, in the present embodiment, the getter employed was 5 mm in diameter, and had as the main components thereof Ba (barium), Al (aluminum), and Ni (nickel), but the present embodiment is not limited to these.

With the image display apparatus according to the present embodiment constructed as described above, as compared to a plurality of getter materials being provided to a known image display apparatus, it was found that this image display apparatus could be evacuated in a shorter time via the evacuation tube, no non-uniformity of pressure distribution within the image display apparatus occurred, a high degree of vacuum could be attained within the image display apparatus, and thus the life expectancy of the image display apparatus was extended markedly.

Eighteenth Embodiment

Figure 33:
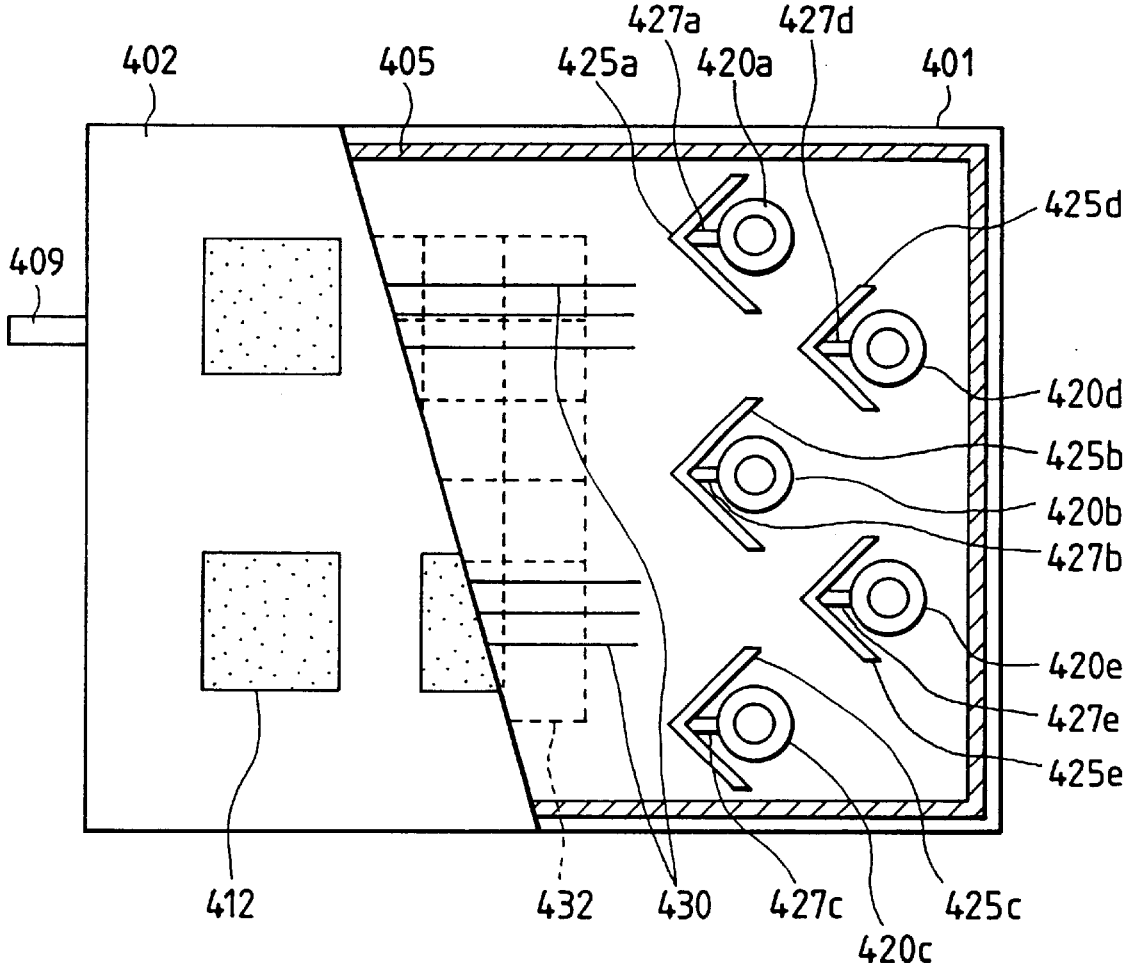
FIG. 33 is a drawing illustrating an eighteenth embodiment of the image display apparatus according to the present invention.

As an eighteenth embodiment, description will be made regarding providing five pieces of getter and five getter holding jigs within the image display apparatus in a zigzag formation. FIG. 33 is a drawing illustrating an eighteenth embodiment of the image display apparatus according to the present invention.

As shown in FIG. 33, the present embodiment is comprised of a face plate 402 formed of an insulating material such as glass and serving as an image display portion, a rear plate 401 formed of an insulating material such as glass and situated so as to oppose the face plate 402, and an outer frame 405 10 mm in width for supporting the structure against the external pressure. The areas where the face plate 402 and outer frame 405 are connected, as well as the areas where the rear plate 401 and outer frame 405 are connected, are bonded by means of glass with a low melting point.

Also, within the envelope, bonded to the face plate 402 and rear plate 401 in a generally vertical direction and in a zigzag formation by means of glass with a low melting point or the like are getter holding jigs 425*a* through 425*e*. Bonded to one side of the getter holding jigs 425*a* through 425*e* comprising the getter scattering prevention member are getter holding rods 427*a* through 427*e*, and bonded to the end of the getter holding rods 427*a* through 427*e* are getters 420*a* through 420*e*, the main components thereof being Ba (barium), Al (aluminum), and Ni (nickel), the pieces of getter being 5 mm in diameter. The getter holding jigs 425*a* through 425*e* comprising the getter scattering prevention member are formed of glass 0.5 mm in thickness, are V-shapes opened at an angle of approximately 90° toward the side to which the getter holding rods 427*a* through 427*e* are bonded, the point at which the getter holding rods 427*a* through 427*e* are each bonded, i.e., the respective apexes, being the centers of the opening angles. The shortest distance between the getter holding jigs 425*a* through 425*e* is set at around ½ of the length of one side of the triangle formed by the V-shaped getter holding jigs 425*a* through 425*e* on the side to which the getter holding rods 427*a* through 427*e* are bonded. The getter holding rods 427*a* through 427*e* are provided generally upon a bisector of the angle formed by the getter holding jigs 425*a* through 425*e*, in order to prevent the getter holding jigs 425*a* through 425*e* from being damaged due to the heat generated when the getter 420*a* through 420*e* are flashed. Also, the length of both sides of the V-shaped getter holding jigs 425*a* through 425*e* grow shorter the farther they are from the image display portion.

Further, on the other side of the getter holding jigs 425*a* through 425*e* provided with the getter 420*a* through 420*e*, i.e., the side of the image display portion, a plurality of display units are arrayed, with each display unit comprising an image pattern 412 on the face plate 402, a control grid 432 for controlling the content of the image, and a filament 430.

Now, the getter holding jigs 425*a* through 425*e* provided with the getter 420*a* through 420*e* are situated in a zigzag manner, some closer to the image display portion and some further away, as shown in FIG. 33. With this arrangement, not gaps between the getter pieces can be observed from the image display side.

Also, in the event that a plurality of getters are to be situated, placing the getter holding jigs and getter in a zigzag manner as shown in the present embodiment is effective both regarding evacuation of the image apparatus by means of the evacuation tube and by means of getter flashing. Further, although the getter holding jigs shown in the present embodiment are V-shaped, arc-shaped getter holding jigs may be used in combination.

Moreover, the length of sides of the V-shaped getter holding jigs are made shorter the farther they are from the image display portion, so that it is even more effective regarding evacuation of the interior of the image display apparatus.

With the image display apparatus according to the present embodiment constructed as described above, as compared to a plurality of getter materials being provided to a known image display apparatus, it was found that this image display apparatus could be evacuated in a shorter time via the evacuation tube, that no non-uniformity of pressure distribution within the image display apparatus occurred, a high degree of vacuum could be attained within the image display apparatus, and thus the working life expectancy of the image display apparatus was extended markedly. Moreover, as with the above-described embodiment, no passing around of getter material to the image display portion was observed.

Nineteenth Embodiment

Figure 34:
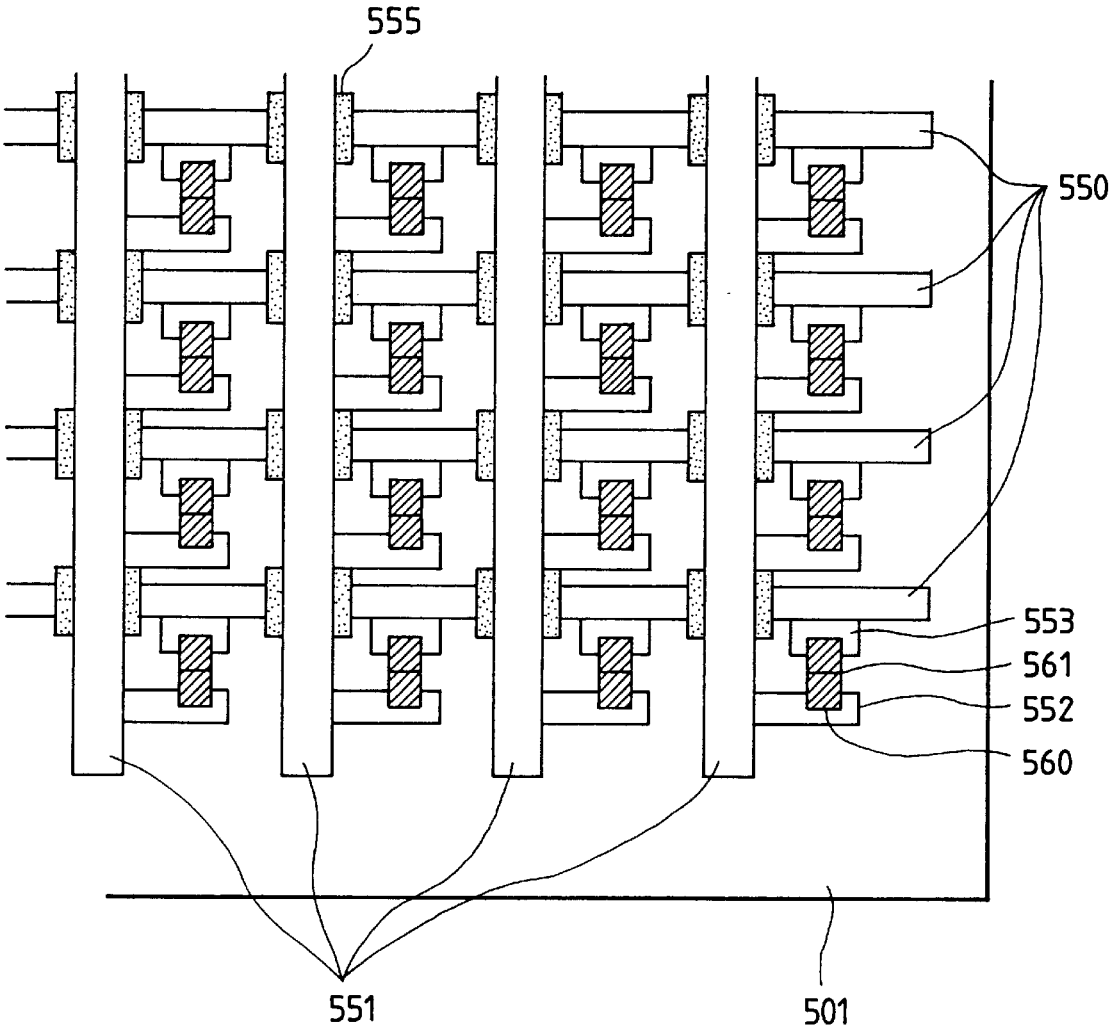
FIG. 34 is a schematic diagram of surface-conductive electron-emitting devices.

A nineteenth embodiment will be used for description of using surface-conductive electron-emitting devices as a fluorescence excitation means. FIG. 34 is a schematic diagram of a plurality of surface-conductive electron-emitting devices having been arrayed.

As shown in FIG. 34, the surface-conductive electron-emitting device according to the present embodiment is formed upon a rear plate 501 which is a substrate formed of an insulating material such as sode-lime glass or the like, and is comprised of lower wiring 550 which is connected to lead electrodes (not shown), an insulating layer 555 formed upon the lower wiring 550, upper wiring 551 which is formed upon the insulating layer 555 and is connected to lead electrodes (not shown), and device electrodes 552 and 553. Further, an external driving power source (not shown) is connected to the lead electrodes for driving the surface-conductive electron-emitting devices.

The method of forming the above-described surface-conductive electron-emitting device will now be described. Device electrodes 552 and 553 are formed on the rear plate 501 by means of vapor deposition or the like, and further, lower wiring 550 is formed upon the device electrode 553 by means of vapor deposition or the like so as to be connected to the device electrode 553. Next, an insulating layer 555 is formed upon the intersection with the upper wiring 551 on the formed lower wiring 550, by means of chemical vapor deposition or the like. Then, upper wiring 551 is formed upon the formed insulating layer 555, by means of vapor deposition or the like.

Subsequently, an electro-conductive thin film 560 formed of PdO (palladium oxide) is formed upon the device electrodes 552 and 553, and by means of electrical conductance between the upper wiring 550 and lower wiring 551, an electron-emitting portion 561 which is a high-resistance area is formed on the PdO thin film.

When voltage from an external drive power source is applied to the surface-conductive electron-emitting device formed as described above, the voltage is applied to the Pd thin film 560 via the lead electrode, upper wiring 550, lower wiring 551, and device electrodes 552 and 553, and electrons are thus emitted from the electron-emitting portion 561.

Figure 35A:
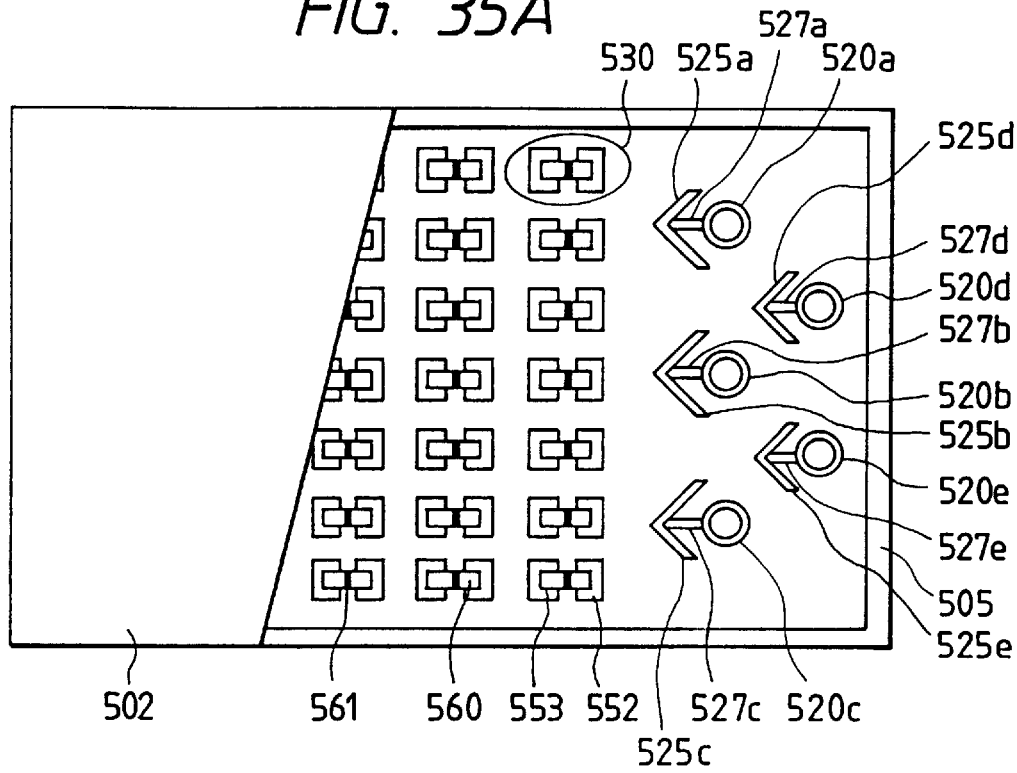
FIGS. 35A and 35B are drawings illustrating a nineteenth embodiment of the image display apparatus according to the present invention, FIG. 35A being a plan view, and FIG. 35B a cross-section view.
Figure 35B:
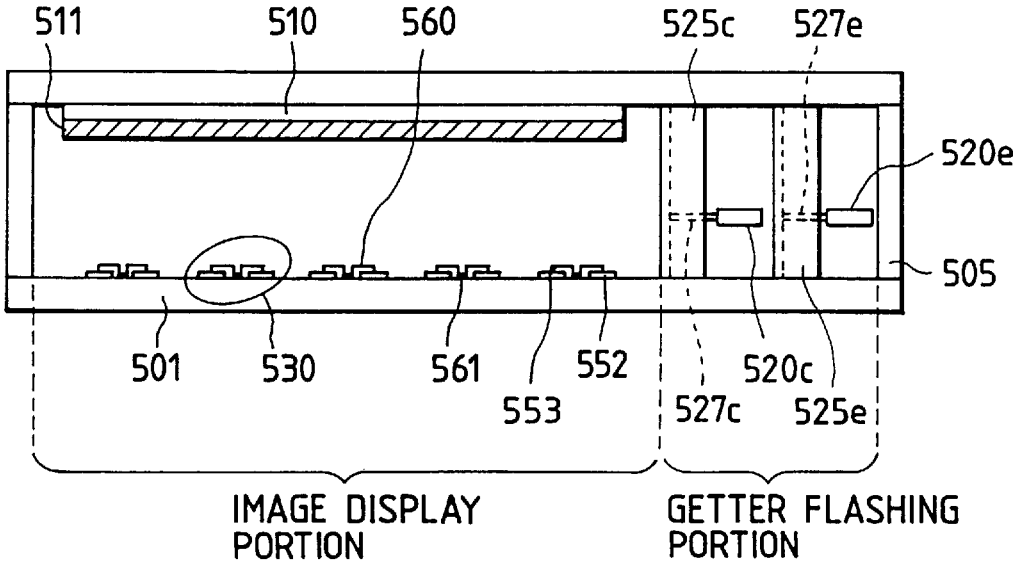

The following is a description of an image display apparatus according to the present invention employing surface-conductive electron-emitting devices such as have been described above. FIGS. 35A and 35B are drawings illustrating an image display apparatus according to the present embodiment as shown in FIG. 34, FIG. 35A being a plan view, and FIG. 35B a cross-section view.

As shown in FIGS. 35A and 35B, an envelope is formed of a rear plate 501, a face plate 502 which is formed of the same insulating material as the rear plate 501 and is formed of fluorescent material 510, and aluminum metal back 511 in that order, and an outer frame 505 which is connected with the periphery portions of both the face plate 502 and rear plate 501. This outer frame 505 is for supporting the structure against the external pressure, and is 10 mm in width. The areas where the face plate 502 and outer frame 505 are connected, as well as the areas where the rear plate 501 and outer frame 505 are connected, are bonded by means of glass with a low melting point.

Also, within the envelope, affixed to the face plate 501 and rear plate 502 in a generally vertical direction by means of glass with a low melting point or the like are getter holding jigs 525*a* through 525*e*. Bonded to one side of the getter holding jigs 525*a* through 525*e* comprising the getter scattering prevention member are getter holding rods 527*a* through 527*e*, and bonded to the end of the getter holding rods 527*a* through 527*e* are getters 520*a* through 520*e*, the main components thereof being nitrogen-doped Ba (barium), Al (aluminum), and Ni (nickel), the pieces of getter being 5 mm in diameter. The getter holding jigs 525*a* through 525*e* comprising the getter scattering prevention member are V-shapes opened at an angle of approximately 90° toward the side to which the getter holding rods 527*a* through 527*e* are bonded, with the shortest distance between the getter holding jigs 525*a* through 525*e* being set so as to be greater than the length of the side of the triangle formed by the V-shaped getter holding jigs 525*a* through 525*e* on the side to which the getter holding rods 527*a* through 527*e* are bonded. The points at which the getter holding rods 527*a* through 527*e* are each bonded, i.e., the respective apexes, are the centers of the opening angles. The getter holding rods 527*a* through 527*e* are provided generally upon a bisector of the angle formed by the getter holding jigs 525*a* through 525*e*, in order to prevent the getter holding jigs 525*a* through 525*e* from being damaged due to the heat generated when the getter 520*a* through 520*e* are flashed. Also, the length of both sides of the V-shaped getter holding jigs 525*a* through 525*e* grow shorter the farther they are from the image display portion, in order to prevent deterioration of the conductance within the image display apparatus.

Further, on the other side of the getter holding jigs 525*a* through 525*e* provided with the getter 520*a* through 520*e*, i.e., the side of the display portion, the surface-conductive electron-emitting devices shown in FIG. 34 are provided on the rear plate 501, and fluorescent material 510 and metal back 511 is provided on the face plate 502.

Now, the getter holding jigs 525*a* through 525*e* provided with the getter 520*a* through 520*e* are situated in a zigzag manner, some closer to the image display portion and some further away, as shown in FIG. 35A. With this arrangement, no gaps between the getter pieces can be observed from the image display side.

When forming the above-described image display apparatus, the getter 520 is baked while the interior of the apparatus is being evacuated by means of an evacuation tube (not shown). The evacuation tube is sealed at the point the interior of the envelope reaches approximately $1\times10^{-8}$ Torr, meaning that sufficient evacuation has been conducted. After sealing off the evacuation tube, the getter 520 is heated and flashed by means of electrical induction heating, thus completing the image display apparatus.

After completion of the image display apparatus, the voltage (5 kV) applied to the metal back 511 formed on the face plate 502 causes the electrons emitted from the surface-conductive electron-emitting devices 530 to be accelerated, and strike fluorescent material 510. Consequently, an image is displayed.

The image display apparatus constructed as described above was excellent, with no short-circuiting of wiring between the upper and lower wiring following getter flashing. It was found that this image display apparatus could be evacuated via the evacuation tube in a shorter time than conventionally, and the pressure distribution within the image display apparatus was excellent without any dependence on distance from the getter adhesion surface being observed, and thus the working life expectancy of the image display apparatus was extended markedly.

Providing the getter scattering prevention member according to the present intention between the getter flashing portion and the image display portion provides the below-described advantages.

1. There is no passing over of getter material to the image display portion upon conducting getter flashing, thus avoiding undesirable effects such as shorting of wiring or undesirable effects to the electron-emitting devices and fluorescent material. Consequently, pixel defects owing to getter, which are fatal to the quality of an image display apparatus, are eradicated. Further, since there is no passing over of getter material as described above, there is no restriction to the image pattern (screen size) within the display area, as with known apparatuses which have taken into account beforehand the passing over of getter. Rather, according to the present intention, the entirety of the image display area can be employed as image pattern (screen size), thus allowing for a larger and more imposing screen on an image display apparatus of the same size.
2. There is no restriction regarding the direction of getter flashing of the getter flashing portion, so that the total area of the face plate, rear plate, outer frame, and getter scattering prevention walls of the getter flashing portion are subject to getter material adhesion, thus effectively securing a large getter area, so that evacuation by means of getter can be conducted for a long period of time.
3. Conductance of the getter scattering prevention member is good. Also, the conductance can be designed and controlled, so that the amount of time required for evacuation by means of the evacuation tube is shortened. Accordingly, manufacturing costs of image display apparatuses can be lowered greatly. Further, conductance is good as described above, so that pressure distribution within the image display apparatus is lightened, the amount of time required for evacuation of gas which is generated from the fluorescent material and the like upon driving the apparatus, this evacuation conducted by means of getter, is shortened, and as a result, an image display apparatus wherein irregularities in brightness and discharge are suppressed can be provided.

According to the above-described, an image display apparatus can be provided with a long working life expectancy, one which is stable over a long period of time, having high quality with no pixel defects or brightness irregularities, and at a low cost.

What is claimed is:

1. An image display apparatus, comprising:

a face plate carrying fluorescent material;

a rear plate carrying a set of electron-emitting devices;

a first spacer maintaining a distance between said face plate and said rear plate, said first spacer having a resistive surface;

getter means disposed surrounding said set of electron-emitting devices, said getter means comprising an evaporation-type getter and a non-evaporation-type getter; and a second spacer maintaining a distance between said face plate and said rear plate, said second spacer being an insulative spacer arranged between said evaporation-type getter and said set of electron-emitting devices.

2. An image display apparatus, comprising:

a face plate carrying fluorescent material;

a rear plate carrying a plurality of electron-emitting devices;

a first spacer maintaining a distance between said face plate and said rear plate, said first spacer having a resistive surface and arranged in an image display portion;

a non-evaporation-type getter disposed inside the image display portion;

a non-evaporation-type getter disposed outside the image display portion; and a second spacer maintaining a distance between said face plate and said rear plate, said second spacer being an insulative spacer arranged between said evaporation-type getter and said plurality of electron-emitting devices.

3. An image display apparatus, comprising:

a face plate carrying fluorescent material;

a rear plate carrying a set of electron-emitting devices;

a first spacer maintaining a distance between said face plate and said rear plate, said first spacer having a resistive surface;

an evaporation-type getter and a non-evaporation-type getter; and a second spacer maintaining a distance between said face plate and said rear plate, said second spacer being an insulative spacer arranged between said evaporation-type getter and said set of electron-emitting devices.

4. An image display apparatus, comprising:

a face plate carrying fluorescent material;

a rear plate carrying a set of electron-emitting devices;

a first spacer maintaining a distance between said face plate and said rear plate, said first spacer having a resistive surface;

getter means disposed surrounding said set of electron-emitting devices, said getter means comprising an evaporation-type getter; and a second spacer maintaining a distance between said face plate and said rear plate, said second spacer being an insulative spacer arranged between said evaporation-type getter and said set of electron-emitting devices.

5. An image display apparatus, comprising:

a face plate carrying fluorescent material;

a rear plate carrying a plurality of electron-emitting devices;

a first spacer maintaining a distance between said face plate and said rear plate, said first spacer having a resistive surface and arranged in an image display portion;

an evaporation-type getter disposed outside the image display portion; and a second spacer maintaining a distance between said face plate and said rear plate, said second spacer being an insulative spacer arranged between said evaporation-type getter and said plurality of electron-emitting devices.

6. An image display apparatus, comprising:

a face plate carrying fluorescent material;

a rear plate carrying a set of electron-emitting devices;

a first spacer maintaining a distance between said face plate and said rear plate, said first spacer having a resistive surface;

an evaporation-type getter; and a second spacer maintaining a distance between said face plate and said rear plate, said second spacer being an insulative spacer arranged between said evaporation-type getter and said set of electron-emitting devices.

* * * * *

UNITED STATES PATENT AND TRADEMARK OFFICE

CERTIFICATE OF CORRECTION

PATENT NO. : 6,486,600 B1
DATED : November 26, 2002
INVENTOR(S) : Hiroo Azuma et al.

It is certified that error appears in the above-identified patent and that said Letters Patent is hereby corrected as shown below:

Column 1,
Line 48, “on a” should read -- one --.

Column 4,
Line 66, “fiedities” should read -- fications --.

Column 5,
Line 4, “modifiedities,” should read -- modifications, --.

Column 10,
Line 19, “modifiedities” should read -- modifications --.

Column 11,
Line 56, “$1.3\times10^{31\ 8}$” should read -- $1.3\times10^{-8}$ --.

Column 15,
Line 32, “modifiedity.” should read -- modification. --.

Column 18,
Lines 26 and 31, “modifiedity” should read -- modification --.
Lines 40 and 44, “modifiedities” should read -- modifications --.

Column 21,
Lines 3 and 64, “modifiedity.” should read -- modification. --.

Column 22,
Line 43, “AºF,” should read -- A'F, --.
Line 44, “AºF.” should read -- A'F. --.

Column 23,
Line 52, “modifiedity.” should read -- modification. --.

Column 24,
Line 16, “modifiedity.” should read -- modification. --.

Column 25,
Line 26, “modifiedity.” should read -- modification. --.

UNITED STATES PATENT AND TRADEMARK OFFICE

CERTIFICATE OF CORRECTION

PATENT NO. : 6,486,600 B1 
DATED : November 26, 2002
INVENTOR(S) : Hiroo Azuma et al.

It is certified that error appears in the above-identified patent and that said Letters Patent is hereby corrected as shown below:

Column 29,
Line 14, "modifiedity," should read -- modification, --.

Column 43,
Line 23, "1 cos θ>H" should read -- 1 cos θ≧H --.

Column 44,
Line 5, "1500" should read -- 150º --.

Column 50,
Line 33, "a non-evaporation-type" should read -- an evaporation-type --.

Signed and Sealed this

Twenty-sixth Day of August, 2003

JAMES E. ROGAN
*Director of the United States Patent and Trademark Office*